US010927603B2

(12) United States Patent
Berry et al.

(10) Patent No.: US 10,927,603 B2
(45) Date of Patent: Feb. 23, 2021

(54) HIGH TRIP RATE DRILLING RIG

(71) Applicant: SCHLUMBERGER TECHNOLOGY CORPORATION, Sugar Land, TX (US)

(72) Inventors: Joe Rodney Berry, Cypress, TX (US); Robert Metz, Cypress, TX (US); Melvin Alan Orr, Tulsa, OK (US); Mark W. Trevithick, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 306 days.

(21) Appl. No.: 15/770,854

(22) PCT Filed: May 1, 2017

(86) PCT No.: PCT/US2017/030329

§ 371 (c)(1),
(2) Date: Apr. 25, 2018

(87) PCT Pub. No.: WO2017/190120

PCT Pub. Date: Nov. 2, 2017

(65) Prior Publication Data

US 2018/0328112 A1 Nov. 15, 2018

Related U.S. Application Data

(60) Provisional application No. 62/330,244, filed on May 1, 2016, provisional application No. 62/330,012, filed (Continued)

(30) Foreign Application Priority Data

Nov. 15, 2016 (WO) ..... PCT/US2016/061952
Nov. 15, 2016 (WO) ..... PCT/US2016/061956
Nov. 17, 2016 (WO) ..... PCT/US2016/062402

(51) Int. Cl.
*E21B 15/00* (2006.01)
*E21B 19/06* (2006.01)

(Continued)

(52) U.S. Cl.
CPC ..... *E21B 7/022* (2013.01); *E21B 3/02* (2013.01); *E21B 15/00* (2013.01); *E21B 19/06* (2013.01);

(Continued)

(58) Field of Classification Search
CPC ..... E21B 15/00; E21B 19/06; E21B 19/08; E21B 19/083; E21B 19/087;

(Continued)

(56) References Cited

U.S. PATENT DOCUMENTS 2,412,020 A 12/1946 Walters
3,253,995 A 5/1966 Antonsen et al.

(Continued)

FOREIGN PATENT DOCUMENTS

CN 104563912 A 4/2015
EP 0979924 A2 2/2000

(Continued)

*Primary Examiner* — Daniel P Stephenson

(57) ABSTRACT

A high trip rate drilling rig has first handling equipment to transport stands in/out of setback, second handling equipment to deliver stands to/from well center, and a hand-off position to set down stands for exchange between first/second equipment. Second equipment can include a top drive and a delivery arm translatable along the mast past each other, and a clasp on the arm slidable on the stand for constraint below the upper end, which can allow the top drive to engage/disengage the constrained stand above the arm. A high trip rate method transports stands in/out of setback, delivers stands to/from well center, and sets down and hands off stands at hand-off position between the setback transportation and well center delivery. The delivery (Continued)

can include engaging/dis engaging the top drive and a stand constrained by the clasp.

49 Claims, 50 Drawing Sheets

Related U.S. Application Data on Apr. 29, 2016, provisional application No. 62/330,016, filed on Apr. 29, 2016, provisional application No. 62/330,021, filed on Apr. 29, 2016, provisional application No. 62/330,200, filed on May 1, 2016.

(51) Int. Cl.

| | |
|---|---|
| ***E21B 19/083*** | (2006.01) |
| ***E21B 19/15*** | (2006.01) |
| ***E21B 19/20*** | (2006.01) |
| ***E21B 3/02*** | (2006.01) |
| ***E21B 7/02*** | (2006.01) |
| ***E21B 19/08*** | (2006.01) |

(52) U.S. Cl.
CPC ..... *E21B 19/08* (2013.01); *E21B 19/083* (2013.01); *E21B 19/155* (2013.01); *E21B 19/20* (2013.01)

(58) Field of Classification Search
CPC ..... E21B 19/155; E21B 19/20; E21B 3/02; E21B 7/022; E21B 19/14; E21B 19/24
See application file for complete search history.

(56) References Cited

U.S. PATENT DOCUMENTS

| | | | |
|---|---|---|---|
| 3,874,518 | A | 4/1975 | Swoboda, Jr. et al. |
| 4,042,123 | A | 8/1977 | Sheldon et al. |
| 4,274,778 | A | 6/1981 | Putnam et al. |
| 4,348,920 | A | 9/1982 | Boyadjieff |
| 4,421,179 | A | 12/1983 | Boyadjieff |
| 4,462,733 | A | 7/1984 | Langowski et al. |
| 4,501,522 | A | 2/1985 | Causer et al. |
| 4,610,315 | A | 9/1986 | Koga et al. |
| 4,621,974 | A | 11/1986 | Krueger |
| 4,715,761 | A | 12/1987 | Berry et al. |
| 4,738,321 | A | 4/1988 | Olivier |
| 4,850,439 | A | 7/1989 | Lund |
| 5,038,871 | A | 8/1991 | Dinsdale |
| 5,107,940 | A | 4/1992 | Berry |
| 5,211,251 | A | 5/1993 | Woolslayer |
| 5,423,390 | A | 6/1995 | Donnally et al. |
| 6,220,807 | B1 | 4/2001 | Sorokan |
| 6,513,605 | B1 | 2/2003 | Lodden |
| 6,557,651 | B1 | 5/2003 | Norby et al. |
| 6,591,471 | B1 | 7/2003 | Hollingsworth et al. |
| 6,591,904 | B2 | 7/2003 | Cicognani |
| 6,609,565 | B1 | 8/2003 | Andreychuk et al. |
| 6,748,823 | B2 | 6/2004 | Pietras |
| 6,779,614 | B2 | 8/2004 | Oser |
| 6,821,071 | B2 | 11/2004 | Woolslayer et al. |
| 6,860,337 | B1 | 3/2005 | Orr et al. |
| 6,976,540 | B2 | 12/2005 | Berry |
| 6,997,265 | B2 | 2/2006 | Berry |
| 7,043,814 | B2 | 5/2006 | Hollingsworth et al. |
| 7,114,235 | B2 | 10/2006 | Jansch et al. |
| 7,140,445 | B2 | 11/2006 | Shahin et al. |
| 7,219,744 | B2 | 5/2007 | Pietras |
| 7,246,983 | B2 | 7/2007 | Zahn et al. |
| 7,331,746 | B2 | 2/2008 | Wright et al. |
| 7,353,880 | B2 | 4/2008 | Pietras |
| 7,451,826 | B2 | 11/2008 | Pietras |
| 7,677,856 | B2 | 3/2010 | Standal |
| 7,681,632 | B2 | 3/2010 | Wood |
| 7,699,122 | B2 | 4/2010 | Eriksen |
| 7,794,192 | B2 | 9/2010 | Wright et al. |
| 7,802,636 | B2 | 9/2010 | Childers et al. |
| 7,828,085 | B2 | 11/2010 | Kuttel et al. |
| 7,931,077 | B2 | 4/2011 | Rudshaug et al. |
| 8,028,748 | B2 | 10/2011 | Laitolais, Jr. et al. |
| 8,052,370 | B2 | 11/2011 | Dekker et al. |
| 8,186,455 | B2 | 5/2012 | Childers et al. |
| 8,186,925 | B2 | 5/2012 | Littlely |
| 8,186,926 | B2 | 5/2012 | Littlely |
| 8,215,887 | B2 | 7/2012 | Fikowski et al. |
| 8,317,448 | B2 | 11/2012 | Hankins et al. |
| 8,397,837 | B2 | 3/2013 | Skogerbo |
| 8,550,761 | B2 | 10/2013 | Belik et al. |
| 8,584,773 | B2 | 11/2013 | Childers et al. |
| 8,839,881 | B1 | 9/2014 | Baumler |
| 8,839,884 | B2 | 9/2014 | Kuttel et al. |
| 8,910,719 | B2 | 12/2014 | Kockeis et al. |
| 8,949,416 | B1 | 2/2015 | Barnes et al. |
| 8,961,093 | B2 | 2/2015 | Springett et al. |
| 8,992,152 | B2 | 3/2015 | Nouwens et al. |
| 9,010,410 | B2 | 4/2015 | Story |
| 9,562,407 | B2 | 2/2017 | Magnuson |
| 9,624,739 | B2 | 4/2017 | Kannegaard et al. |
| 9,932,783 | B2 * | 4/2018 | Magnuson ..... E21B 19/14 |
| 10,053,934 | B2 * | 8/2018 | Keogh ..... E21B 19/24 |
| 10,465,455 | B2 * | 11/2019 | Berry ..... E21B 19/14 |
| 10,519,727 | B2 * | 12/2019 | Orr ..... E21B 3/02 |
| 2004/0069532 | A1 | 4/2004 | Keast |
| 2005/0173154 | A1 | 8/2005 | Lesko |
| 2007/0193750 | A1 | 8/2007 | Wright et al. |
| 2008/0164064 | A1 | 7/2008 | Belik et al. |
| 2008/0302525 | A1 | 12/2008 | Beierbach et al. |
| 2009/0053015 | A1 | 2/2009 | Zachariasen et al. |
| 2009/0274545 | A1 | 11/2009 | Liess et al. |
| 2010/0243325 | A1 | 9/2010 | Veeningen |
| 2010/0303586 | A1 | 12/2010 | Hankins et al. |
| 2010/0326672 | A1 | 12/2010 | Childers et al. |
| 2011/0079434 | A1 | 4/2011 | Belik et al. |
| 2011/0174483 | A1 | 7/2011 | Odell et al. |
| 2012/0020758 | A1 | 1/2012 | Springett et al. |
| 2012/0067642 | A1 | 3/2012 | Magnuson |
| 2012/0305261 | A1 | 12/2012 | Roodenburg et al. |
| 2013/0025937 | A1 | 1/2013 | Pilgrim et al. |
| 2013/0112395 | A1 | 5/2013 | Story |
| 2013/0220601 | A1 | 8/2013 | Ferrari |
| 2013/0284450 | A1 | 10/2013 | Roodenburg et al. |
| 2014/0110174 | A1 | 4/2014 | Childers et al. |
| 2014/0124218 | A1 | 5/2014 | Pilgrim |
| 2014/0202769 | A1 | 7/2014 | Magnuson |
| 2014/0328650 | A1 | 11/2014 | Hu |
| 2016/0060979 | A1 | 3/2016 | Magnuson |
| 2017/0234088 | A1 | 8/2017 | Orr et al. |
| 2018/0216405 | A1 * | 8/2018 | De Mul ..... E21B 7/02 |
| 2018/0328112 | A1 * | 11/2018 | Berry ..... E21B 19/083 |
| 2019/0017334 | A1 | 1/2019 | Loeyning et al. |
| 2019/0106950 | A1 | 4/2019 | Alvaer et al. |

FOREIGN PATENT DOCUMENTS

| | | | |
|---|---|---|---|
| RU | 2100565 | C1 | 12/1997 |
| RU | 2541972 | C2 | 2/2015 |
| SU | 1730422 | A1 | 4/1992 |
| WO | 9315303 | A1 | 8/1993 |
| WO | 0111181 | A1 | 2/2001 |
| WO | 0218742 | A1 | 3/2002 |
| WO | 2006059910 | A1 | 6/2006 |
| WO | 2010141231 | A2 | 12/2010 |
| WO | 2011016719 | A1 | 2/2011 |
| WO | 2011056711 | A2 | 5/2011 |
| WO | 2012148286 | A1 | 11/2012 |
| WO | 2014029812 | A2 | 2/2014 |
| WO | 2016204608 | A1 | 12/2016 |
| WO | 2017087200 | A1 | 5/2017 |
| WO | 2017087349 | A1 | 5/2017 |
| WO | 2017087350 | A1 | 5/2017 |

* cited by examiner

HIGH TRIP RATE DRILLING RIG

CROSS-REFERENCE TO RELATED APPLICATION

This application is the United States national phase entry of and claims priority to Patent Cooperation Treaty Number PCT/US2017/030329 filed on May 1, 2017 which claims priority to U.S. Provisional Patent Application 62/330,016 filed on Apr. 29, 2016. This application also claims priority to Patent Cooperation Treaty Numbers PCT/US2016/061952 and PCT/US2016/061956, both filed on Nov. 15, 2016, and Patent Cooperation Treaty Number PCT/US2016/062402 filed on Nov. 17, 2016. This application claims priority to U.S. Provisional Patent Application Ser. No. 62/330012 and 62/330021 filed on Apr. 29, 2016 and U.S. Provisional Patent Application Ser. Nos. 62/330200 and 62/330244 filed on May 1, 2016. All 9 of these applications are incorporated by reference herein in their entirety.

The present document claims the benefit of and priority to: U.S. Provisional Application Ser. No. 62/330,244, filed May 1, 2016; U.S. Provisional Application Ser. No. 62/330,012, filed Apr. 29, 2016; U.S. Provisional Application Ser. No. 62/330,016, filed Apr. 29, 2016; U.S. Provisional Application Ser. No. 62/330,021, filed Apr. 29, 2016; U.S. Provisional Application Ser. No. 62/330,200, filed May 1, 2016; International Application Number PCT/US2016/062402, filed Nov. 17, 2016; International Application Number PCT/US2016/061956, filed Nov. 15, 2016; and International Application Number PCT/US2016/061952, filed Nov. 15, 2016; each of which is hereby incorporated herein by reference in its entirety. All priority documents are hereby incorporated herein by reference in their entireties for all States where permitted.

BACKGROUND

In the exploration of oil, gas and geothermal energy, drilling operations are used to create boreholes, or wells, in the earth. Conventional drilling involves having a drill bit on the bottom of the well. A bottom-hole assembly is located immediately above the drill bit where directional sensors and communications equipment, batteries, mud motors, and stabilizing equipment are provided to help guide the drill bit to the desired subterranean target.

A set of drill collars are located above the bottom-hole assembly to provide a non-collapsible source of weight to help the drill bit crush the formation. Heavy weight drill pipe is located immediately above the drill collars for safety. The remainder of the drill string is mostly drill pipe, designed to operate under tension. A conventional drill pipe section is about 30 feet long, but lengths vary based on style. It is common to store lengths of drill pipe in "doubles" (2 connected lengths) or "triples" (3 connected lengths). When the drill string (drill pipe, drill collars and other components) are removed from the wellbore to change-out the worn drill bit, the drill pipe and drill collars are set back in doubles or triples until the drill bit is retrieved and exchanged. This process of pulling everything out of the hole and running it all back in is known as "tripping."

Tripping is non-drilling time and, therefore, an expense. Efforts have long been made to devise ways to avoid it or at least speed it up. Running triples is faster than running doubles because it reduces the number of threaded connections to be disconnected and then reconnected. Triples are longer and therefore more difficult to handle due to their length and weight and the natural waveforms that occur when moving them around. Manually handling moving pipe can be dangerous.

It is desirable to have a drilling rig with the capability to reduce the trip time. One option is to operate a pair of opposing masts, each equipped with a fully operational top drive that sequentially swings over the wellbore. In this manner, tripping can be nearly continuous, pausing only to spin connections together or apart. Problems with this drilling rig configuration include at least costs of equipment, operation and transportation.

Tripping is a notoriously dangerous activity. Conventional drilling practice requires locating a derrickman high up on the racking module platform, where he is at risk of a serious fall and other injuries common to manually manipulating the heavy pipe stands when racking and unracking the pipe stands when tripping. Personnel on the drill floor are also at risk, trying to manage the vibrating tail of the pipe stand, often covered in mud and grease of a slippery drill floor in inclement weather. In addition, the faster desired trip rates increase risks.

It is desirable to have a drilling rig with the capability to reduce trip time and connection time. It is also desirable to have a system that includes redundancies, such that if a component of the system fails or requires servicing, the task performed by that component can be taken-up by another component on the drilling rig. It is also desirable to have a drilling rig that has these features and remains highly transportable between drilling locations.

SUMMARY

A drilling rig system and method are disclosed for obtaining high trip rates, particularly on land based, transportable drilling rigs. The drilling rig can reduce non-productive time by separating the transport of tubular stands in and out of their setback position into a first function, and delivery of a tubular stand into or out of well center as a second function. The functions intersect at a stand hand-off position, where tubular stands are set down for exchange between tubular handling equipment.

Also disclosed are embodiments of an arrangement between a retractable top drive assembly and a tubular delivery arm that may allow the top drive to hoist or lower the drill string, while the tubular delivery arm simultaneously hoists only the stands in or out of well center. In some embodiments, the tubular delivery arm is positioned below the upper end of the stand in well center position to stabilize the upper end and make room for the top drive over the stand, to facilitate engaging or disengaging the top drive and the stand, e.g., with the string held in the rotary table.

In some embodiments, the drilling rig comprises first function tubular handling equipment to transport tubular stands in and out of a setback position on a setback platform; second function tubular handling equipment to deliver the tubular stands to and from a well center over a well; and a stand hand-off position between the first and second function tubular handling equipment to set down tubular stands for exchange at an intersection between the first function tubular equipment and the second function tubular equipment.

In some embodiments, a method to insert tubulars in or remove tubulars from a drill string in a well below a drill floor of a drilling rig may comprise using first tubular handling equipment to transport tubular stands in and out of a setback position on a setback platform; using second tubular handling equipment to deliver the tubular stands to and from a well center position over the well; setting down the tubular stands in a stand hand-off position at an intersection between the first and second tubular handling equipment; and exchanging the tubular stands between the first and second functions at the stand hand-off position.

In some embodiments of the drilling rig and method, the first tubular handling equipment may comprise an upper racking arm over a racking module and the setback platform, and the second tubular handling equipment may comprise a tubular delivery arm.

In some embodiments, a method to insert tubulars in or remove tubulars from a drill string in a well below a drilling rig may comprise a first tubular handling function comprising guiding upper portions of the tubular stands to transport the tubular stands in or out of a setback position on a setback platform; a second tubular handling function comprising guiding the upper portions of the tubular stands to deliver the tubular stands to or from a well center position over the well; setting down the tubular stands in a stand hand-off position located at an intersection between the first and second functions; and exchanging the tubular stands between the first and second tubular handling functions at the stand hand-off position.

In some embodiments, a method to insert tubulars in or remove tubulars from a drill string in a well below a drilling rig may comprise moving tubular stands between a racked position in a fingerboard assembly and a set down position in a stand hand-off position, located between the fingerboard assembly and a drilling mast; and retrieving and delivering the tubular stands between the stand hand-off position and a well center position over well center. The method in some embodiments may further comprise connecting or disconnecting the tubular stands and a drill string; engaging or disengaging the tubular stands and a top drive assembly; and lowering or hoisting the tubular stands connected to the drill string with the top drive assembly.

In some embodiments, a drilling rig may comprise a retractable top drive assembly vertically translatable along a mast; and a tubular delivery arm also vertically translatable along the mast and comprising a tubular clasp movable between well center and a position forward of the well center, e.g., a mousehole, a stand hand-off position, or a catwalk; where the tubular clasp is engageable with an upper end of a tubular stand and the tubular clasp is slidably engageable with the tubular stand below the upper end, e.g., to facilitate positioning an upper portion of the tubular stand in the well center position below the upper end.

In some embodiments, a method to insert tubulars in or remove tubulars from a drill string in a well below a drilling rig may comprise engaging a tubular clasp of a tubular delivery arm and an upper end of a tubular stand; moving the tubular clasp between a well center position over a well center and a position forward of the well center, e.g., a mousehole, a stand hand-off position, or a catwalk; positioning an upper portion of the tubular stand in the well center position with the clasp below the upper end; and engaging or disengaging a top drive and the constrained upper end of the tubular stand in the well center position.

In some embodiments, the stand hand-off position is a designated setdown position for transferring the next tubular stand to go into the well or to be racked, as handled between the tubular delivery arm and the upper racking arm. In one embodiment, the lower end of the stand hand-off position is located on a setback platform, e.g., beneath the drill floor where a lower racking arm can work with the upper racking arm.

In some embodiments, an upper stand constraint may be provided to clasp an upper portion of one of the tubular stands, e.g., near its top, to secure it in vertical orientation when at the stand hand-off position. The upper stand constraint may be mounted on the racking module. By securing an upper portion of a tubular stand at the stand hand-off position, the upper racking arm is free to progress towards the next tubular stand to be retrieved. The tubular delivery arm can lower along the mast to clasp the tubular stand held by the upper stand constraint above the upper stand constraint, e.g., at the upper end such as at the upset, without interfering with the path of the upper racking arm.

In some embodiments, a lower stand constraint may be provided to guide ascending and descending tubular stands to and away from the stand hand-off position and to secure the tubular stands vertically when at the stand hand-off position. A stand hand-off station may be located at the stand hand-off position, e.g., to provide automatic washing and doping of the pin connection. The terms "grease" and "dope" are used interchangeably herein. A grease dispenser may also be provided on the tubular delivery arm for automatic doping of the box end of the tubular stands.

In some embodiments, an intermediate stand constraint may be provided and attached to the V-door side edge of the center section of the substructure of the drilling rig, e.g., at or below the drill floor. The intermediate stand constraint may include a gripping assembly for gripping tubular stands to prevent their vertical movement while suspended over the mousehole to facilitate stand-building without the need for step positions in the mousehole assembly. The intermediate stand constraint may also have a clasp, and the ability to extend between the stand hand-off position and the mousehole.

In some embodiments, an upper racking arm can be provided to move tubular stands of drilling tubulars between any racking position within the racking module and the stand hand-off position, located between the mast and a fingerboard of the racking module.

In some embodiments, a setback platform is provided beneath a racking module for supporting stored casing and tubular stands, e.g., near ground level. A lower racking arm may be provided to control movement of the lower ends of tubular stands and/or casing while being moved between the stand hand-off position and their racked position on the platform. In some embodiments, movements of the lower racking arm are controlled to match movements of the upper racking arm to maintain the tubular stands in a vertical orientation.

In some embodiments, a lower stabilizing arm may be provided at the drill floor level, e.g., for guiding the lower portion of casing, drilling tubulars, and stands of the drilling tubulars between the catwalk, mousehole, and stand hand-off and well center positions.

In some embodiments, a tubular delivery arm can travel vertically along the structure of the same drilling mast as the top drive, e.g., with lifting capability less than that of the top drive, e.g., sufficient to hoist a tubular stand of drill pipe or drill collars. The tubular delivery arm can move tubular stands vertically and horizontally, e.g., in the drawworks to V-door direction, reaching positions that may include the centerline of the wellbore, a stand hand-off position, a mousehole, and a catwalk.

In some embodiments, a conventional non-retractable top drive may be used in conjunction with the tubular delivery arm and/or the stand hand-off position, with pauses to avoid conflict between the non-retractable top drive and the tubular delivery arm.

In some disclosed embodiments, tubular stand hoisting from the stand hand-off position and delivery to well center is accomplished by the tubular delivery arm, and drill string hoisting and lowering is accomplished by the retractable top drive. The retractable top drive and tubular delivery arm can pass each other in relative vertical movement on the same mast. Retraction capability of the retractable top drive, and tilt and/or rotation control of the tubular delivery arm, and compatible geometry of each may permit them to pass one another without conflict.

In some embodiments, either or both the top drive and the tubular delivery arm may be sufficiently retractable from the well center position, such that the top drive and the tubular delivery arm may, when one (or both) of them is retracted and the other is in the well center position, e.g., engaging a tubular in the well center position, be independently translated along the mast past one another. In these embodiments, a tubular stand can be disconnected and hoisted away from the drill string suspended in the wellbore using the tubular delivery arm, while the retractable top drive is travelling downwards into position to grasp and lift the drill string for hoisting. Similarly, a tubular stand can be positioned and stabbed over the wellbore with the tubular delivery arm, while the retractable top drive is travelling upwards into position above the stand for connection. The simultaneous paths of the retractable top drive and tubular delivery arm may significantly reduce trip time.

In some embodiments, an iron roughneck (tubular connection machine) may be provided such as mounted to a rail on the drilling floor or attached to the end of a drill floor manipulating arm to move between a retracted position, the well center and the mousehole. The iron roughneck can make-up and break-out tool joints, e.g., drill pipe, casing, and so on, over the well center and the mousehole. A second iron roughneck may be provided to dedicate a first iron roughneck to connecting and disconnecting tubulars over the mousehole, and the second iron roughneck can be dedicated to connecting and disconnecting tubulars over the well center.

The disclosed embodiments provide a novel drilling rig system that may significantly reduce the time needed for tripping of drill pipe. Some of the disclosed embodiments may further provide a system with one or more mechanically operative redundancies. The following disclosure describes "tripping in" which means adding tubular stands on a racking module to the drill string to form the complete length of the drill string to the bottom of the well so that drilling may commence. It will be appreciated by a person of ordinary skill that the procedure summarized below is generally reversed for tripping out of the well to remove tubular stands from the wellbore for orderly racking. Although a configuration related to triples is being described herein, a person of ordinary skill in the art will understand that such description is by example only as the disclosed embodiments are not limited, and would apply equally to singles, doubles and fourables.

The disclosed embodiments will become more readily understood from the following detailed description and appended claims when read in conjunction with the accompanying drawings in which like numerals represent like elements. The drawings constitute a part of this specification and include embodiments that may be configured in various forms. It is to be understood that in some instances various aspects of the disclosed embodiments may be shown exaggerated or enlarged to facilitate their understanding.

DETAILED DESCRIPTION

The following description is presented to enable any person skilled in the art to make and use the disclosed embodiments, and is provided in the context of an application and its requirements. Various modifications to the disclosed embodiments will be apparent to those skilled in the art, and the general principles defined herein may be applied to other embodiments and applications without departing from the spirit and scope of the disclosed embodiments. Thus, the disclosed embodiments are not intended to be limited to the embodiments shown, but is to be accorded the widest scope consistent with the principles and features disclosed herein.

Figure 1:
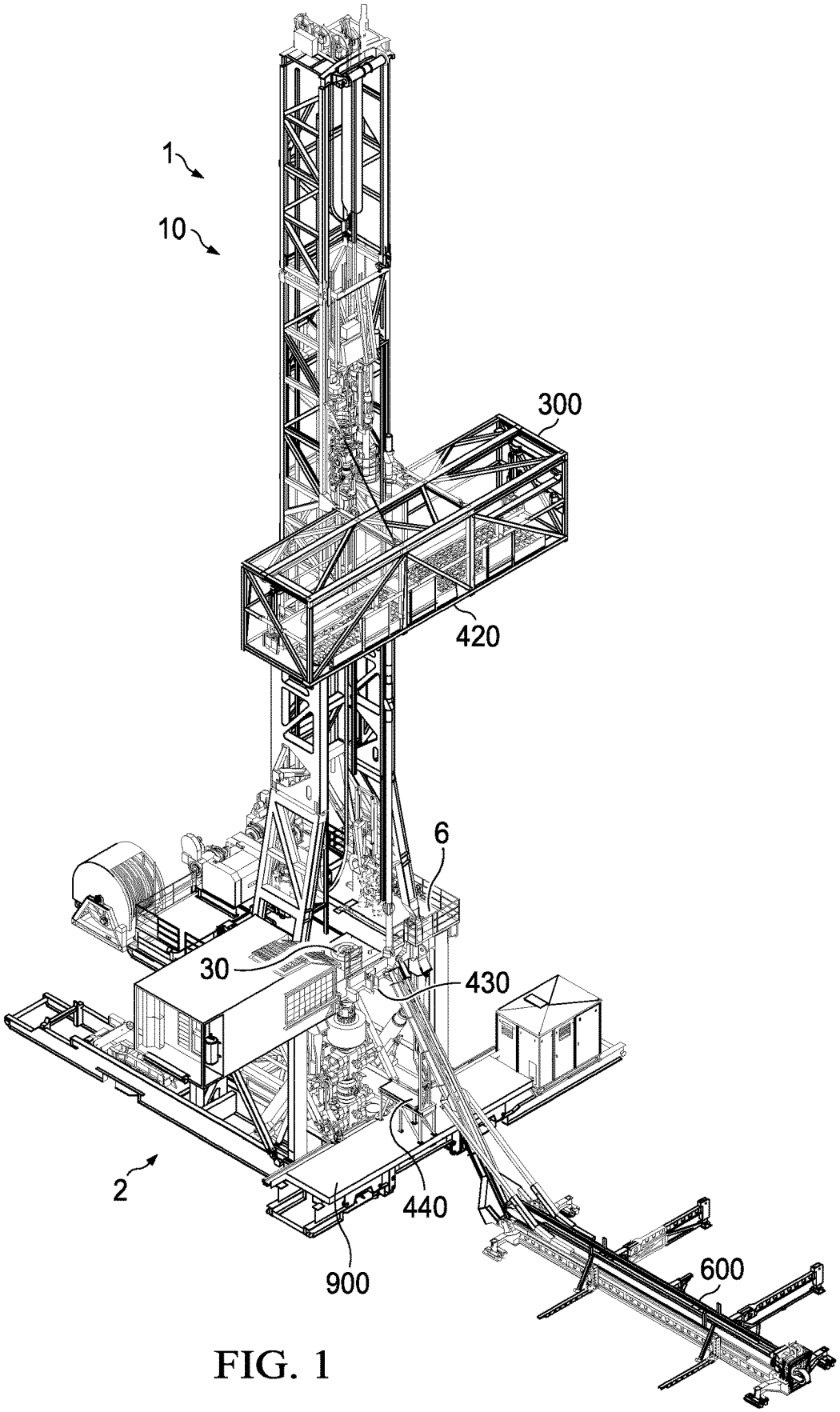
FIG. 1 is an isometric view of an embodiment of the drilling rig system of the disclosed embodiments for a high trip rate drilling rig.

FIG. 1 is an isometric view of an embodiment of the drilling rig system of the disclosed embodiments for a high trip rate drilling rig 1. FIG. 1 illustrates drilling rig 1 having the conventional front portion of the drill floor removed, and placing well center 30 near to the edge of drill floor 6. In this configuration, a setback platform 900 is located beneath the level of drill floor 6, and connected to base box sections of substructure 2 on the ground. In this position, setback platform 900 is beneath racking module 300 such that tubular stands 80 (see FIG. 33) located in racking module 300 will be resting on setback platform 900.

Having setback platform 900 near ground level may reduce the required size of the side boxes of substructure 2 and thus the side box transport weight. This configuration may also facilitate mitigation of the effects of wind against mast 10.

In this configuration, racking module 300 is located lower on mast 10 of drilling rig 1 than on conventional land drilling rigs, since tubular stands 80 are not resting at the level of drill floor 6. As a result, a secondary hoisting means may elevate tubular stands 80 to reach the level of drill floor 6, before they can be added to the drill string.

In some embodiments, a mousehole having a mousehole center (see FIG. 30) is located on the forward edge of drill floor 6 and extends downward beneath. An intermediate stand constraint 430 may be located adjacent to drill floor 6 and centered over mousehole center. A stand hand-off position 50 is located on setback platform 900, for example, and extends vertically upwards, unimpeded by another structure beneath racking module 300. A lower stand constraint 440 may be located on setback platform 900 and centerable over stand hand-off position 50, which may be forward of, and in alignment with, well center 30 and mousehole center.

Figure 2:
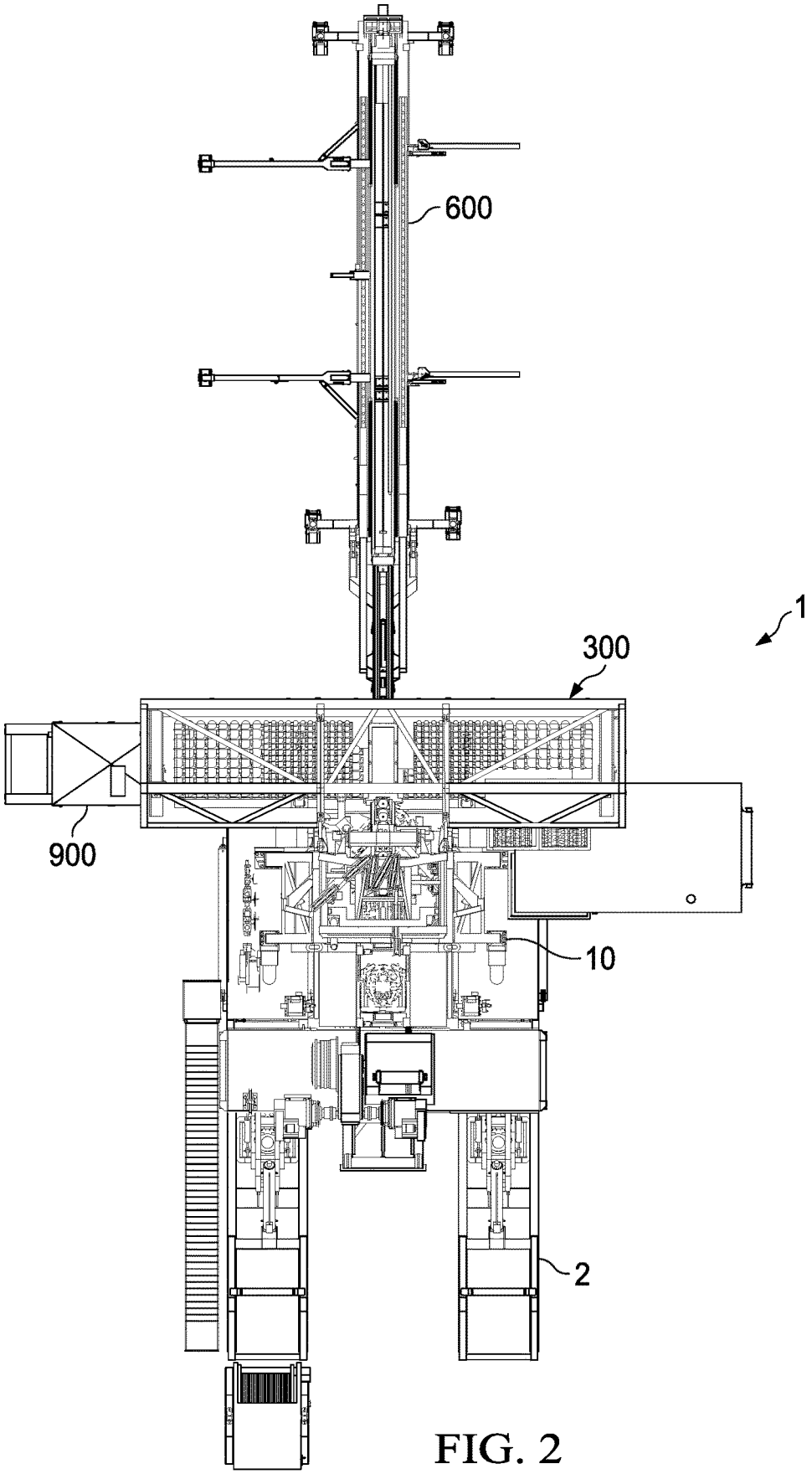
FIG. 2 is a top view of the embodiment of FIG. 1 of the disclosed embodiments for a high trip rate drilling rig.

FIG. 2 is a top view of the drilling rig 1 of FIG. 1. Racking module 300 has a frame 302 connected to a fingerboard assembly 310 (see FIG. 7), which may, if desired, have columns of racking positions 312 aligned perpendicular to conventional alignment. As so aligned, racking column positions 312 run in a V-door to drawworks direction. Drilling masts generally have a mast front or V-door side, and an opposite mast rear or drawworks side. Perpendicular to these sides are the driller's side and opposite off-driller's side.

As seen in FIG. 2, the racking positions for tubular stands 80 in racking module 300 align with space for racking tubular stands on setback platform 900. Racking module 300 and setback platform 900 can be size selected independent of the substructure 2 and mast 10 depending on the depth of the well to be drilled and the number of tubular stands 80 to be racked. In some embodiments, drilling rig 1 is thus scalable.

Figure 3:
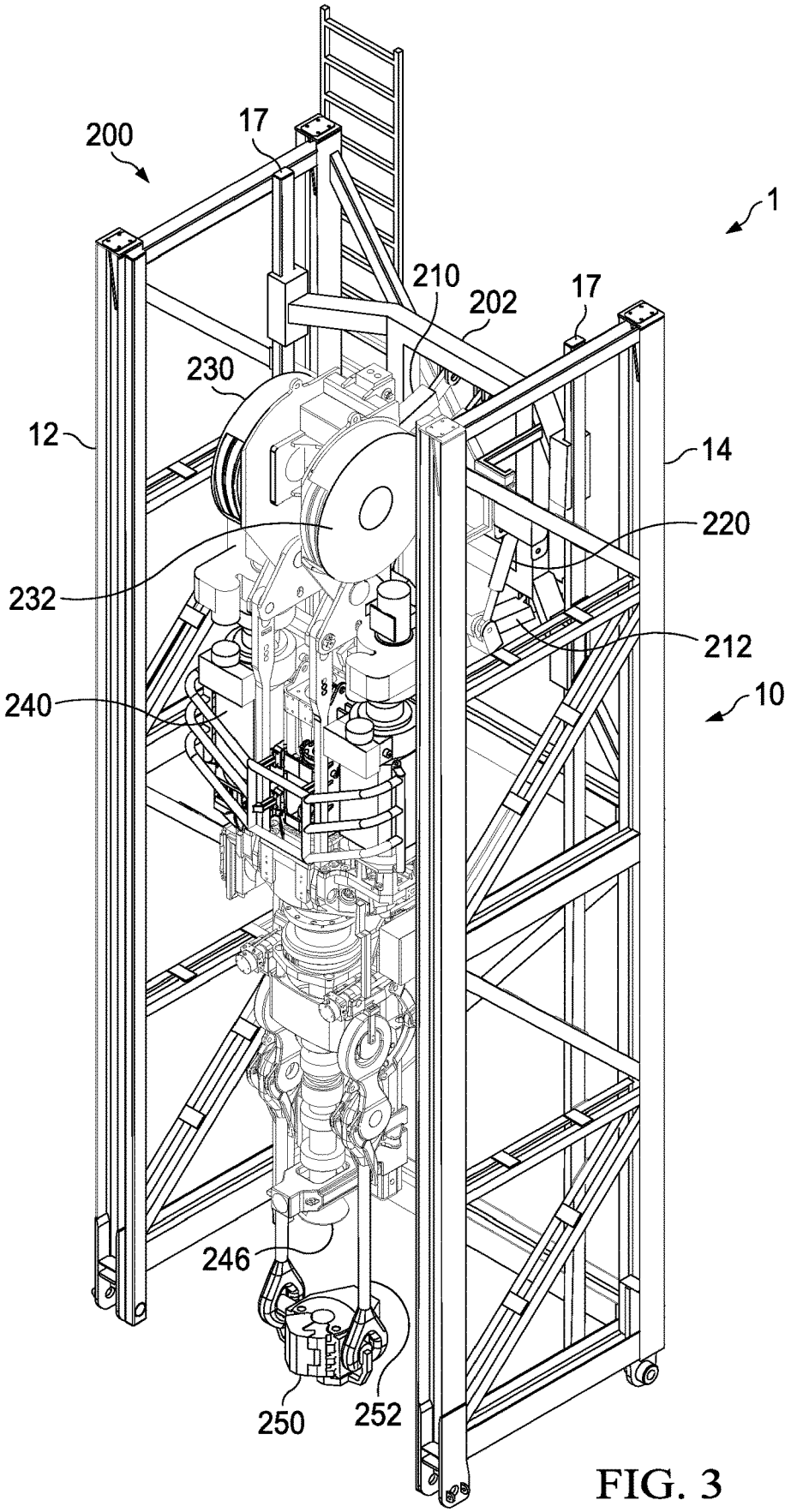
FIG. 3 is an isometric cut-away view of the retractable top drive in a drilling mast as used in an embodiment of the high trip rate drilling rig.

FIG. 3 is an isometric cut-away view of a retractable top drive assembly 200 in drilling mast 10 as used in an embodiment of drilling rig 1. Retractable top drive assembly 200 is generally comprised of a travelling block assembly (230, 232), a top drive 240, a pair of links 252 and an elevator 250, along with other various components. Retractable top drive assembly 200 may, for example, have a retractable dolly 202 that is mounted on guides 17 in mast 10. A first yoke 210 connects block assembly 230, 232 to dolly 202. A second yoke 212 extends between dolly 202 and top drive 240. In the embodiment illustrated, guides 17 are proximate to the rear side 14 of mast 10, and dolly 202 is vertically translatable on the length of guides 17.

In the embodiment illustrated, retractable top drive assembly 200 has a split block configuration including a driller's side block 230 and an off-driller's side block 232. This feature provides mast-well center path clearance additional to that obtained by the ability to retract dolly 202. The additional clearance may facilitate wire line access as well as facilitate avoiding conflict with a tubular delivery arm 500 (see FIG. 12) when tilted for well center 30 alignment of a tubular stand 80. An actuator 220 extends between second yoke 212 and dolly 202 to facilitate controlled movement of top drive 240 between a well center 30 position and a retracted position. Retractable top drive assembly 200 has a top drive 240 and a stabbing guide 246. Pivotal links 252 extend downward. An automatic elevator 250 is attached to the ends of links 252.

Figure 4:
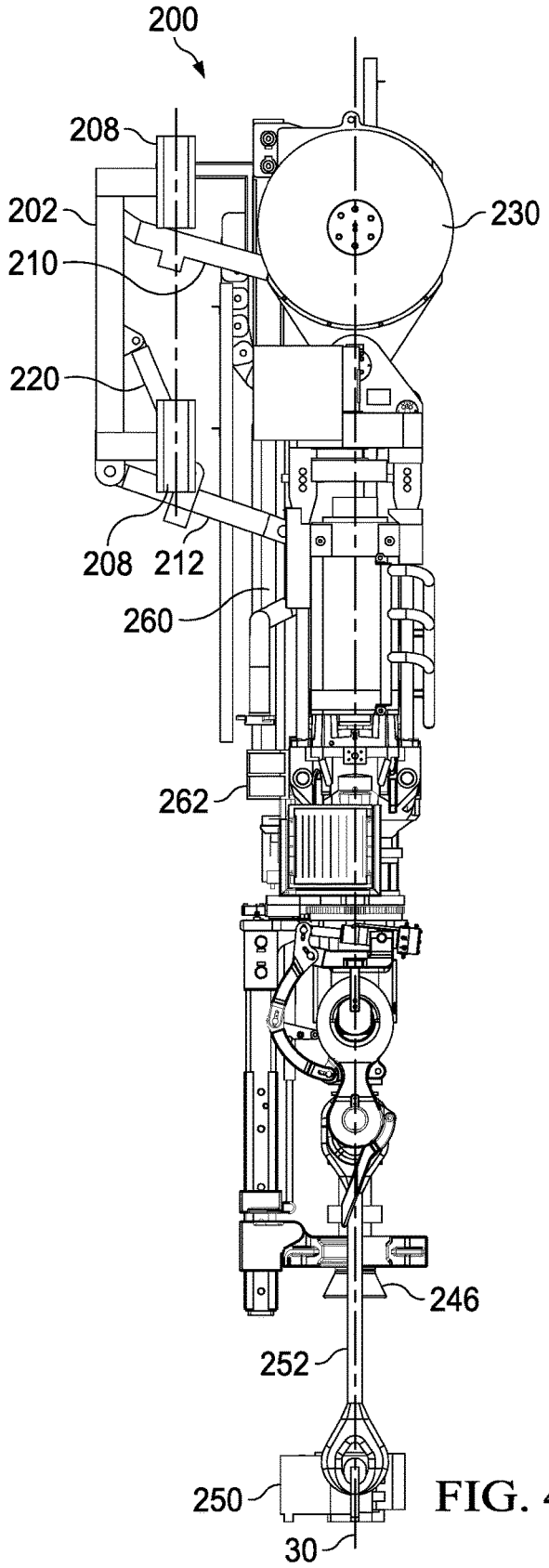
FIG. 4 is a side cut-away view of the retractable top drive, showing it positioned over the well center.

FIG. 4 is a side cut-away view of an embodiment of retractable top drive assembly 200, showing it positioned over well center 30. Retractable top drive assembly 200 may optionally have a torque tube 260 that functions to transfer torque from retractable top drive assembly 200 to dolly 202 and there through to guides 17 and mast 10. (See FIG. 6).

Figure 5:
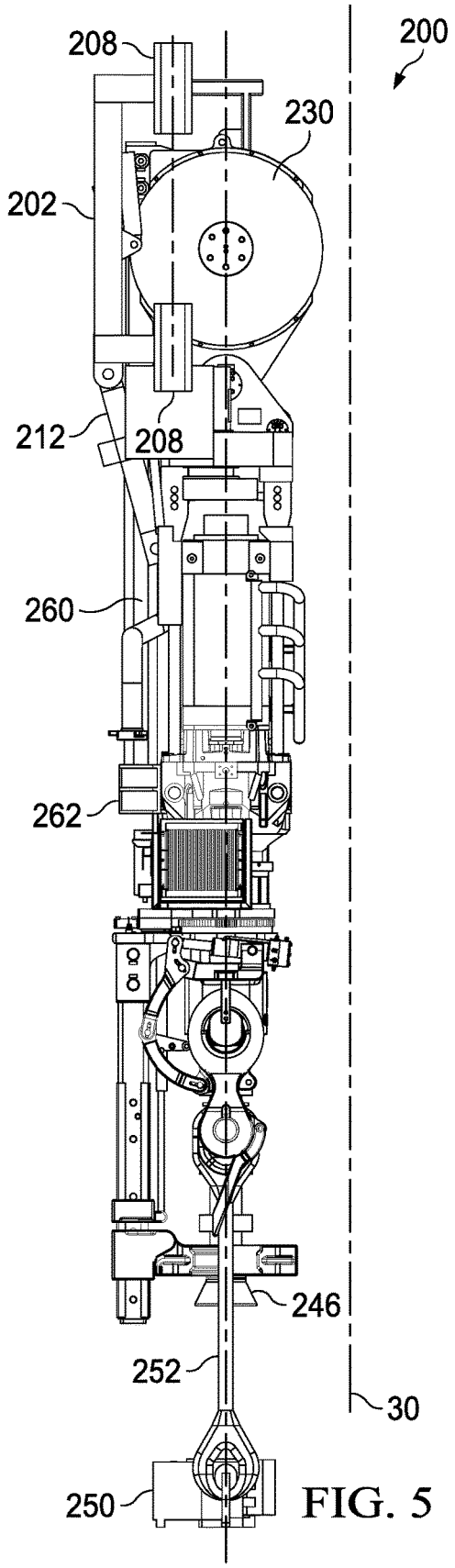
FIG. 5 is a side cut-away view of the retractable top drive, showing it retracted from its position over the well center.
Figure 12:
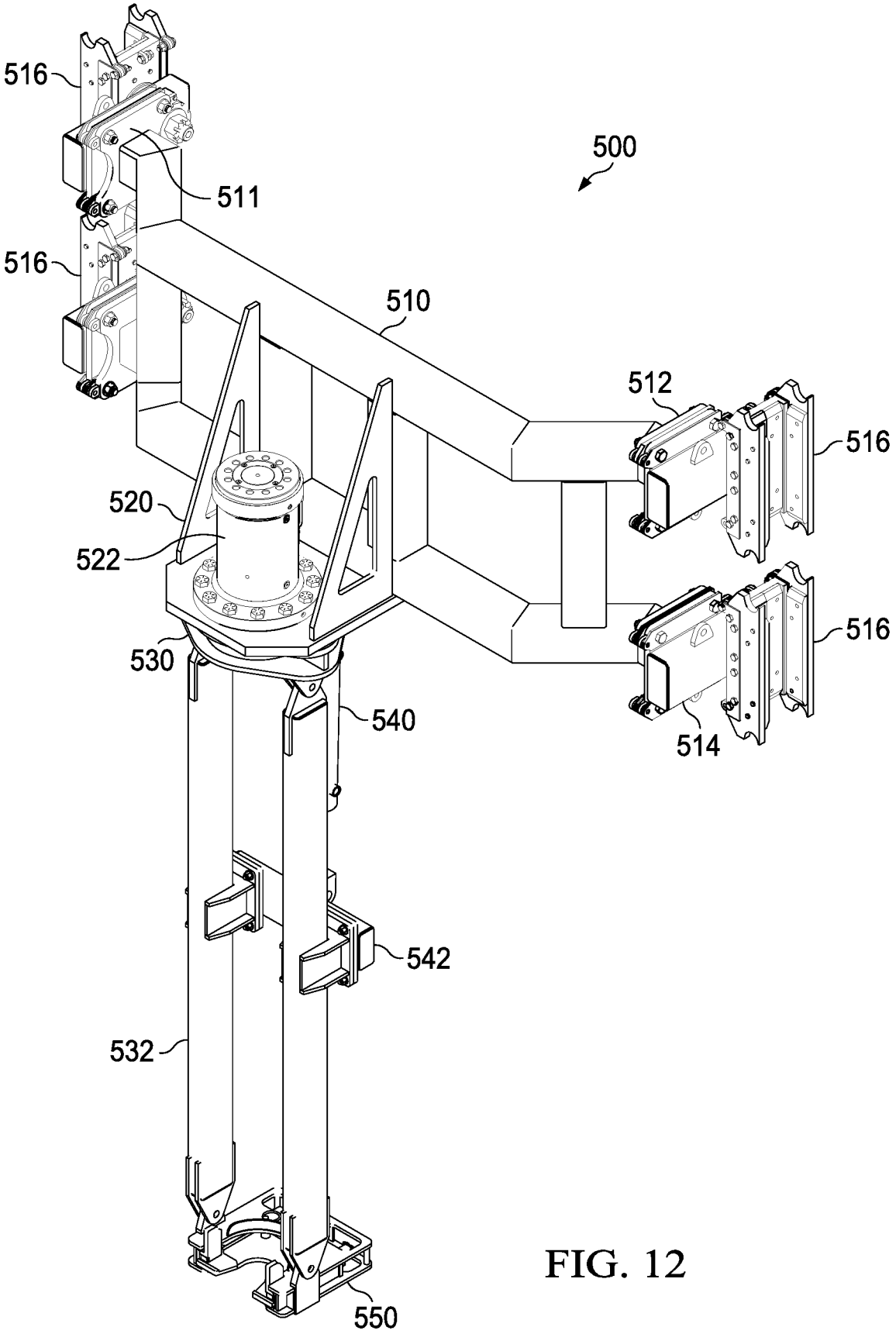
FIG. 12 is an isometric view of an embodiment of the tubular delivery arm component of the high trip rate drilling rig, shown having a free pivoting tubular clasp.
Figure 12A:
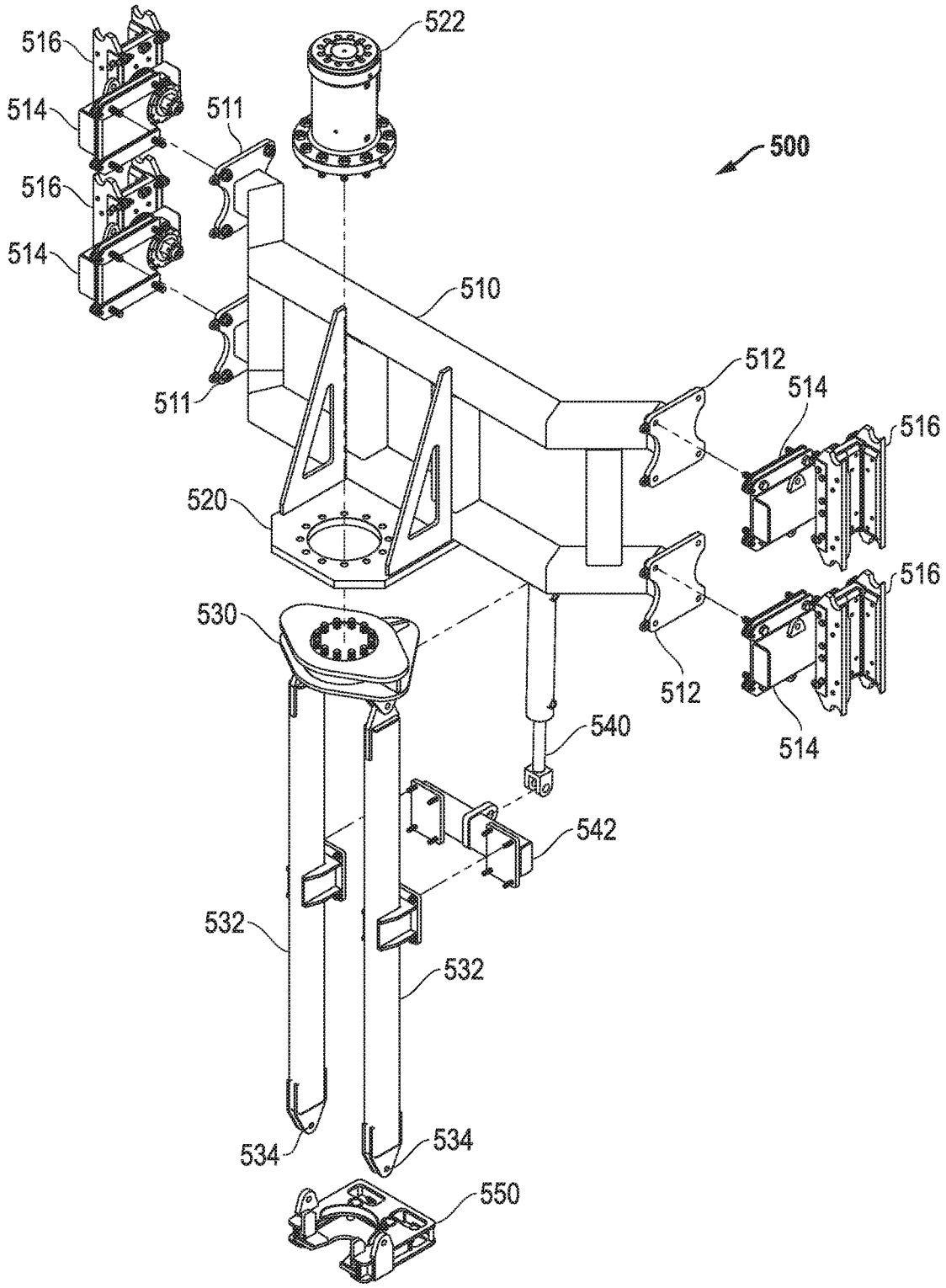
FIG. 12A is an isometric exploded view of the embodiment of the tubular delivery arm illustrated in FIG. 12.

FIG. 5 is a side cut-away view of the embodiment of retractable top drive assembly 200 in FIG. 4, showing it retracted from its position over well center 30 to avoid contact with a tubular delivery arm 500 that vertically translates the same mast 10 as retractable top drive assembly 200 (see FIG. 12).

Figure 6:
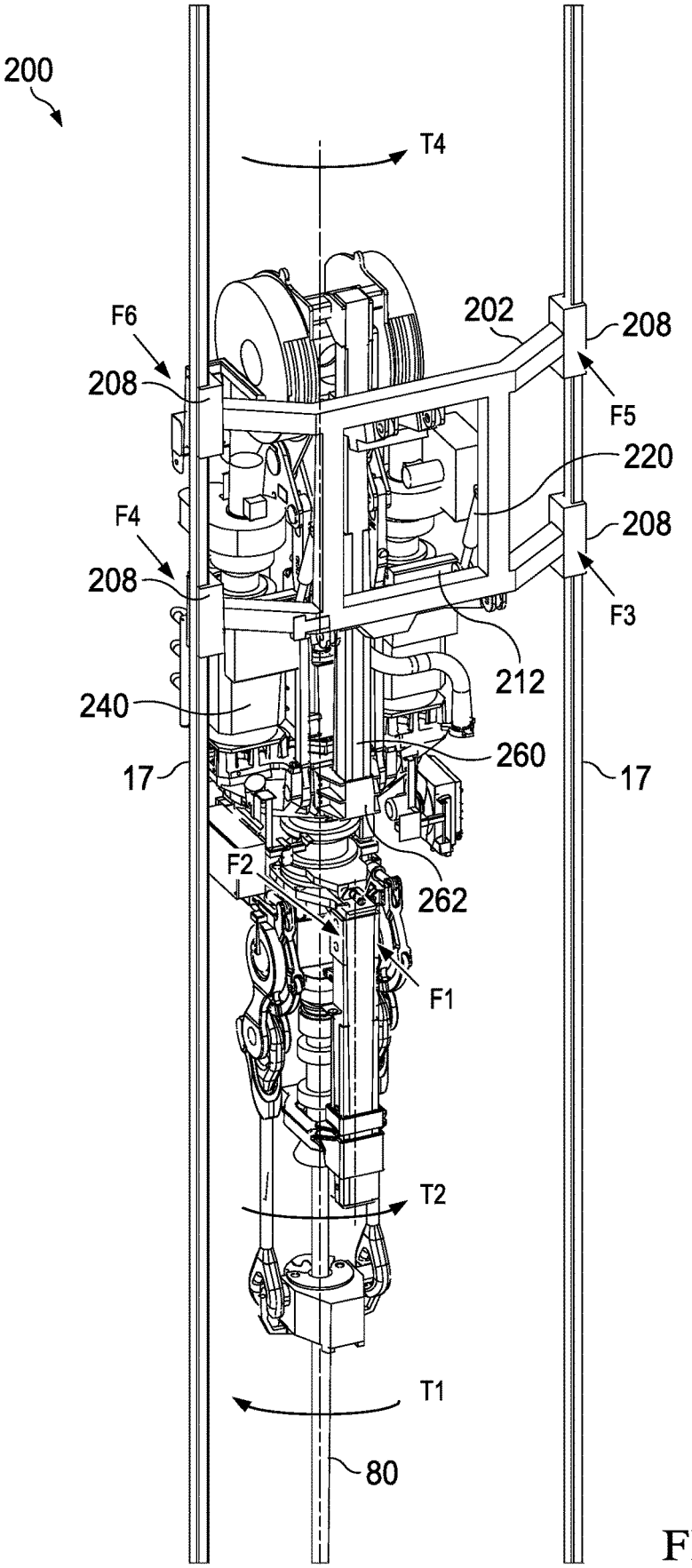
FIG. 6 is an isometric simplified block diagram illustrating the transfer of reaction torque to the top drive, to the torque tube, to the travelling block to the dolly, and to the mast.

FIG. 6 is an isometric cut-away view of an embodiment illustrating the force transmitted through torque tube 260 connected directly to the travel block assembly. Torque tube 260 is solidly attached to the travelling block assembly, such as between block halves 230 and 232, and thus connected to dolly 202 through yoke 210 and yoke 212. Torque may be encountered from make-up and break-out activity as well as drilling torque reacting from the drill bit and stabilizer engagement with the wellbore. Torque tube 260 may be engaged to top drive 240 at torque tube bracket 262 in sliding relationship. Top drive 240 is vertically separable from the travelling block assembly to accommodate different thread lengths in tubular couplings. The sliding relationship of the connection at torque tube bracket 262 accommodates this movement.

Slide pads 208 seen in the embodiment shown may be mounted on opposing ends of dolly 202 that extend outward in the driller's side and off-driller's side directions. Each dolly end may have an adjustment pad between the end and slide pad 208. Slide pads 208 engage guides 17 to guide retractable top drive assembly 200 up and down the vertical length of mast 10. Optional adjustment pads may permit precise centering and alignment of dolly 202 on mast 10, or a roller mechanism may be used.

In FIG. 6, retractable top drive assembly 200 is positioned over well center 30, and tubular stand 80 is right rotated by top drive 240 as shown by T1. When drilling related friction at the drill bit, stabilizers and bottom hole assembly components, is overcome to drill ahead, reactive torque T2 at top drive 240 may be transmitted to torque tube 260 through opposite forces F1 and F2 at bracket 262. Torque tube 260 transmits this torque to second yoke 212, which transmits the force to connected dolly 202., which in turn transmits the force to guides 17 of mast 10 through slide pads 208. By this configuration, torque tube 260 is extended and retracted with top drive 240 and the travelling block. By firmly connecting torque tube 260 directly to the travelling block and using a single dolly at top drive 240, retractable top drive assembly 200 can accommodate a tubular delivery arm 500 on common mast 10 without interference.

Figure 7:
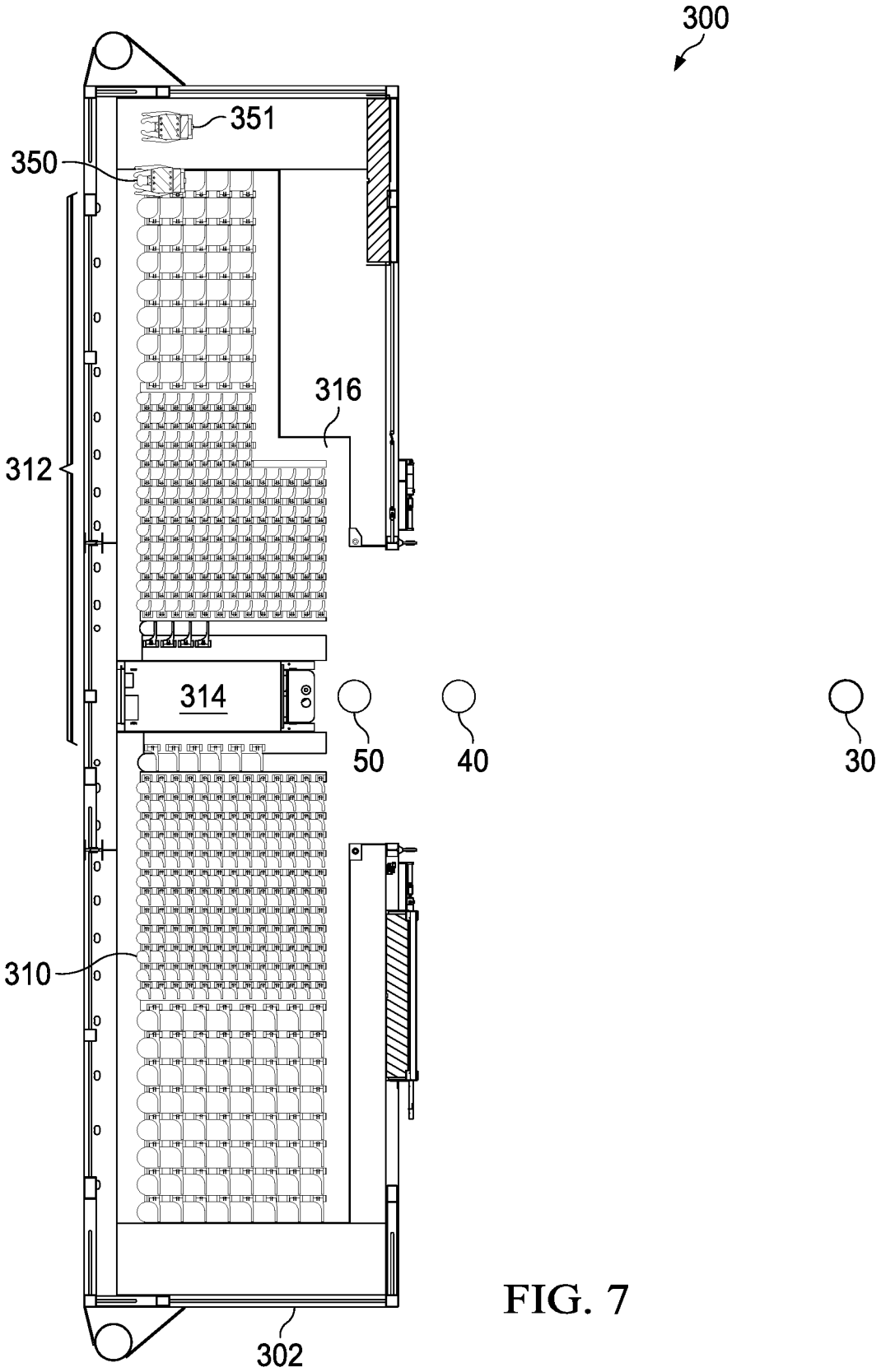
FIG. 7 is an isometric view of the racking module, illustrating the upper racking arm translating the alleyway and delivering the drill pipe to a stand hand-off position, according to the embodiments disclosed.

FIG. 7 is a top view of racking module 300, illustrating an operating envelope of upper racking arm 350, and the relationship of stand hand-off position 50 to racking module 300, in some embodiments. Fingerboard assembly 310 may provide a rectangular grid of multiple tubular storage positions between its fingers. Fingerboard assembly 310 has racking column positions 312 optionally aligned in the V-door to drawworks direction, opening in the direction of the mast 10, facing the opening on the front side of the mast, and a transverse alleyway 316 connecting to the stand hand-off position 50.

In some embodiments, an upper racking arm 350 can position its gripper 382 (see FIG. 10) over the tubular racking column positions 312 in the grid to hoist or set down a tubular stand 80 and transport it along the column to or from the alleyway 316. In FIG. 7, upper racking arm 350 is shown positioned to engage a stand to travel between the racking column position 312 toward alleyway 316, or positioned to set down the stand in the racking column position in the case of tripping out, for example. An optional second upper racking arm 351, also having the capability of positioning its gripper 382 over the tubular racking column position 312, may provide redundancy and/or speed up the process of moving tubular stands 80 between the racking positions 312 and the stand hand-off position 50.

Figure 8:
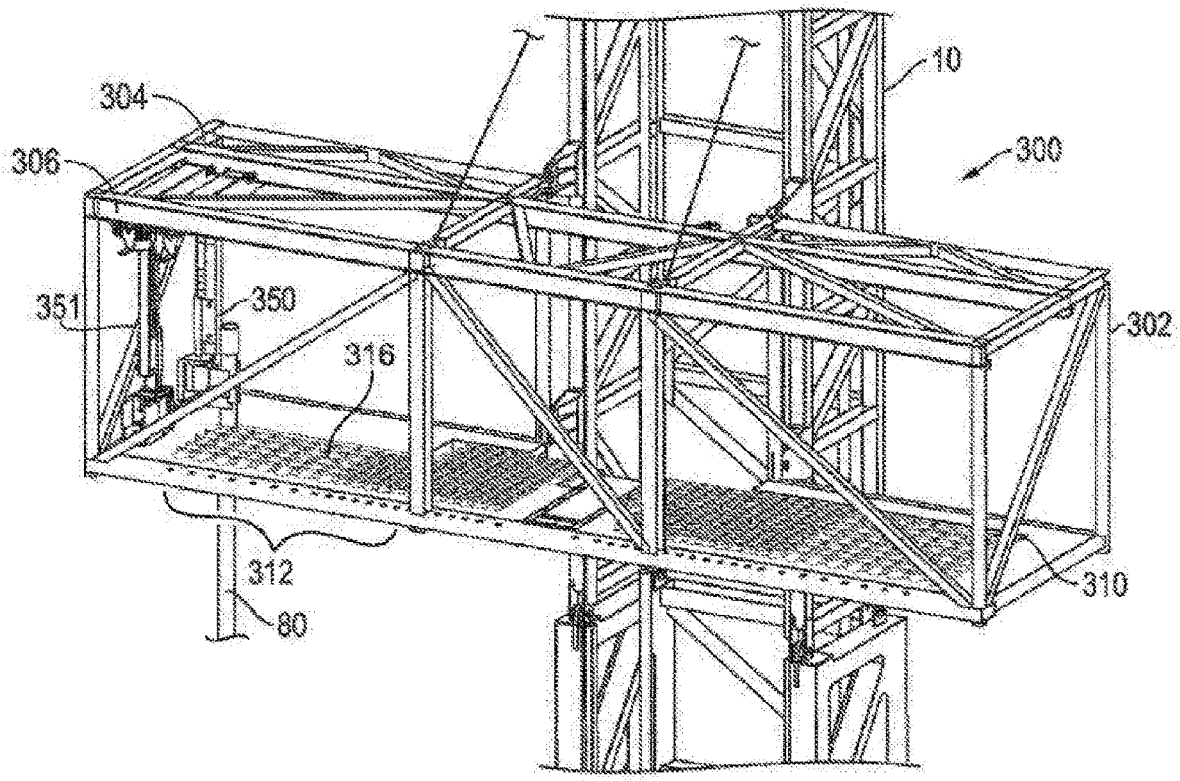
FIG. 8 is a top view of the racking module, illustrating the operating envelope of the upper racking arm and the relationship of the stand hand-off position to the racking module, well center and mousehole, according to the disclosed embodiments.

FIG. 8 is an isometric view of racking module 300 component of the disclosed embodiments, illustrating upper racking arm 350 hoisting tubular stand 80 and traversing alleyway 316 towards stand hand-off position 50, or away from the stand hand-off position 50 to be transported into racking column position 312.

Figure 9:
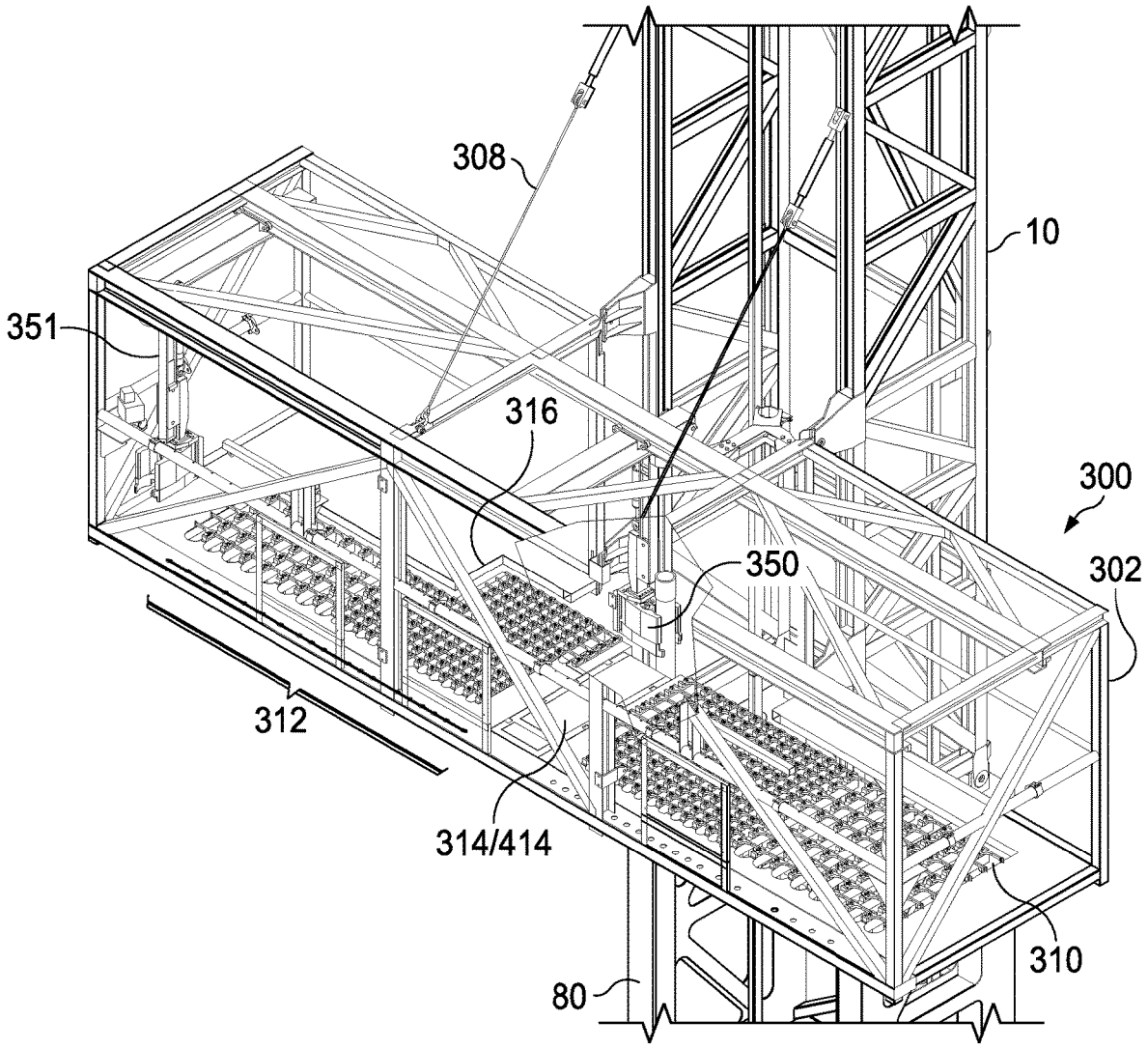
FIG. 9 is an isometric view of an embodiment of an upper racking arm component of the racking module of the disclosed embodiments, illustrating rotation of the arm suspended from the bridge.

FIG. 9 is an isometric view partially cut away to show an embodiment of racking module 300 in which upper racking arm 350 is hoisting tubular stand 80 in the stand hand-off position 50, after retrieving it from racking column position 312 of fingerboard assembly 310 (see FIG. 7) and carrying it along the alleyway 316 (see FIG. 8) in preparation for setting down the tubular stand 80 in the stand hand-off position 50 (see FIG. 11); or after retrieving tubular stand 80 from the stand hand-off position 50 (see FIG. 11) in preparation for traversing alleyway 316 (see FIG. 8) to deliver the tubular stand to a racking column position 312 of fingerboard assembly 310 (see FIG. 7).

After setting down a tubular stand 80, either in the stand hand-off position 50 (FIG. 9) or in the racking column position 312 (FIG. 7), the upper racking arm 350 can traverse over the fingerboard to return to retrieve and hoist a next one of the tubular stands. The retrieval and delivery of tubular stands 80 between the racking column position 312 and the stand hand-off position 50 is repeated as needed to rack or unrack the tubular stands.

Figure 10:
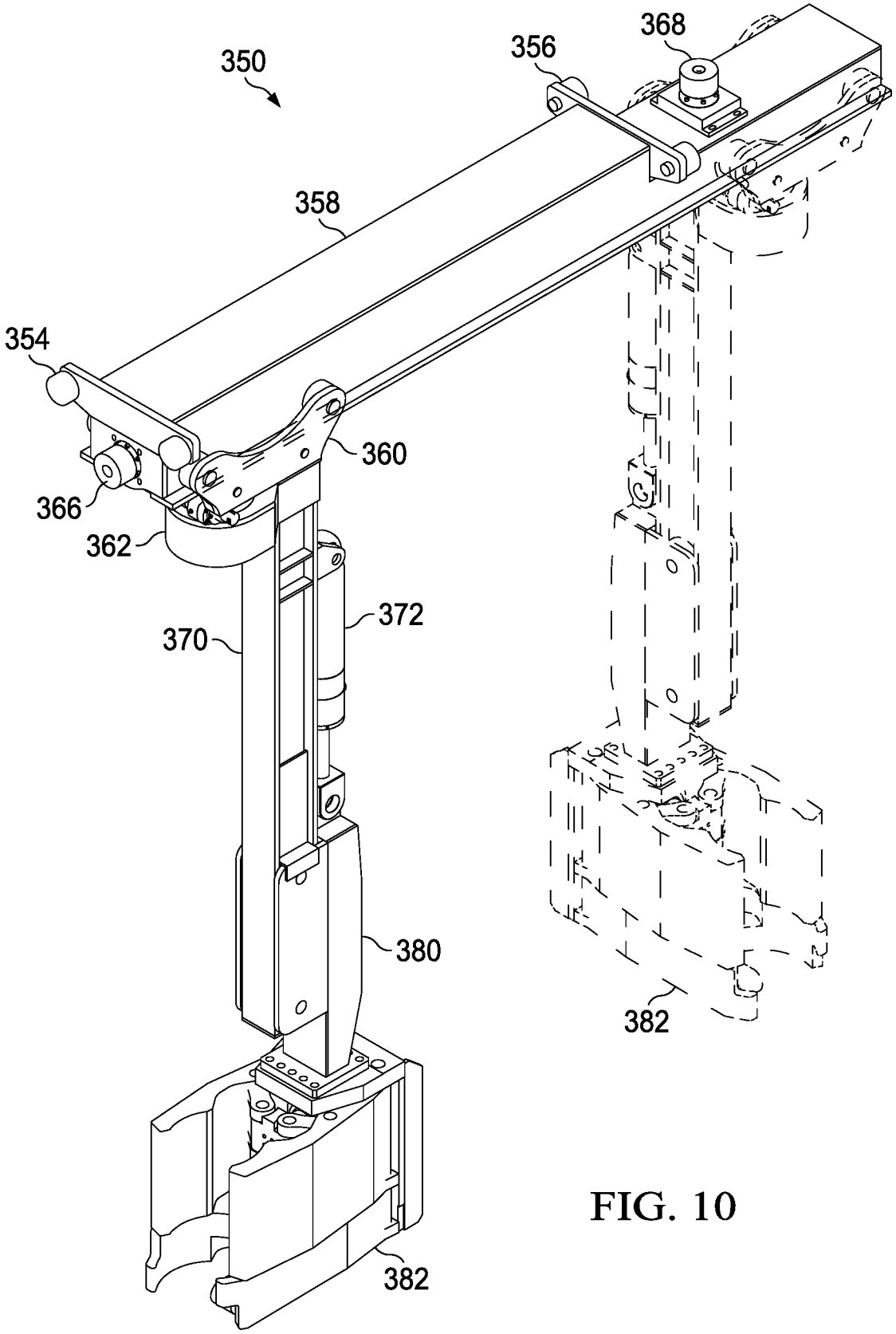
FIG. 10 is an isometric break-out view of an embodiment of the racking module, illustrating the upper racking arm translating the alleyway and delivering the tubular stand to the stand hand-off position.

FIG. 10 is an isometric view of an embodiment of upper racking arm 350, illustrating the travel range and rotation of gripper 382 connected to sleeve 380 and arm 370, as suspended from bridge 358. Upper racking arm 350 may have a bridge 358 spanning an inner runway 304 and an outer runway 306 supported on frame 302. Bridge 358 may have an outer roller assembly 354 and an inner roller assembly 356 for supporting movement of upper racking arm 350 along runways 306 and 304, respectively (see FIG. 11), on racking module 300.

In some embodiments, an outer pinion drive 366 extends from an outer end of bridge 358, and an inner pinion drive 368 extends proximate to the inner end (mast side) of bridge 358. Pinion drives 366 and 368 engage complementary geared racks on runways 306 and 304, and these may be electronically synchronized to inhibit crabbing. Actuation of pinion drives 366 and 368 permits upper racking arm 350 to horizontally translate the length of racking module 300.

In some embodiments, a trolley 360 is translatably mounted to bridge 358. The position of trolley 360 may be controlled by a rack and pinion drive system, a capstan cable drive system, and so on. In the embodiments illustrated, trolley pinion drive 364 engages a complementary geared rack on bridge 358. Actuation of the drive 364 permits trolley 360 to horizontally translate the length of bridge 358.

In some embodiments, a rotary actuator 362 may be mounted to trolley 360, and an arm 370 may be connected at an offset to the rotary actuator and thus trolley 360. Gripper 382 extends perpendicularly in relation to the lower end of arm 370, and in the same plane as the offset. Gripper 382 is attached to sleeve 380 for gripping tubular stands 80 (see FIG. 9) racked in racking module 300. Sleeve 380 is mounted to arm 370 in vertically translatable relation, as further described below, and actuation of the rotary actuator 362 causes rotation of gripper 382. In some embodiments, a centerline of the rotary actuator 362 may extend downward from the center of rotation of as a common axis with the centerline of tubular stand 80 gripped by gripper 382, such that rotation of gripper 382 results in centered rotation of tubular stands 80 without lateral movement. The ghost lines of this view show arm 370 and gripper 382 rotated 90 degrees by rotary actuator 362. As shown, and as described above, the centerline of a stand of tubular stand 80 gripped by upper racking arm 350 is maintained in its lateral position, without lateral movement, when arm 370 is rotated.

As stated above, sleeve 380 may be mounted to arm 370 in vertically translatable relation, such as by slide bearings, rollers, or other method. In the embodiment illustrated, a tandem cylinder assembly 372 is connected between arm 370 and sleeve 380. Tandem cylinder assembly 372 comprises a counterbalance cylinder and a lift cylinder. Actuation of the lift cylinder is operator controllable with conventional hydraulic controls. Tubular stand 80 is hoisted by retraction of the lift cylinder. The counterbalance cylinder of the tandem cylinder assembly 372 is in the extended position when there is no load on gripper 382, and when tubular stand 80 is set down, the counterbalance cylinder retracts to provide a positive indication of set down of tubular stand 80. Set down retraction of the counterbalance cylinder is measured by a transducer (not shown) such as a linear position transducer. The transducer provides this feedback to prevent destructive lateral movement of tubular stand 80 before it has been lifted.

Figure 11:
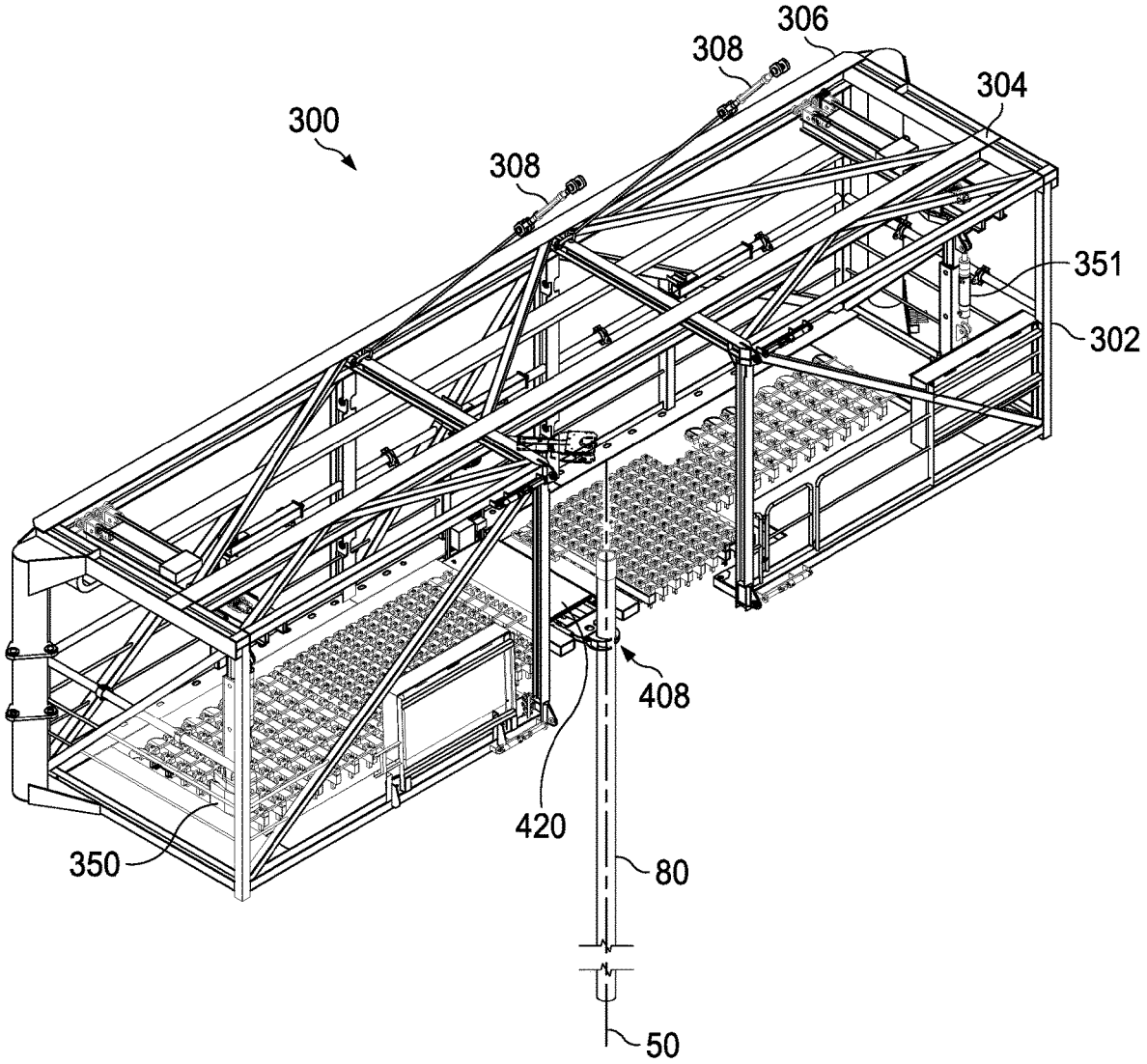
FIG. 11 an isometric view of the racking module from the opposite side, illustrating the upper stand securing the tubular stand in position at the stand hand-off position, according to the embodiments disclosed.

FIG. 11 is an isometric view of an embodiment of the racking module 300 of FIG. 7 and the upper racking arm 350 of FIG. 10, shown from the opposite side to illustrate clasp 408 of upper stand constraint 420 holding tubular stand 80 at stand hand-off position 50. Mast 10 is removed from this view for clarity. With the tubular stand 80 constrained at stand hand-off position 50, upper racking arm 350 is free to travel into position to hoist the next tubular stand 80 from the racking column position 312, or to retrieve the tubular stand 80 from the stand hand-off position 50 in the case of tripping out, for example. Upper stand constraint 420 can be used to secure tubular stand 80 in place at stand hand-off position 50, e.g., restricting horizontal movement and optionally allowing vertical movement. This facilitates delivery of tubular stand 80 and other tubular stands (such as drill collars) between the stand hand-off position 50 and upper racking arms 350, 351 and also between the stand hand-off position 50 and tubular delivery arm 500 or retractable top drive assembly 200.

In some embodiments, carriage 404 (FIG. 11B) of upper stand constraint 420 can extend further towards well center 30 to tilt tubular stand 80 sufficiently to render it accessible to retractable top drive assembly 200. This allows upper stand constraint 420 to provide a redundant mechanism to tubular delivery arm 500. In some embodiments, upper stand constraint 420 may also be used to deliver certain drill collars and other heavy tubular stands 80 that may exceed the lifting capacity of tubular delivery arm 500.

Figure 11A:
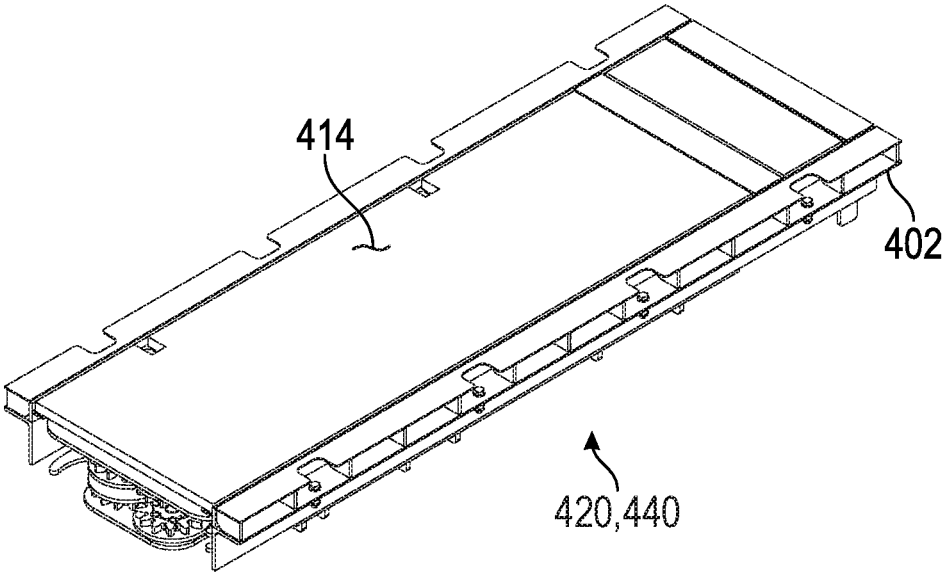
FIG. 11A is an isometric view of an embodiment of a tubular stand constraint, illustrating the carriage retracted and the clasp open.

FIG. 11A is an isometric view of an embodiment of upper stand constraint 420 or lower stand constraint 440, shown with carriage 404 (FIG. 11) retracted. Upper stand constraint 420 as shown in this embodiment can be positioned high above drill floor 6, on racking module 300 (FIG. 11). The stand constraint 440 as shown in this embodiment can also be positioned below drill floor 6, on setback platform 900 (see FIG. 1). In this configuration, the respective alleyway 316, 912 (FIGS. 7, 33) is clear to allow a tubular stand 80 to be moved to or from the stand hand-off position 50.

Figure 11B:
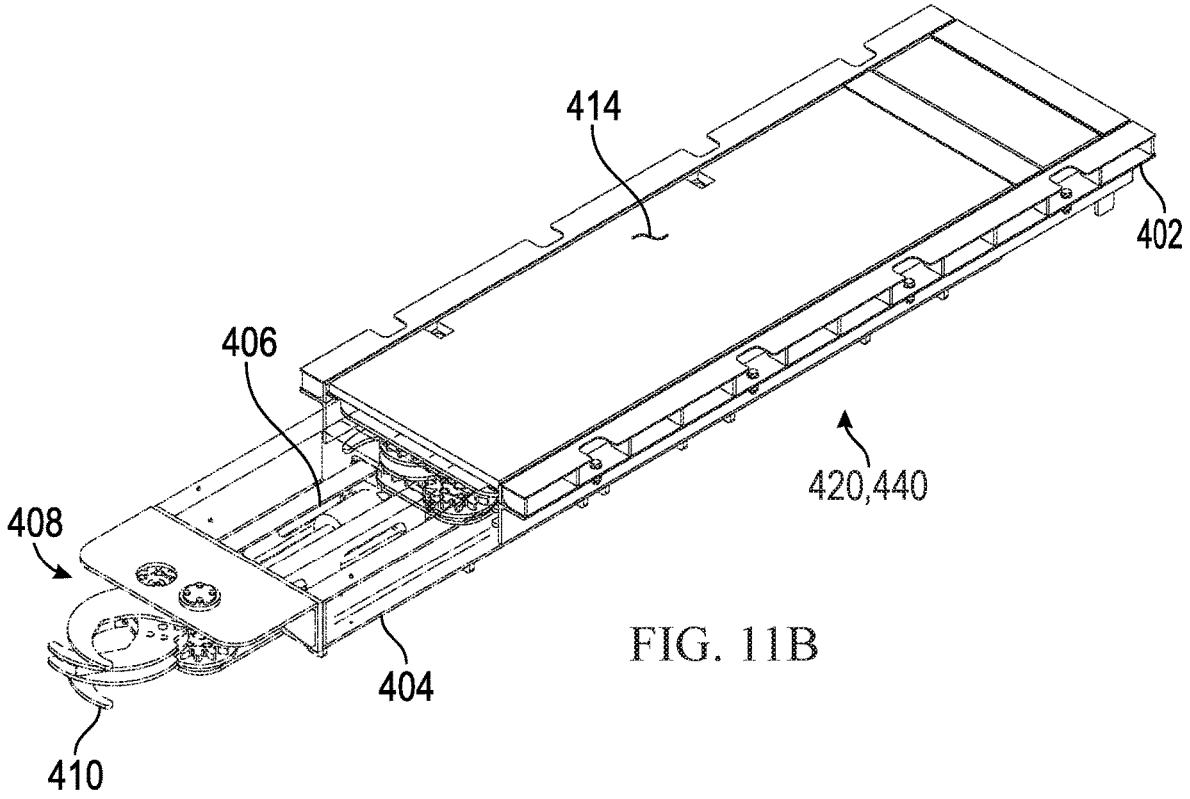
FIG. 11B is an isometric view of an embodiment of a tubular stand constraint, illustrating the carriage extended and the clasp closed, as it would be to restrain a tubular stand.

FIG. 11B is an isometric view of stand constraint 420,440 of FIG. 11A, according to some embodiments, illustrating carriage 404 extended and clasp 408 closed, as it would be around a tubular stand 80 received in the stand hand-off position 50. Stand constraint 420,440 has a frame 402. A surface 414 forms the top of stand constraint 420,440. A carriage 404 is connected to frame 402 in an extendable relationship. A carriage actuator 406 is connected between frame 402 and carriage 404 and is operable to extend and retract carriage 404 from frame 402. A clasp 408 is pivotally connected to the end of carriage 404. A clasp actuator is operable to open and close clasp 408.

In some embodiments, clasp 408 can be self-centering to permit closure of clasp 408 around a full range of drilling tubulars 80, including casing 82, drill collars 84 and drill pipe 86. In some embodiments, clasp 408 slidably receives the tubular stand 80 and does not inhibit vertical movement, allowing the tubular stand 80 to be hoisted or set down while the clasp 408 is engaged. In one embodiment, clasp 408 comprises opposing claws 410.

FIG. 12 is an isometric view of an embodiment of tubular delivery arm 500 of the disclosed embodiments, and FIG.

12A is an isometric exploded view. Retractable top drive assembly 200 provides a first tubular handling device that vertical translates mast 10. Tubular delivery arm 500 provides a second tubular handling functionality that may be, for example, vertically translatable along the same mast 10 of transportable land drilling rig 1, without physically interfering with retractable top drive assembly 200. In some embodiments, tubular delivery arm 500 comprises a dolly 510. In one embodiment, adjustment pads 514 are attached to ends 511 and 512 of dolly 510. A slide pad 516 may be located on each adjustment pad 514, and configured for sliding engagement with front side 12 of mast 10 of drilling rig 1. Adjustment pads 514 permit precise centering and alignment of dolly 510 on mast 10. In other embodiments, rollers, rack and pinion, or other arrangements may be incorporated in place of or in addition to slide pads 516.

In some embodiments, an arm bracket 520 may extend outward from dolly 510 in the V-door direction. An arm 532 or pair of arms 532 may be pivotally and rotationally connected to depend from arm bracket 520. An actuator bracket 542 is connected between arms 532. A tilt actuator 540 is pivotally connected between actuator bracket 542 and one of either dolly 510 or arm bracket 520, e.g., drive plate 530, to control the pivotal relationship between arm 532 and dolly 510.

Rotary actuator 522 can be provided, according to some embodiments, for rotational control of arm 532 relative to dolly 510. A tubular clasp 550 is pivotally connected to the lower end of each arm 532, to engage tubular stand 80 below the dolly 510 and provide a clear horizontal path between well center position 30 and stand hand-off position. In an embodiment, rotary actuator 522 is mounted to arm bracket 520 and has a drive shaft extending through arm bracket 520. A drive plate 530 is rotatably connected to the underside of arm bracket 520 and connected to the drive shaft of rotary actuator 522. In this embodiment, clasp 550 may be optionally rotated to face tubular stand 80 at stand hand-off position 50 facing the V-door direction. Flexibility in orientation of clasp 550 reduces manipulation of tubular delivery arm 500 to capture tubular stand 80 at stand hand-off position 50 by eliminating the need to further rise, tilt, pass, and clear tubular stand 80.

A centerline of a tubular stand 80 secured in clasp 550 may be located between pivot connections 534 at the lower ends of each arm 532. In this manner, clasp 550 can be self-balancing to suspend a tubular stand 80 vertically, e.g., depending from the clasp 550, without the need for additional angular controls or adjustments.

Figure 13:
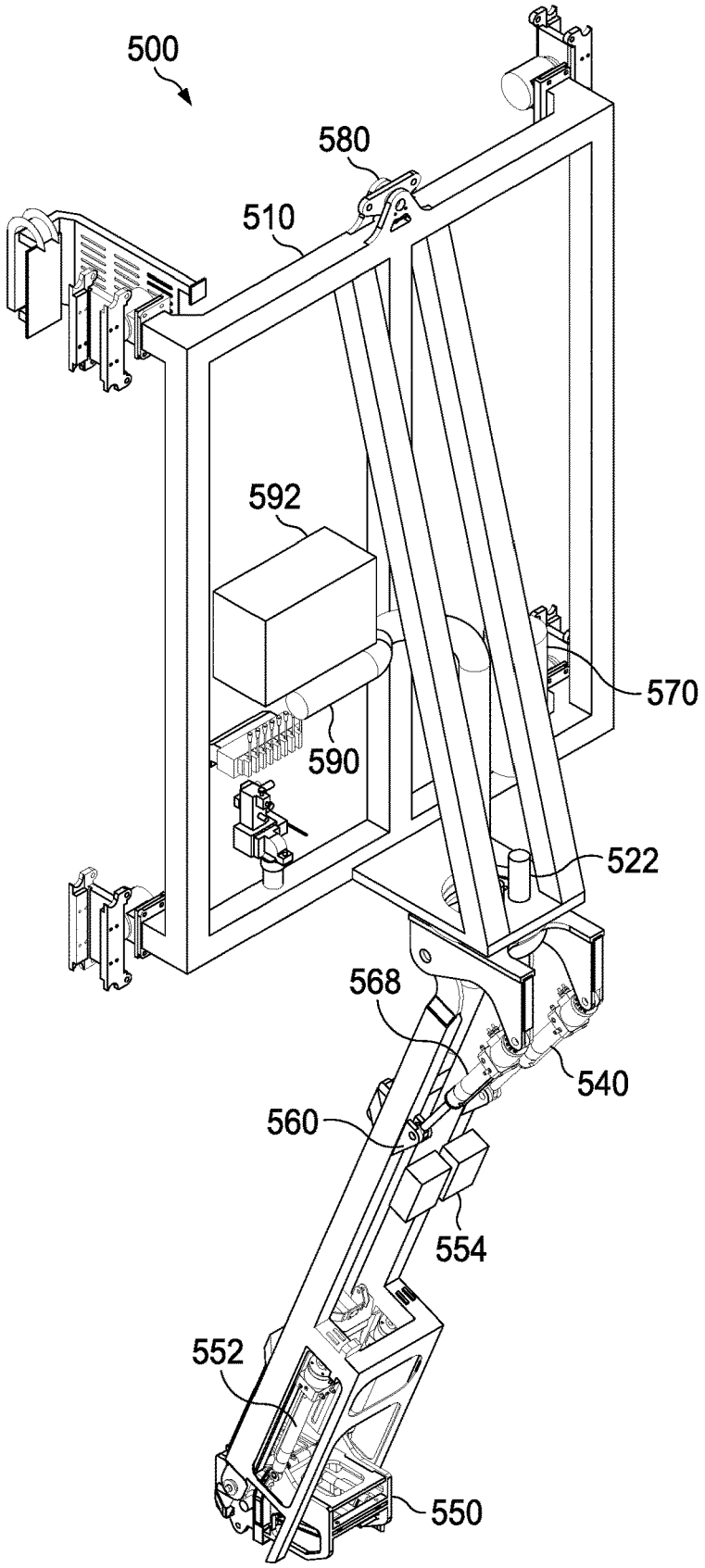
FIG. 13 is an isometric view of another embodiment of the tubular delivery arm, having an incline controlled tubular clasp and an automatic box doping apparatus.
Figure 13A:
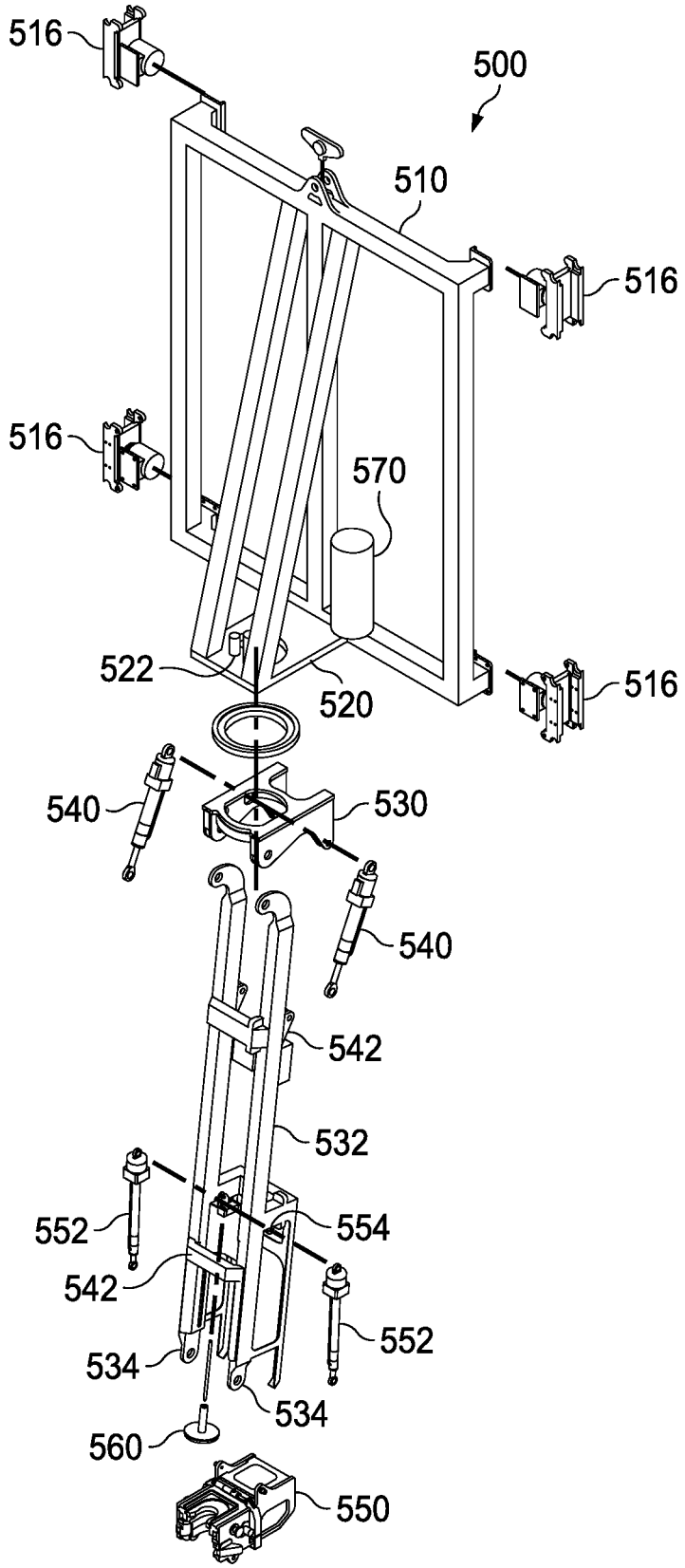
FIG. 13A is an isometric exploded view of the tubular delivery arm of FIG. 13.
Figure 13B:
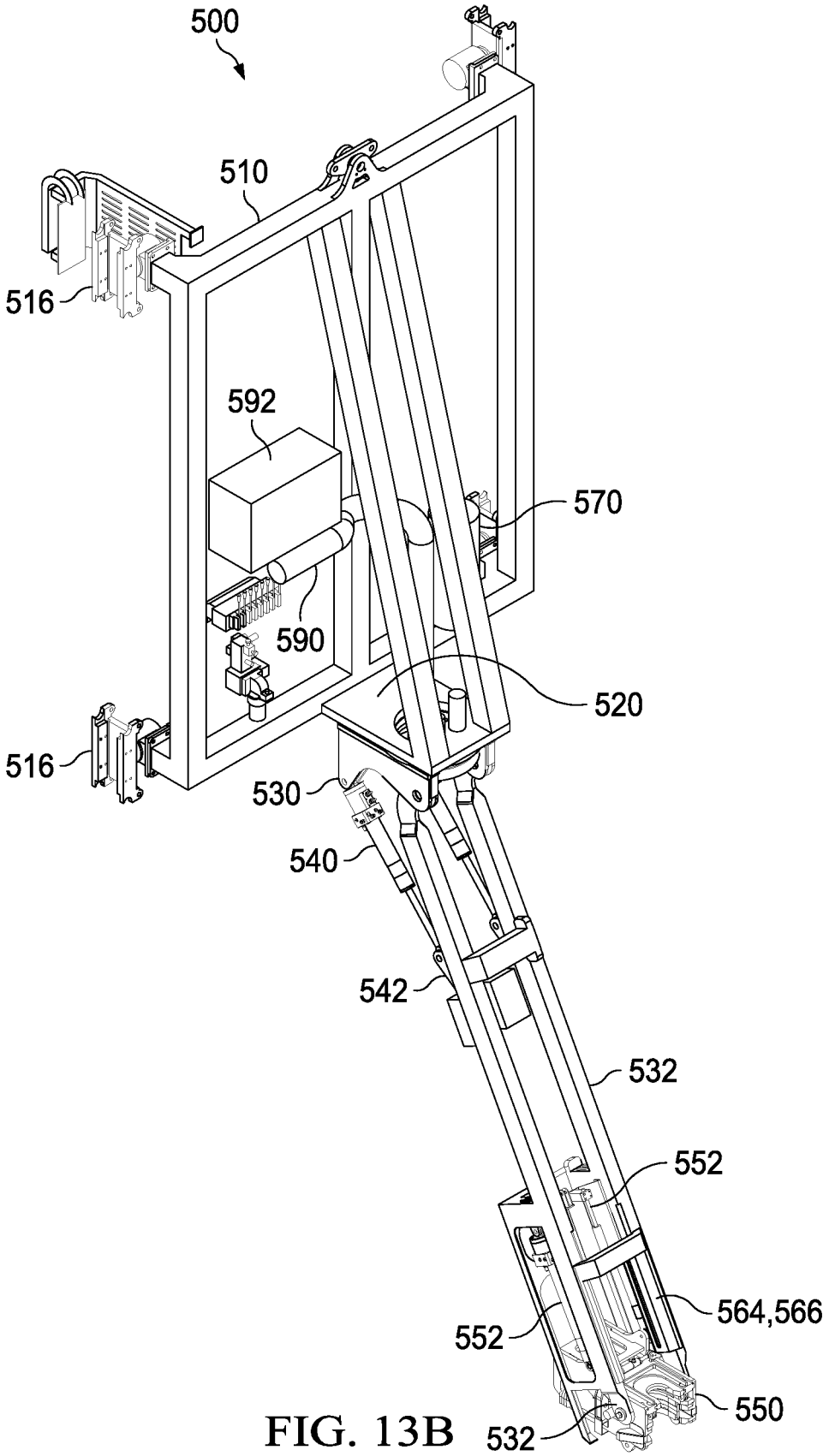
FIG. 13B is a fully assembled isometric view of the tubular delivery arm illustrated in FIGS. 13 and 13A.
Figure 14:
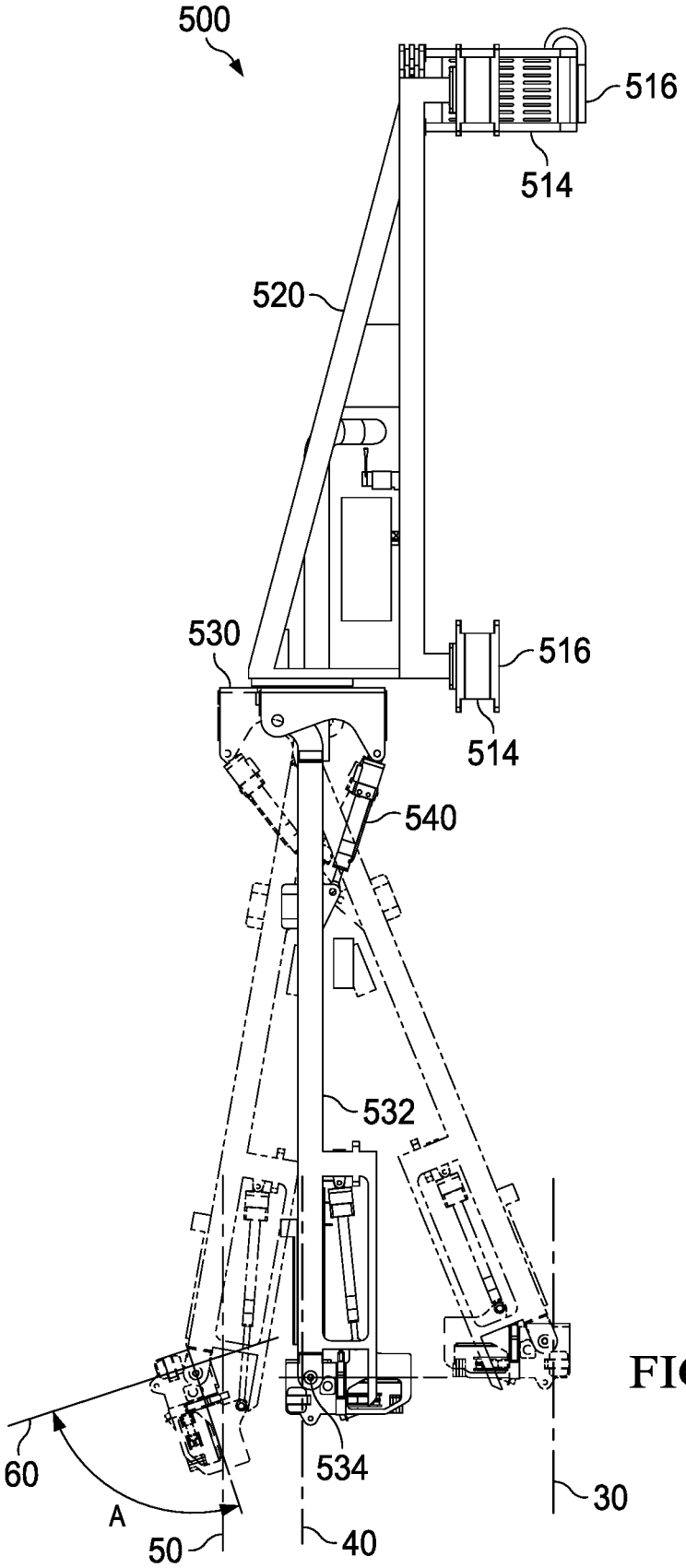
FIG. 14 is a side view of an embodiment of the tubular delivery arm, illustrating the range of the tubular delivery arm to position a tubular stand relative to positions of use on a drilling rig.
Figure 14A:
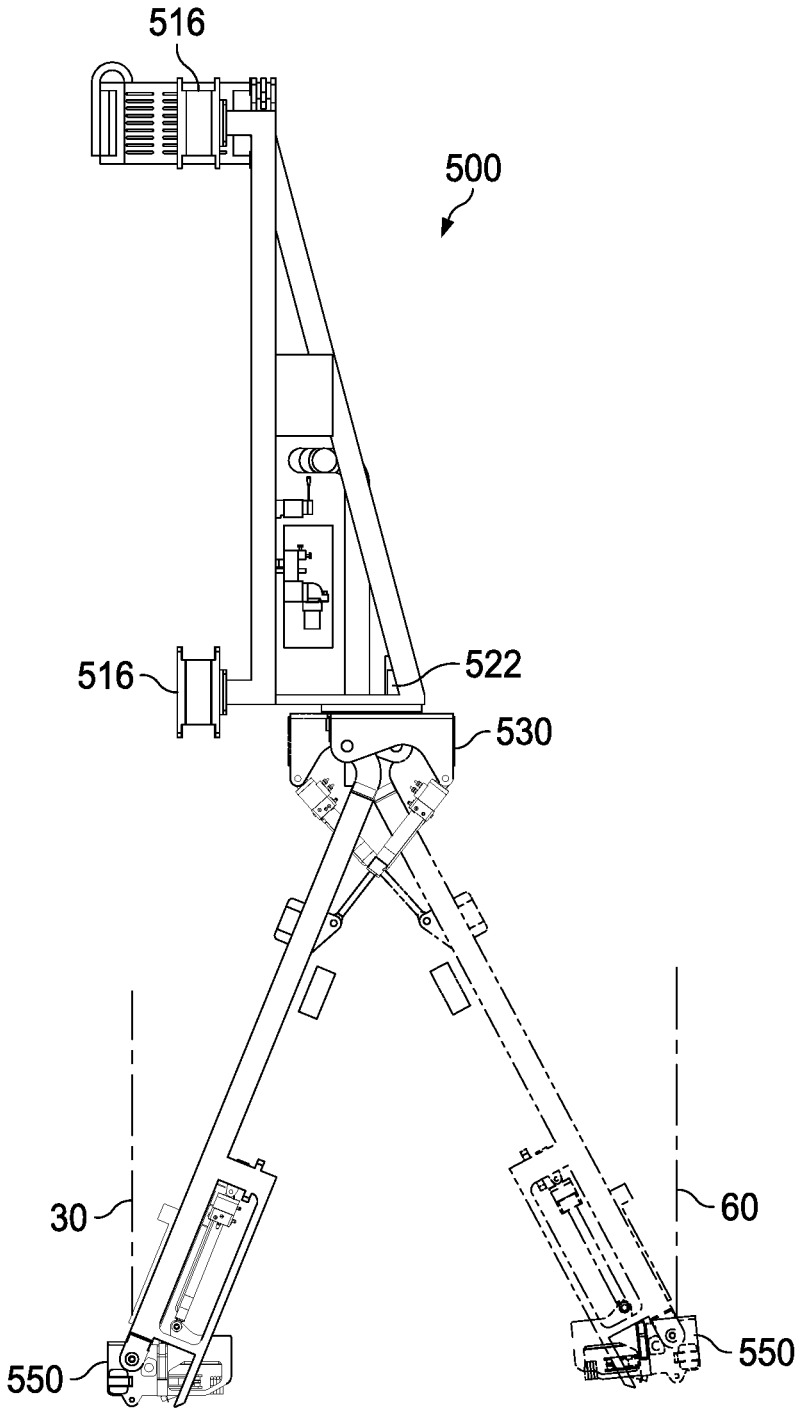
FIG. 14A is a side view of another embodiment of the tubular delivery arm illustrating the range of the tubular delivery arm to position a tubular stand relative to positions of use on a drilling rig.

FIG. 13 is an isometric view of another embodiment of the tubular delivery arm 500 of the disclosed embodiments, and FIG. 13A is an isometric exploded view. In this embodiment, an incline actuator 552 is operative to control the angle of tubular clasp 550 relative to arm 532. FIG. 13 illustrates arms 532 rotated and tilted to position clasp 550 over well center 30 as seen in FIGS. 14 and 14A, and FIG. 13B illustrates arms 532 rotated and tilted to position clasp 550 to receive a tubular stand 80 in the stand hand-off position 50. As also seen in FIG. 14, extension of the incline actuator 552 inclines tubular clasp 550 to permit tilting of heavy tubular stands, such as large collars, and to position tubular clasp 550 properly for receiving a tubular section 81 or tubular stand 80 from catwalk 600 at catwalk position 60.

Referring again to FIGS. 13, 13A, and 13B, in some embodiments, a grease dispenser 560 is extendably connected to a lower end of arm 532 above clasp 550, and extendable to position grease dispenser 560 at least partially inside of a box connection of tubular stand 80 secured by clasp 550. A grease supply line may be connected between grease dispenser 560 and a grease reservoir 570 for this purpose. In this embodiment, grease dispenser 560 may be actuated to deliver grease, such as by pressurized delivery to the interior of the box connection by either or both of spray nozzles or contact wipe application.

This embodiment permits grease to be stored in pressurized grease container 570 and strategically sprayed into a box connection of a tubular stand 80 held by clasp 550 prior to its movement over well center 30 for connection. The automatic doping procedure improves safety by eliminating the manual application at the elevated position of tubular stand 80.

FIGS. 14 and 14A illustrate an exemplary lateral range of the motion of tubular delivery arm 500 to position a tubular stand 80 relative to positions of use on drilling rig 1. Tubular delivery arm 500 can retrieve and deliver a tubular stand 80 between well center 30, mousehole position 40, and stand hand-off position 50, and optionally to catwalk position 60, where clasp 550 can be inclined for retrieving or delivering tubular stand 80 from catwalk 600.

Figure 14B:
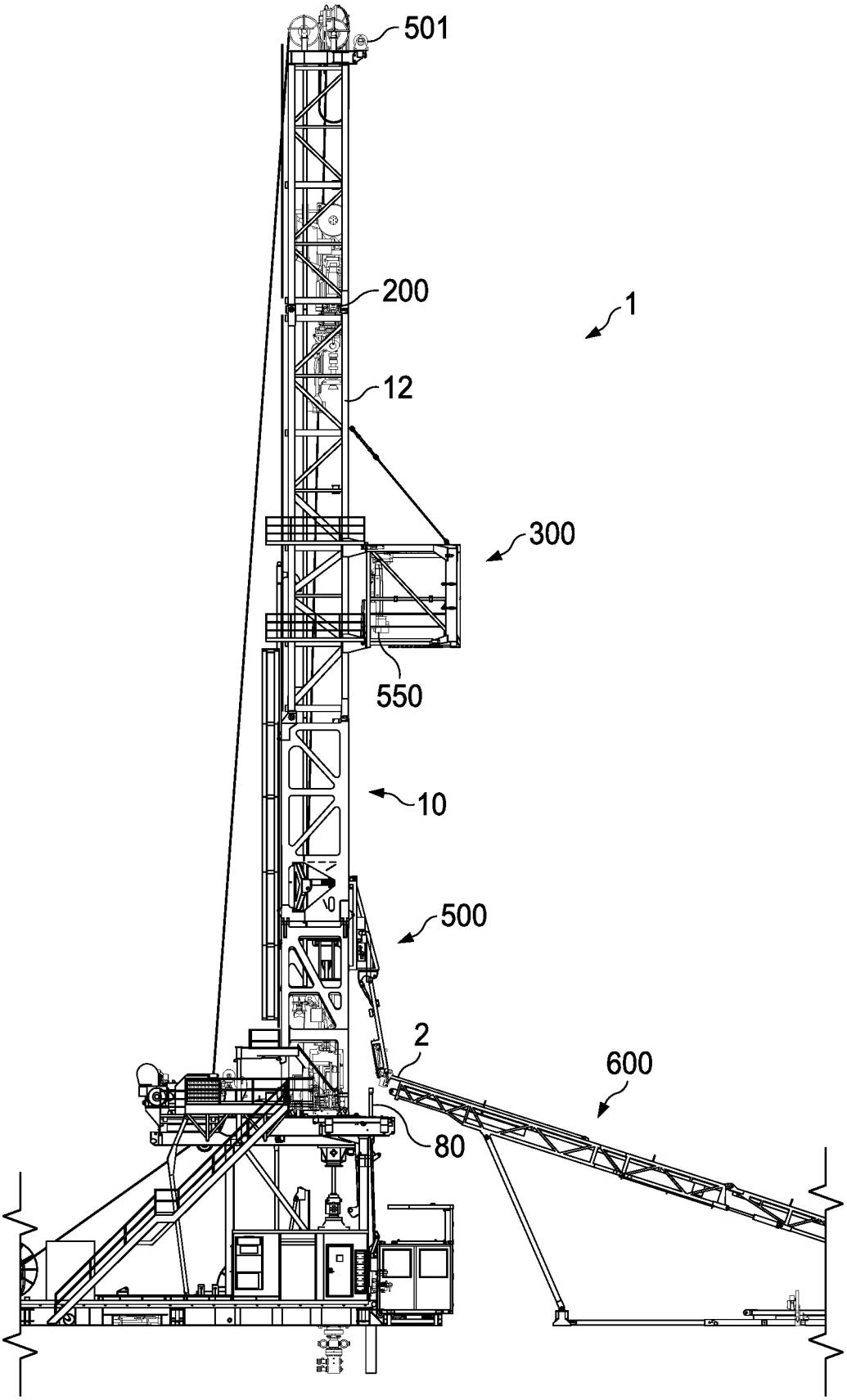
FIG. 14B is a side view of an embodiment of the tubular delivery arm connected to a drilling mast and in position to receive a section of drill pipe from the catwalk.

FIG. 14B is a side view of one embodiment of tubular delivery arm 500 shown connected to drilling mast 10 of drilling rig 1 in catwalk position 60 (see FIG. 3) to receive a tubular section 2 from catwalk 600. For this purpose, it is advantageous to have inclination control of clasp 550, as disclosed in an embodiment shown in FIGS. 11-14.

Figure 14C:
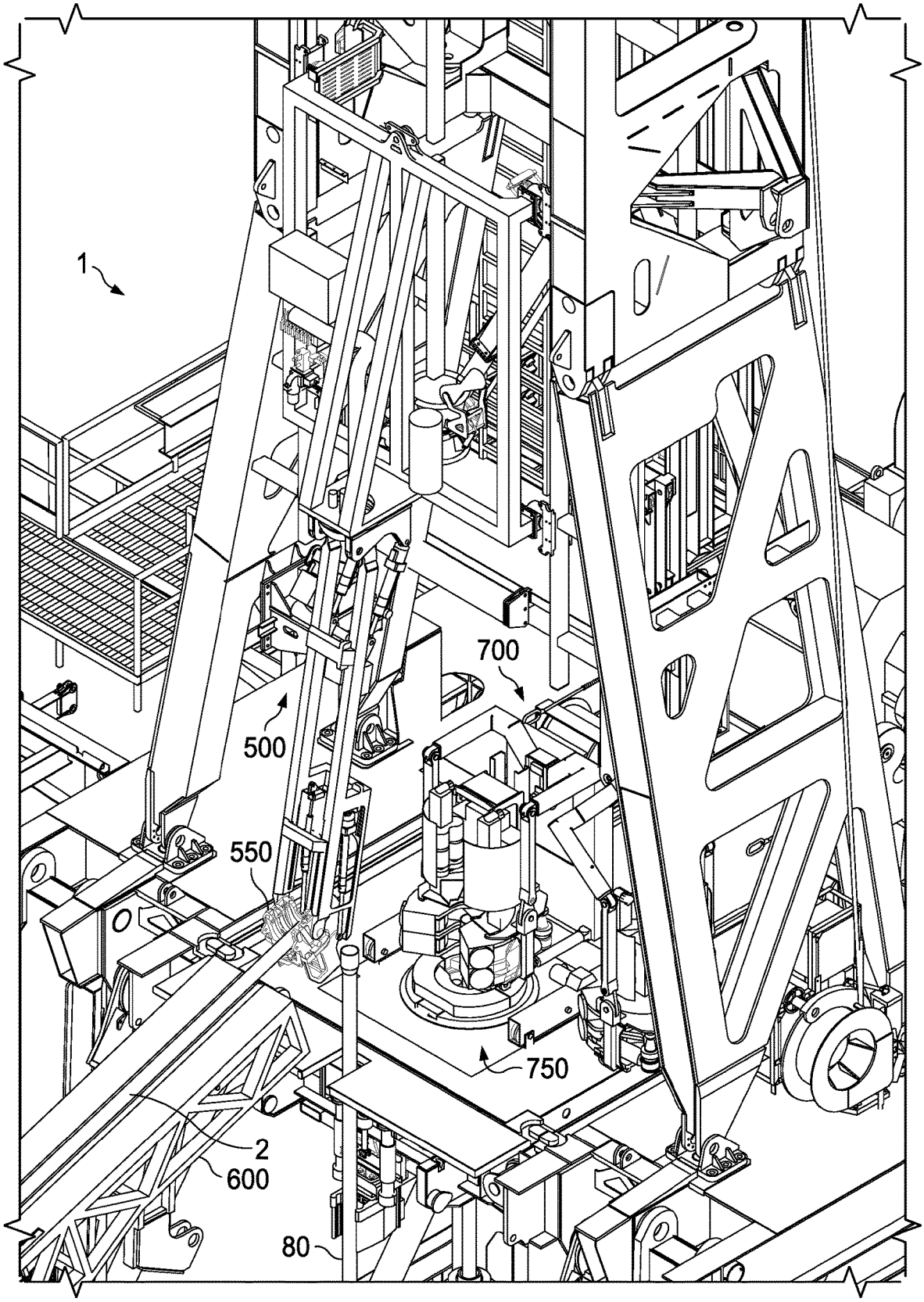
FIG. 14C is an isometric view of the embodiment of the tubular delivery arm of FIG. 14B, illustrating the tubular delivery arm receiving a section of drill pipe from the catwalk.
Figure 14D:
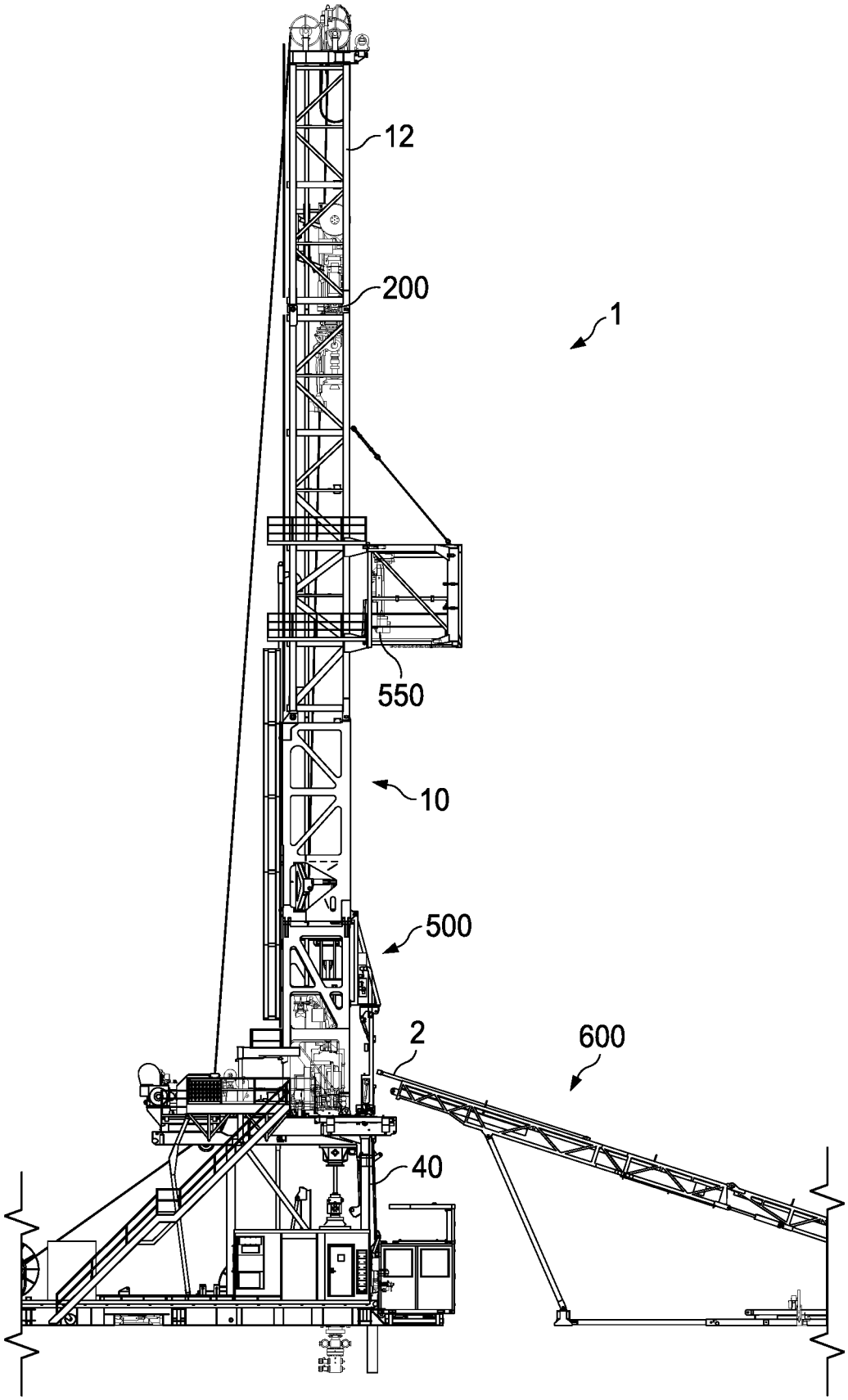
FIG. 14D is a side view of an embodiment of the tubular delivery arm connected to a drilling mast and positioned to receive a tubular stand from, or deliver a section of pipe to, the mousehole.

FIG. 14C is an isometric view of the embodiment of tubular delivery arm 500 of FIG. 14B, receiving a tubular section 2 (drill pipe 2) from catwalk 600. As seen in this view, tubular delivery arm 500 is articulated outwards by tilt actuator 540 to permit clasp 550 to attach to tubular section 2. From this position, tubular delivery arm 500 can be used to deliver tubular section 2 to the well center for make-up with the drill string in the well by an iron roughneck 750 shown positioned by a drill floor manipulating arm 700. In some embodiments, tubular delivery arm 500 can be used to build a stand with another drill pipe 2 secured in a mousehole 40 as shown in FIG. 14D.

Figure 14E:
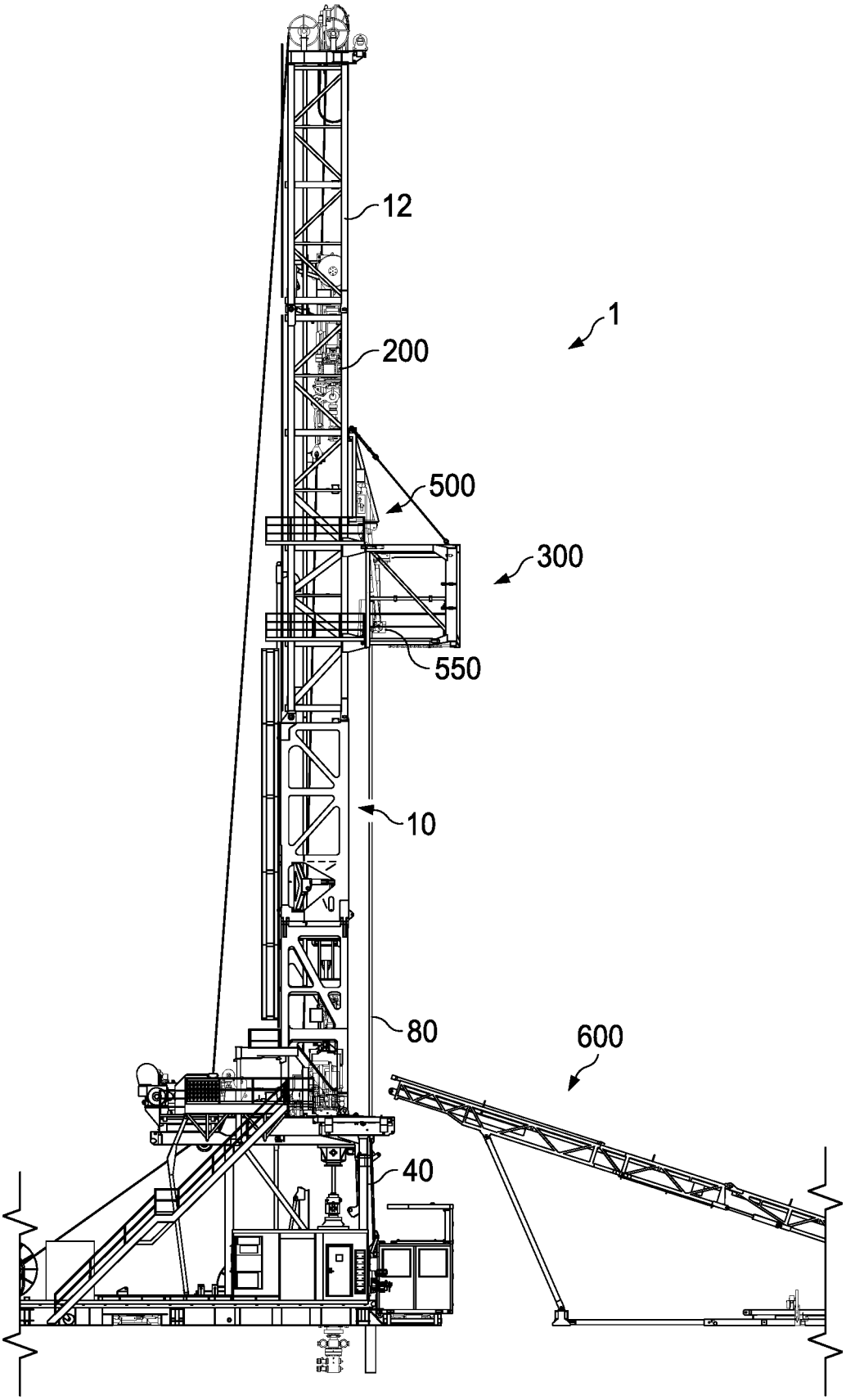
FIG. 14E is a side view of an embodiment of the tubular delivery arm connected to a drilling mast and in position to receive (or deliver) a tubular stand at the stand hand-off position at the racking module.

FIG. 14E is a side view of an embodiment of tubular delivery arm 500 connected to a drilling mast 10 and in position to receive (or deliver) tubular stand 80 from stand hand-off position 50 at racking module 300.

Figure 14F:
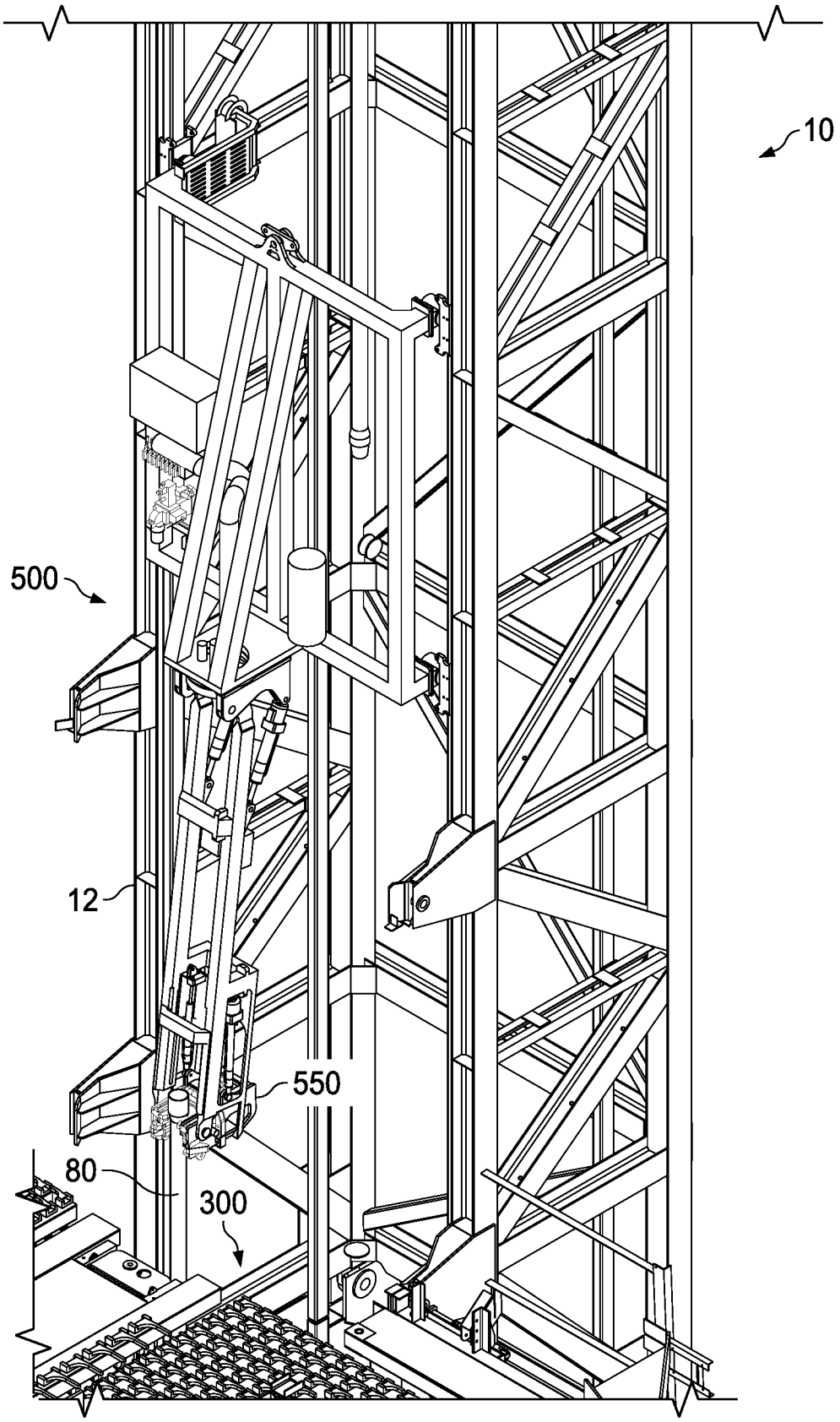
FIG. 14F is an isometric view of the embodiment of the tubular delivery arm of FIG. 7, illustrating the tubular delivery arm positioned over the stand hand-off position between the racking module and the mast, and having a tubular stand secured in the clasp.

FIG. 14F is an isometric view of the embodiment of tubular delivery arm 500 of FIG. 7, illustrating tubular delivery arm 500 articulated to stand hand-off position 50 between racking module 300 and mast 10, and having tubular stand 80 secured in clasp 550.

In one embodiment, slide pads 516 are slidably engageable with the front side 12 of drilling mast 10 to permit tubular delivery arm 500 to travel up and down along the front of mast 10. Rails may be attached to mast 10 for receiving slide pads 516. Tilt actuator 540 permits clasp 550 to swing over well center 30, mousehole 40, stand hand-off position 50, and if desired, catwalk 60.

Figure 14G:
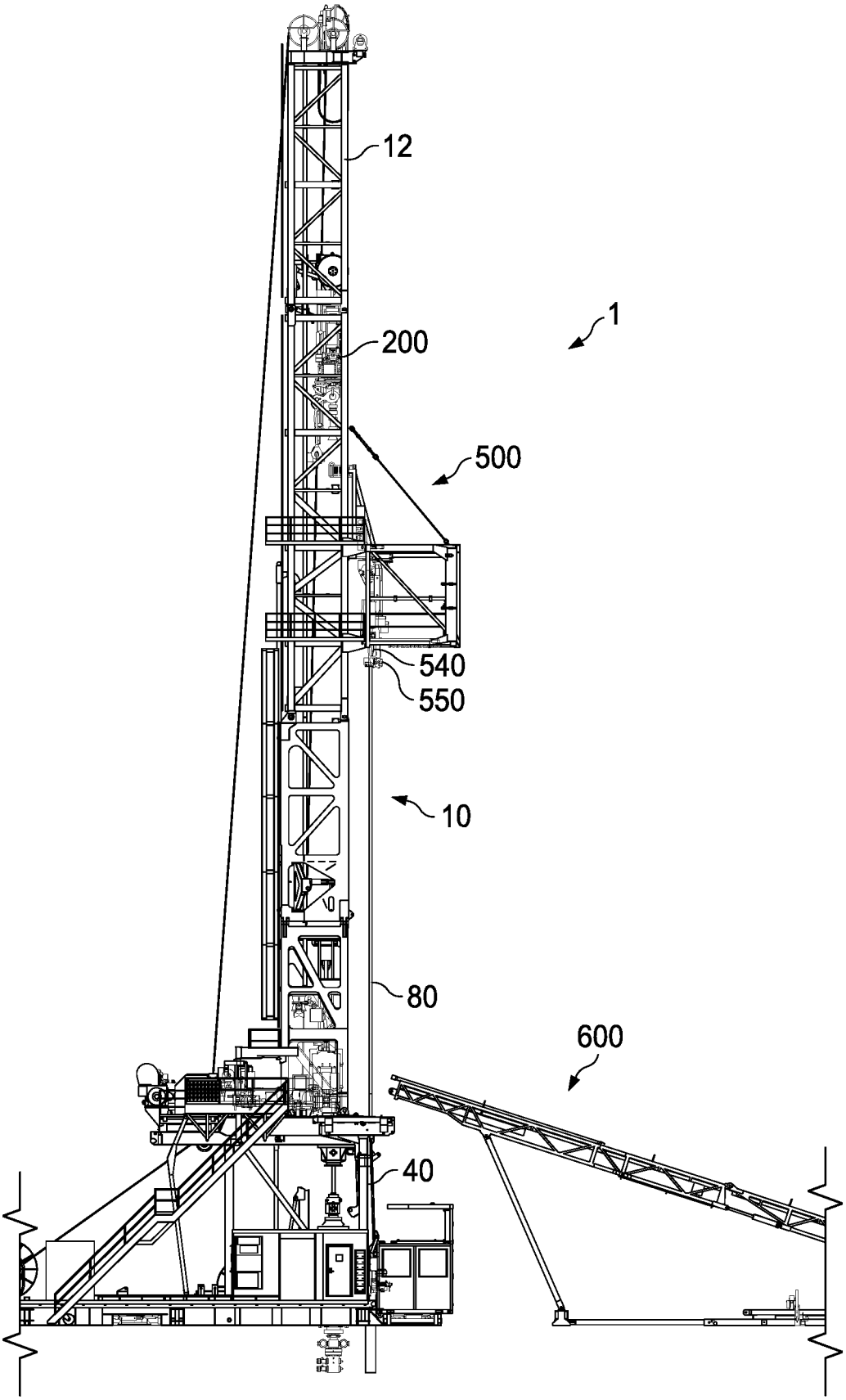
FIG. 14G is a side view of an embodiment of the tubular delivery arm connected to a drilling mast and positioned over well center to deliver a tubular stand into a stump at the well center, and to release the tubular stand when secured by the top drive.

FIG. 14G is a side view of an embodiment of tubular delivery arm 500 connected to drilling mast 10 and in position to deliver tubular stand 80 to well center 30 to stab into a stump secured at well center 30. After stabbing, tubular delivery arm 500 can hand tubular stand 80 off to top drive assembly 200.

Figure 15:
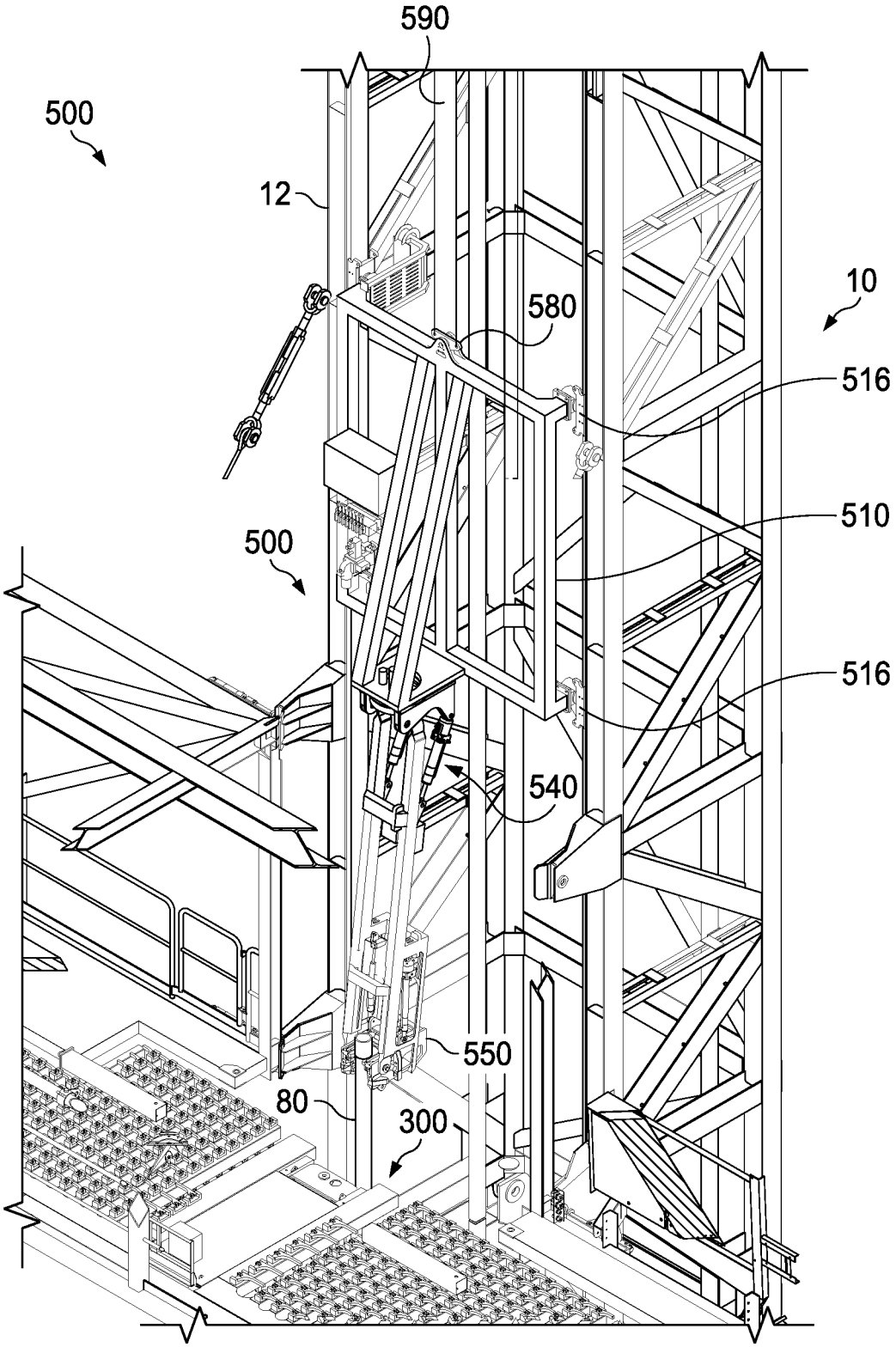
FIG. 15 is an isometric view of the embodiment of the tubular delivery arm of FIG. 13, in which a portion of the upper racking module is cut away to more clearly illustrate the tubular delivery arm articulated to the stand hand-off position clasping a tubular stand.

FIG. 15 is an isometric view of an embodiment of the tubular delivery arm 500, in which a portion of the upper racking module is cut away to more clearly illustrate tubular delivery arm 500 articulated to stand hand-off position 50 between racking module 300 and mast 10, and having a tubular stand 80 secured in clasp 550.

Slide pads 516 are slidably engaged with the front side (V-door side) 12 of drilling mast 10 to permit tubular delivery arm 500 to vertically traverse front side 12 of mast 10. Tilt actuator 540 positions clasp 550 over stand hand-off position 50. Tubular delivery arm 500 may have a hoist connection 580 on dolly 510 for connection to a hoist at the crown block to facilitate movement of tubular delivery arm 500 vertically along mast 10.

Figure 16:
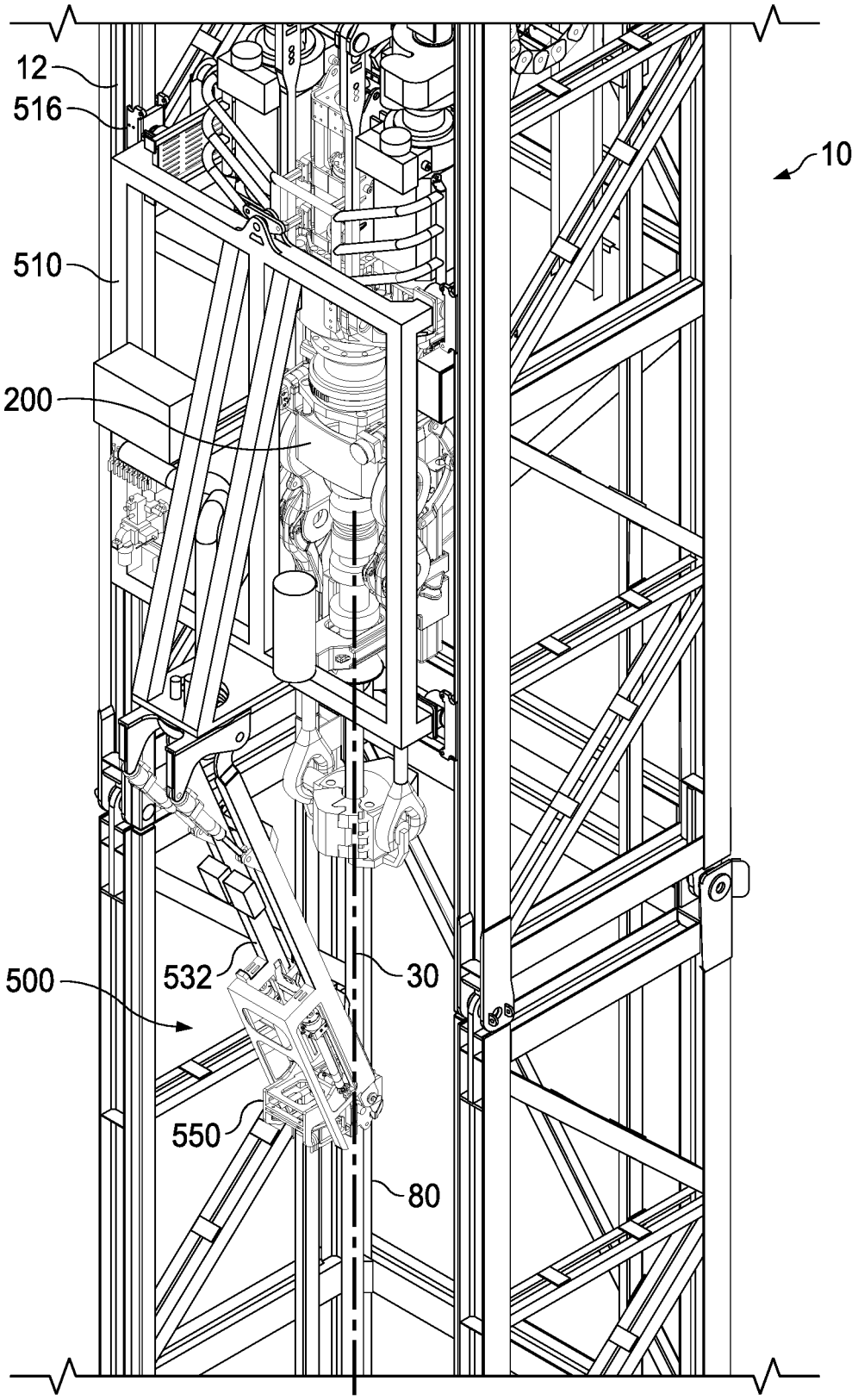
FIG. 16 is an isometric view of the embodiment of the tubular delivery arm of FIG. 13, illustrating the tubular delivery arm articulated over the well center and handing a tubular stand to the top drive.

FIG. 16 is an isometric view of the embodiment of tubular delivery arm 500 of FIG. 14, illustrating tubular delivery arm 500 being articulated over well center 30 and handing tubular stand 80 off to retractable top drive assembly 200. Tubular delivery arm 500 is articulated by expansion of tilt actuator 540, which inclines arms 532 into position such that the centerline of tubular stand 80 in clasp 550 is directly over well center 30.

Figure 16A:
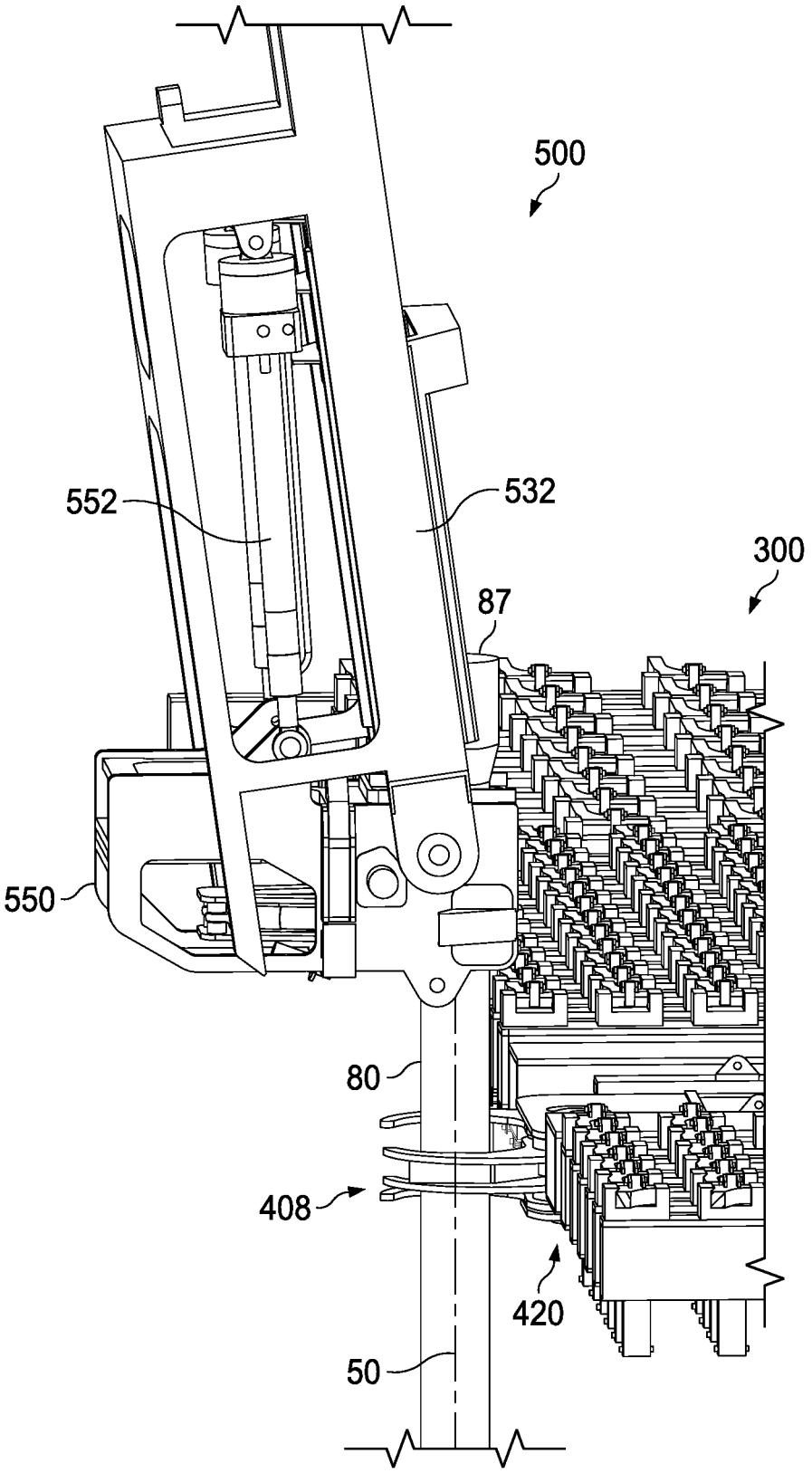
FIG. 16A is an isometric view of the embodiment of the tubular delivery arm of FIG. 16, illustrating the tubular delivery arm articulated to reach a tubular stand held by an upper stand constraint component at the stand hand-off position.

FIG. 16A is an isometric view of the embodiment of the tubular delivery arm of FIG. 16, illustrating tubular delivery arm 500 connected to tubular stand 80 at stand hand-off position 50. Tubular stand 80 is shown secured in the stand hand-off position by clasp 408 of upper stand constraint 420 beneath racking module 300. In this position, tubular delivery arm 500 may activate grease dispenser 560 to apply an appropriate amount of grease inside the box end of tubular stand 80.

Figure 16B:
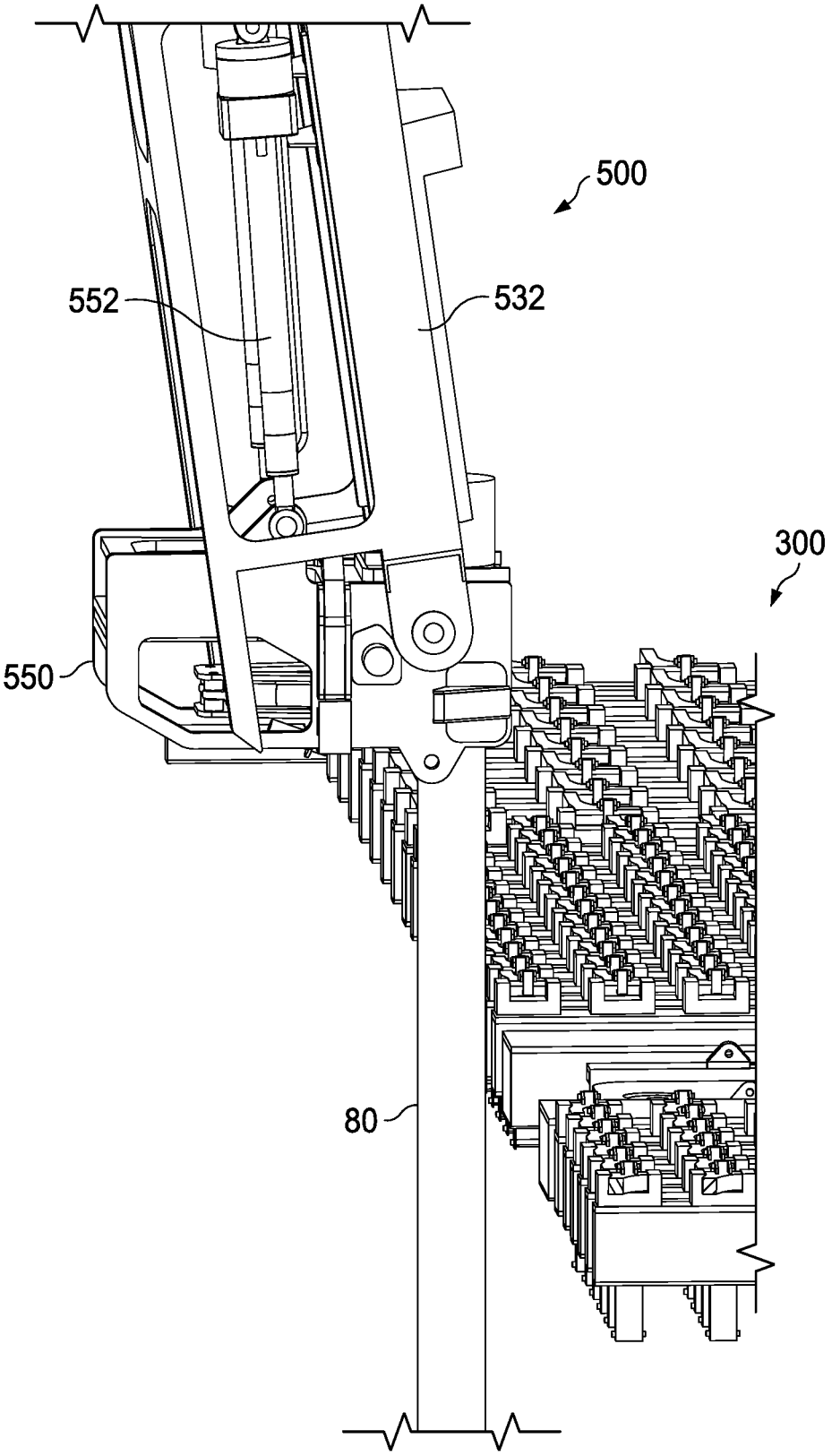
FIG. 16B is an isometric view of the embodiment of the tubular delivery arm of FIG. 16A, illustrating the upper stand constraint having released the tubular stand and the tubular delivery arm hoisting the tubular stand as the grease dispenser is lowered to spray grease into the box end of the tubular stand being lifted.

FIG. 16B is an isometric view of the embodiment of tubular delivery arm 500 of FIG. 16A, illustrating tubular delivery arm 500 hoisting tubular stand 80 released by upper stand constraint 420 away from stand hand-off position 50 adjacent to racking module 300. In this manner, tubular delivery arm 500 is delivering and centering tubular stands 80 for top drive assembly 200. This design allows independent and simultaneous movement of tubular delivery arm 500 and top drive assembly 200. This combined capability provides accelerated trip speeds. The limited capacity of tubular delivery arm 500 to lift tubular stands 80 of drill pipe drill collars allows the weight of tubular delivery arm 500 and mast 10 to be minimized. Tubular delivery arm 500 can be raised [and lowered along the front 12 of mast 10 with an electric or hydraulic crown winch 501 (see FIG. 14B). If desired, tubular delivery arm 500 could be raised and lowered along mast 10 by means of a rack and pinion arrangement, with drive motors.

In this manner, tubular delivery arm 500 is delivering and stabbing tubular stands for retractable top drive assembly 200. This allows independent and simultaneous movement of retractable top drive assembly 200 to lower the drill string into the well (set slips), disengage the drill string, retract, and travel vertically up mast 10 while tubular delivery arm 500 is retrieving, centering, and stabbing the next tubular stand 80. This combined capability makes greatly accelerated trip speeds possible. The limited capacity of tubular delivery arm 500 to lift only stands of drill pipe allows the weight of tubular delivery arm 500 to be minimized, if properly designed. Tubular delivery arm 500 can be raised and lowered along mast 10 with only a relatively small electric or hydraulic crown winch 501 (see FIG. 14B), e.g., having less lifting capacity than top drive 200. Winch 500 may be electronically controlled to position the delivery arm 500 along the mast 10 in the desired location in some embodiments.

Figure 17:
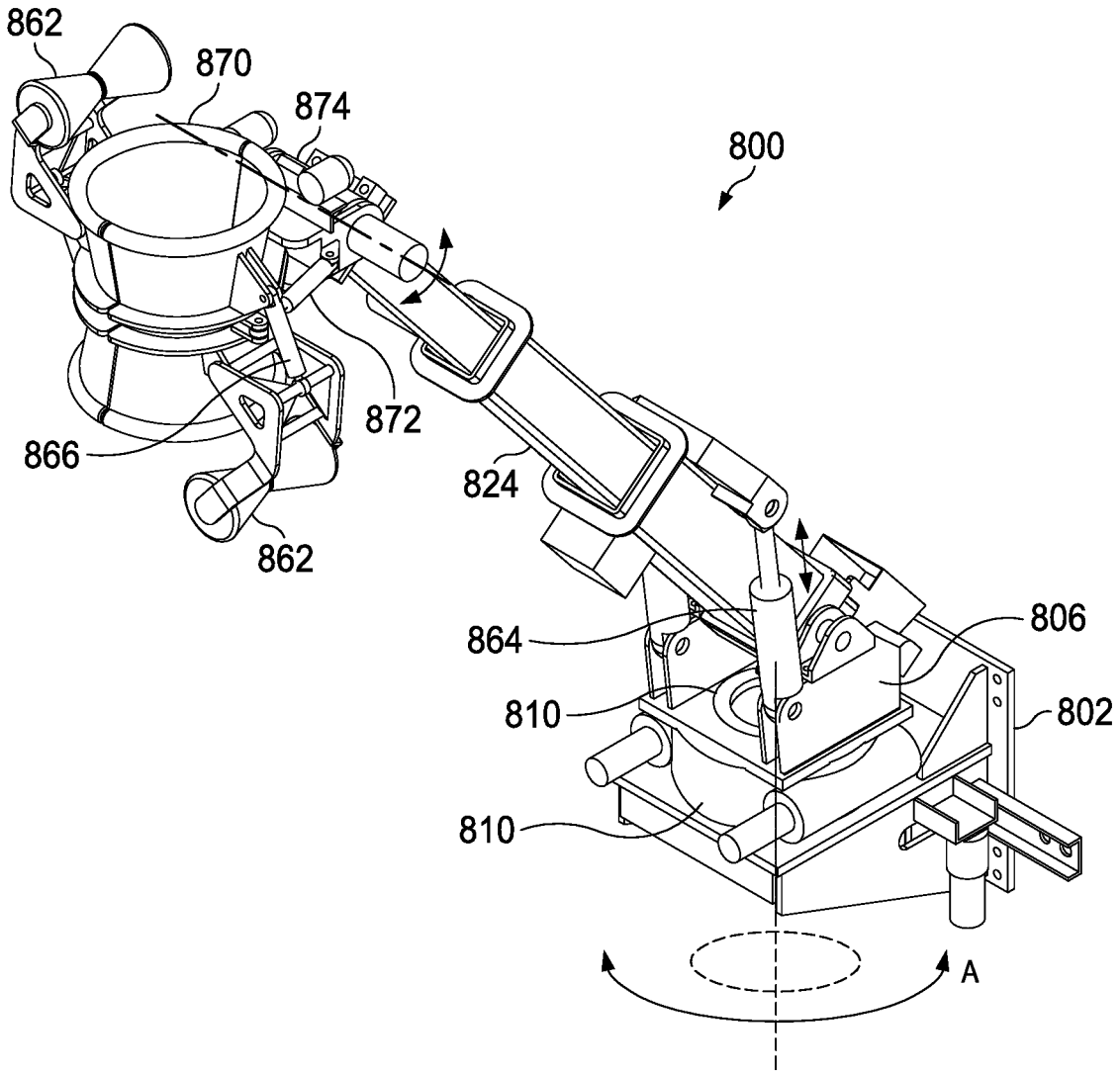
FIG. 17 is an isometric view of a lower stabilizing arm component according to the disclosed embodiments, illustrating the multiple extendable sections of the arm.

FIG. 17 is an isometric view of an embodiment of a lower stabilizing arm 800, that may be pivotally and/or rotatably mounted to the base for connection to a lower portion of a drilling mast, illustrating the rotation, pivot, and extension of an arm 824. In this embodiment, arm 824 is pivotally and rotationally connected to a mast bracket 802. An arm bracket 806 is rotationally connected to mast bracket 802. Arm 824 is pivotally connected to arm bracket 806. A pivot actuator 864 controls the pivotal movement of arm 824 relative to arm bracket 806 and thus mast bracket 802. A rotary table 810 controls the rotation of arm 824 relative to arm bracket 806 and thus mast bracket 802. Arm 824 is extendable as shown.

In this embodiment, a tubular guide 870 is rotational and pivotally connected to arm 824. A pivot actuator 872 controls the pivotal movement of tubular guide 870 relative to arm 824. A rotary actuator 874 controls the rotation of tubular guide 870 relative to arm 824. A pair of V-rollers 862 is provided to center a tubular stand 80 in guide 870. V-rollers 862 are operable by a roller actuator 866.

Figure 18:
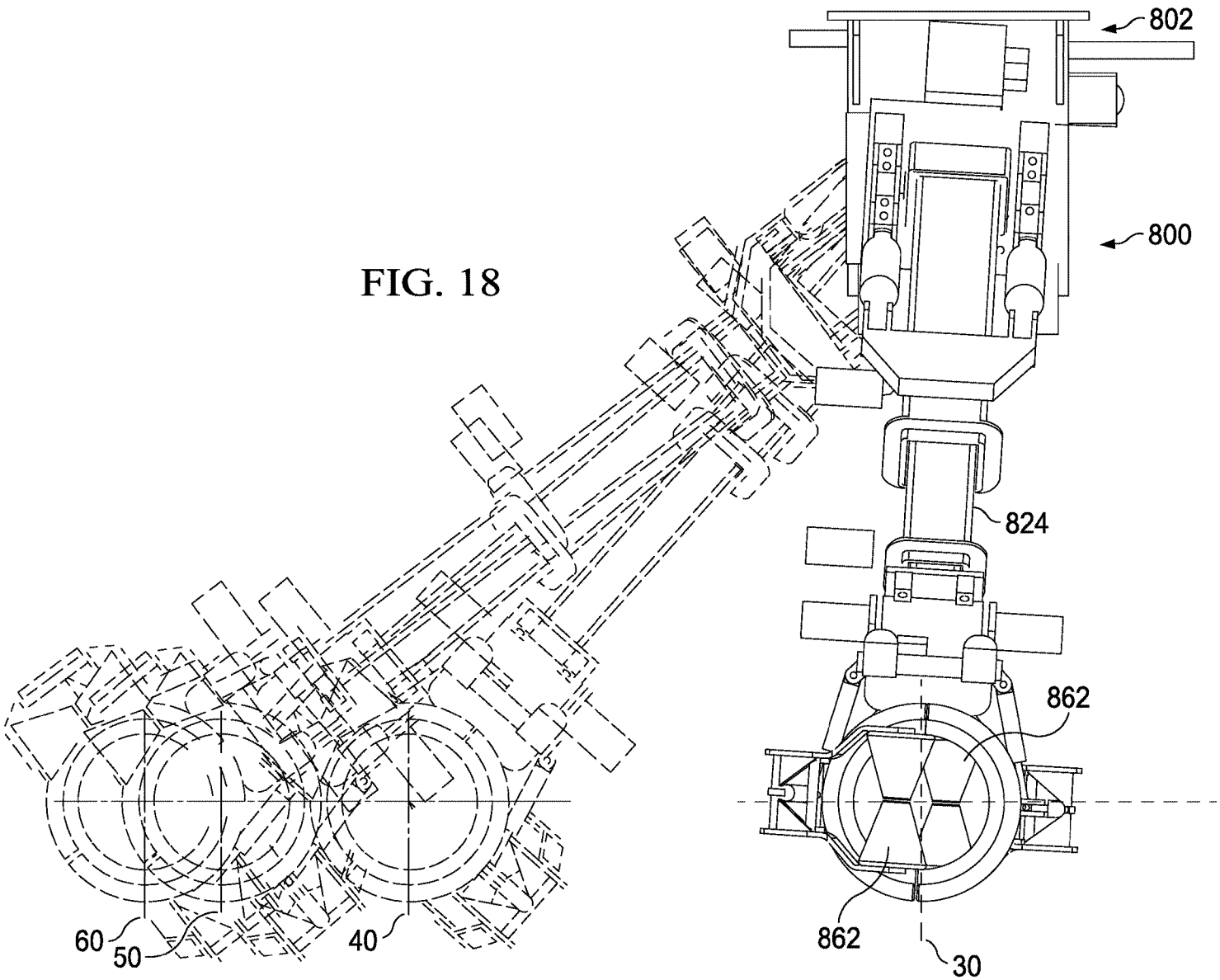
FIG. 18 is a side view of the embodiment of FIG. 16, illustrating positioning of the lower stabilizing arm to stabilize the lower portion of a tubular stand between a well center, mousehole, stand hand-off and catwalk position.

The operation of the various rotational and pivot controls permits placement of tubular guide 870 over center of each of a wellbore 30, a mousehole 40, and a stand hand-off position 50 of drilling rig 1 as seen best in FIG. 18.

FIG. 18 is a top view of an embodiment of a lower stabilizing arm 800, illustrating the change in positioning that occurs as lower stabilizing arm 800 relocates between the positions of well center 30, mousehole 40, stand hand-off position 50, and catwalk 60.

Figure 19:
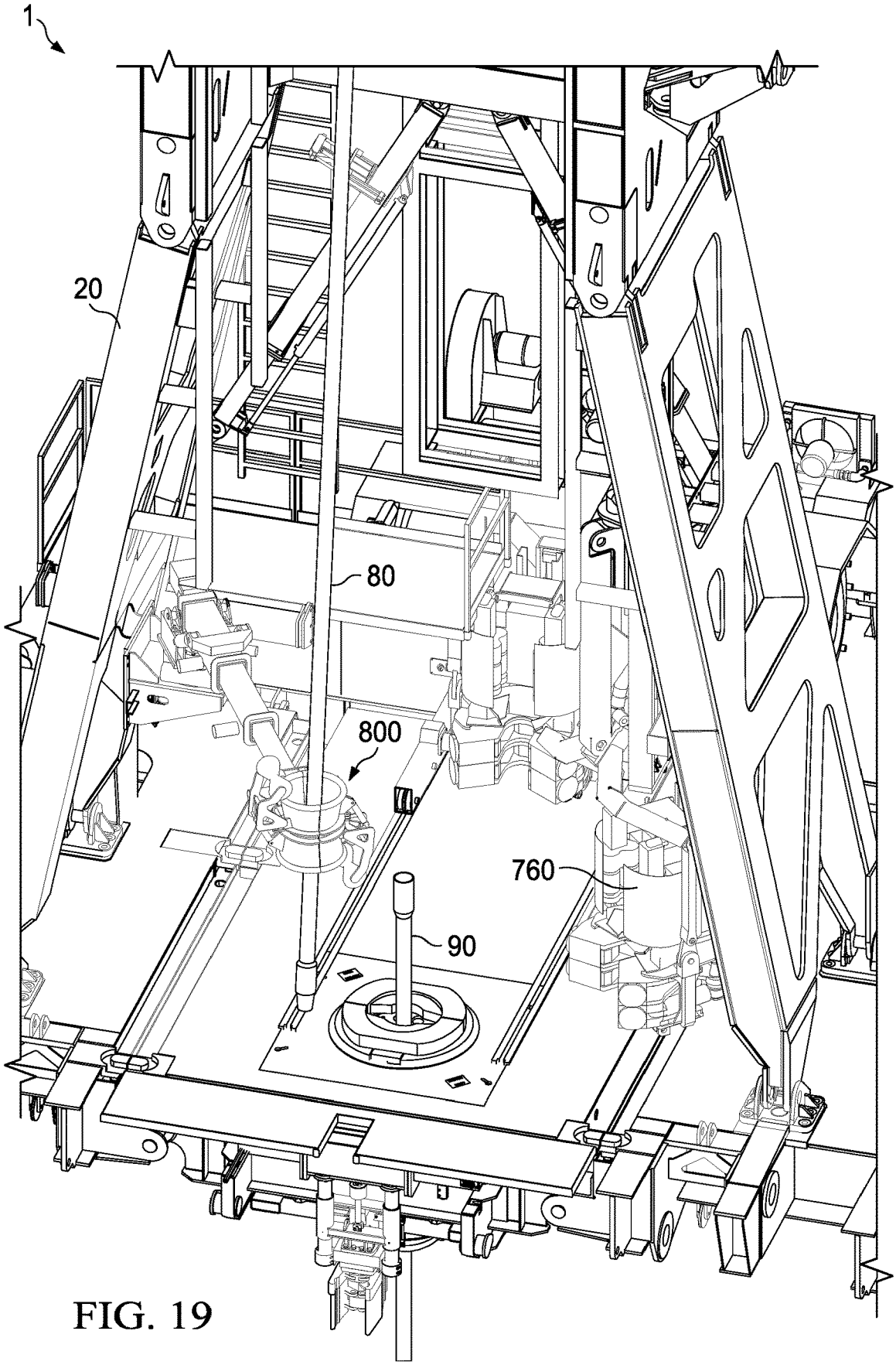
FIG. 19 is an isometric view of the embodiment of FIG. 18, illustrating the lower stabilizing arm capturing the lower end of a drill pipe section near the catwalk.

FIG. 19 is an isometric view of an embodiment of lower stabilizing arm 800 connected to a leg 20 of drilling rig 1, and illustrating lower stabilizing arm 800 capturing the lower end of tubular stand 80 and guiding tubular stand 80 to well center 30 for stabbing into drill string 90. Once stabbed, iron roughneck 760 will connect the tool joints.

Figure 20:
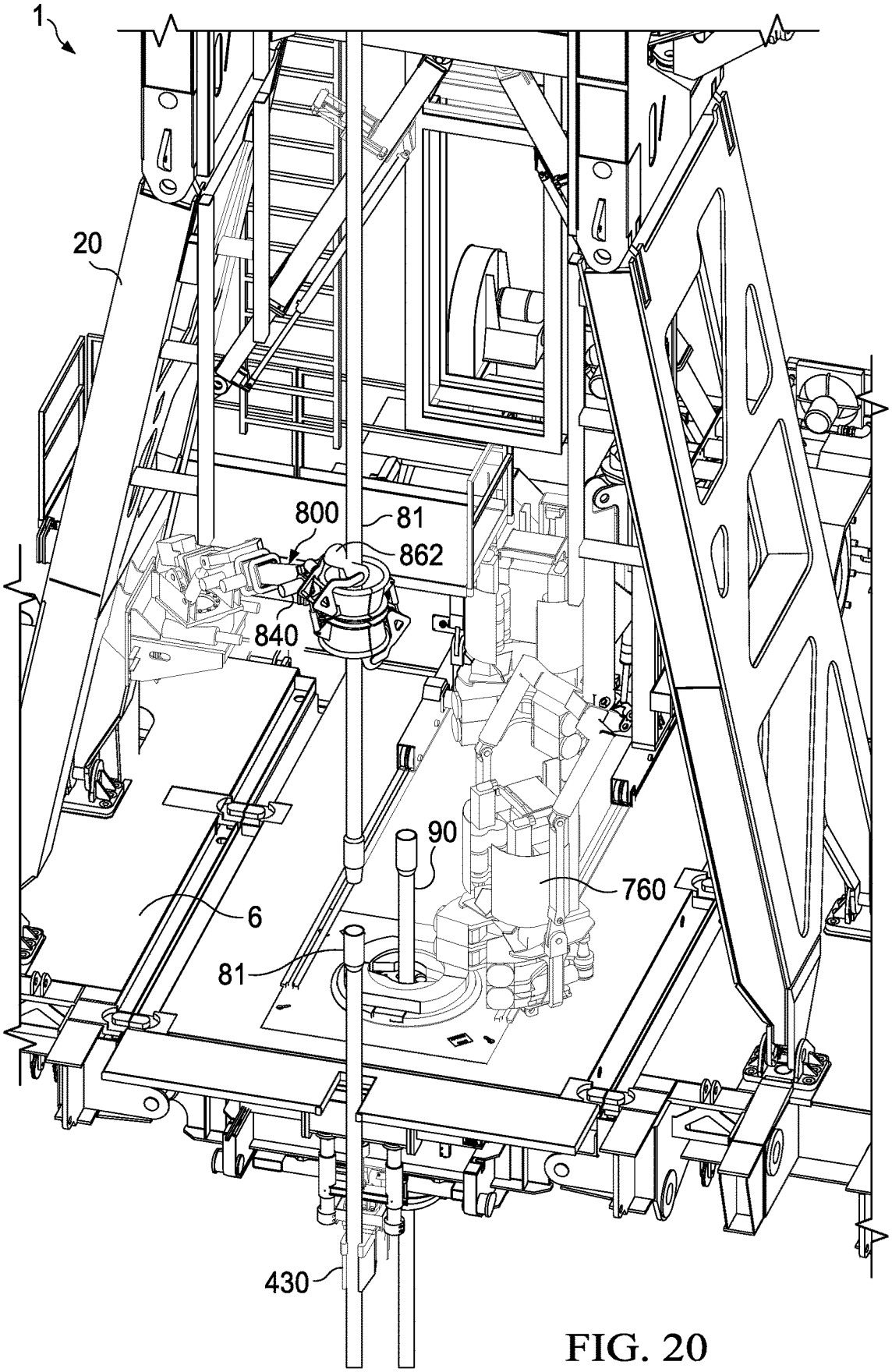
FIG. 20 is an isometric view of an embodiment of the lower stabilizing arm, illustrated secured to the lower end of a stand of drill pipe and stabbing it at the mousehole.

FIG. 20 illustrates an embodiment of lower stabilizing arm 800 secured to the lower end of tubular section 81 and preparing to stab it into the box connection of tubular section 81 located in mousehole 40 in a stand building procedure. In FIG. 20, tubular section 81 in mousehole 40 is secured to drill floor 6 by a tubular gripping 409 of intermediate stand constraint 430.

As illustrated and described above, in some embodiments, lower stabilizing arm 800 can handle the lower end of tubular stand 80 and tubular sections 81 to safely permit the accelerated movement of tubular stands for reducing trip time and connection time, and to reduce exposure of workers on drill floor 6. Lower stabilizing arm 800 provides a means for locating the pin end of a hoisted tubular stand 80 into alignment with the box end of another for stabbing, or for other positional requirements such as catwalk retrieval, racking, mousehole insertion, and stand building. Lower stabilizing arm 800 can facilitate accurately positioning tubular stand 80 at wellbore center 30, mousehole 40, and stand hand-off position 50, etc.

Figure 21:
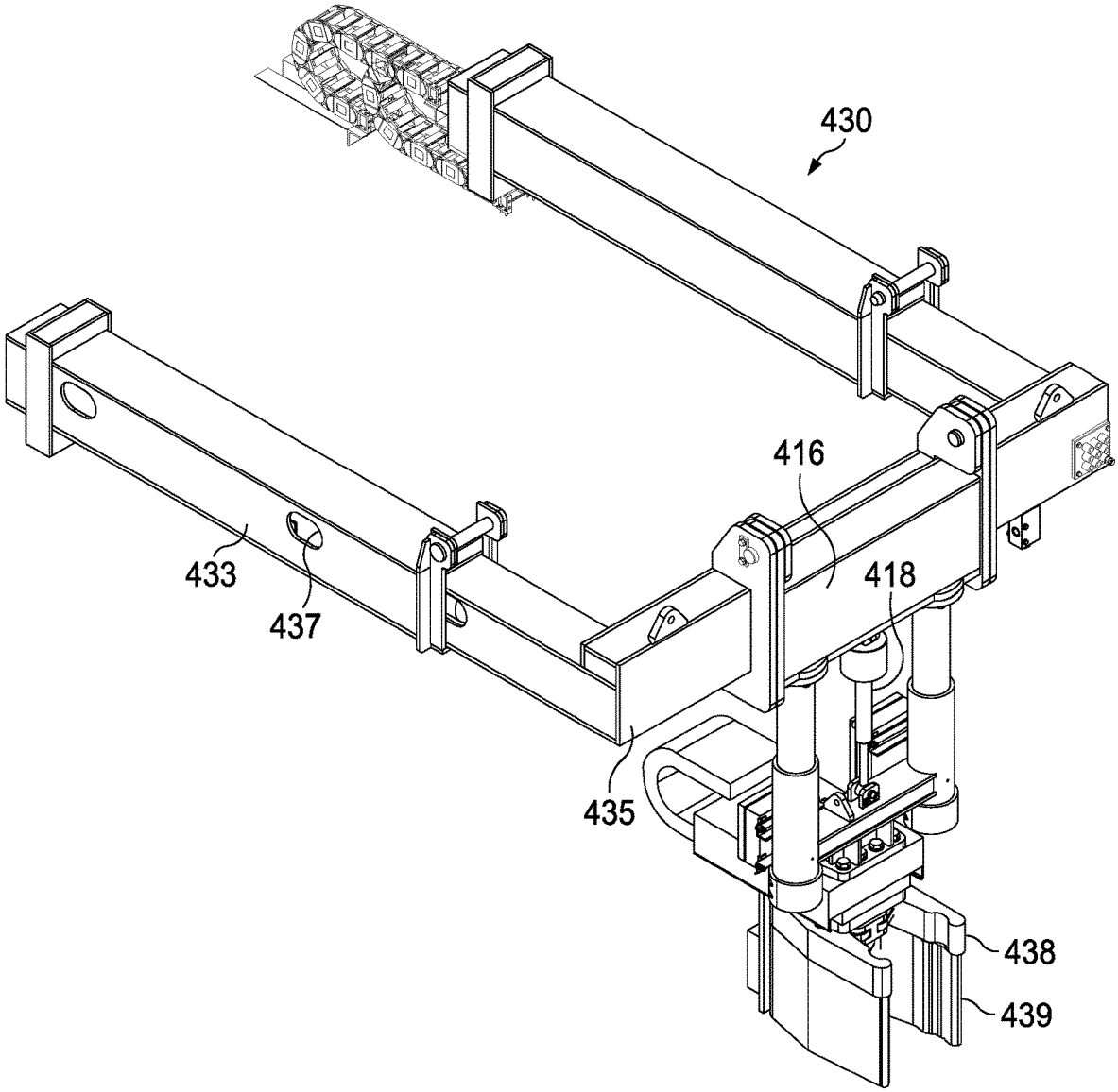
FIG. 21 is an isometric view of an embodiment of an intermediate stand constraint, illustrated extended.

FIG. 21 is an isometric view of an embodiment of an intermediate stand constraint 430. Intermediate stand constraint 430 as shown can be connected at or immediately beneath drill floor 6, as illustrated in FIG. 1. Intermediate stand constraint 430 has a frame 433 that may be configured as a single unit or as a pair, as illustrated. A carriage 435 is extendably connected to frame 433. In the view illustrated, carriage 435 is extended from frame 433. A carriage actuator 437 is connected between frame 433 and carriage 435 and is operable to extend and retract carriage 435 from frame 433.

In some embodiments, a clasp 438 is pivotally connected to the end of carriage 435. A clasp actuator is operable to open and close clasp 438. In some embodiments, clasp 408 can be self-centering to permit closure of clasp 438 around a full range of drilling tubulars 80, including casing, drill collars and drill pipe. Clasp 438 is not required to resist vertical movement of tubular stand 80, which can be slidably received. In one embodiment, clasp 438 comprises opposing claws.

In some embodiments, a tubular gripping assembly 439 is provided and can support the vertical load of tubular stand 80 to prevent downward vertical movement of tubular stand 80. In the embodiment shown, a transport bracket 416 is pivotally connected to carriage 435. An actuator 418 is provided to adjust the height of clasp 438 and gripper 439. If desired, the vertical actuator 418 may be used in the hand-off logic between the top drive assembly 200 and the intermediate stand constraint 430 over the mousehole 40. For example, actuator 418 can be hydraulically charged to hold it at an upper position; when the weight of a stand 80 is removed or applied, the actuator 418 may extend or retract, and with the integrated linear transducer in the cylinder 418, signal a control system that the tubular weight is being taken by the top drive assembly and the gripper 409 can be opened to release the stand.

Figure 22:
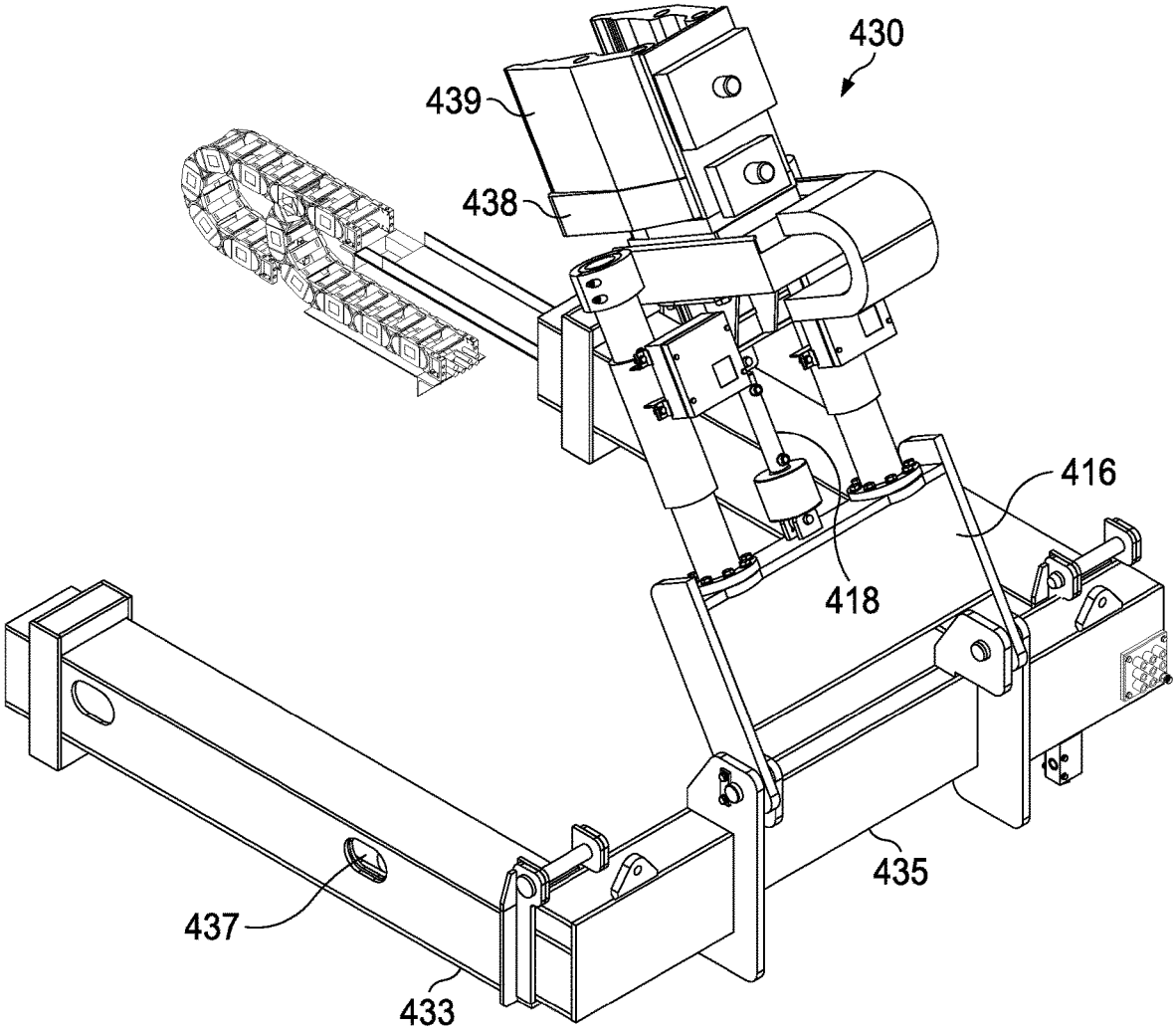
FIG. 22 is an isometric view of the embodiment of the intermediate stand constraint of FIG. 21, illustrating the intermediate stand constraint folded for transportation between drilling locations.

FIG. 22 is an isometric view of the embodiment of intermediate stand constraint 430 of FIG. 21, illustrating carriage 435 retracted, and transport bracket pivoted into a transport position. In operation, intermediate stand constraint 430 can facilitate stand building at mousehole 40. For example, intermediate stand constraint 430 may be used to vertically secure a first tubular section 81. A second tubular section 81 may then be positioned in series alignment by a hoisting mechanism such as the tubular delivery arm 500. With the use of an iron roughneck 760 (see FIG. 19 and FIG. 20) movably mounted at drill floor 6, the series connection between the first and second tubular sections 81 can be made to create a double tubular stand 80. Gripping assembly 439 can then be released to permit the double tubular stand 80 to be lowered into mousehole 40. Gripping assembly 439 can then be actuated to hold double tubular stand 80 in centered position, as a third tubular section 81 is hoisted above and stabbed into double tubular section 81. Once again, iron roughneck 760 on drill floor 6 can be used to connect the third tubular section 81 and form a triple tubular stand 80.

Figure 23:
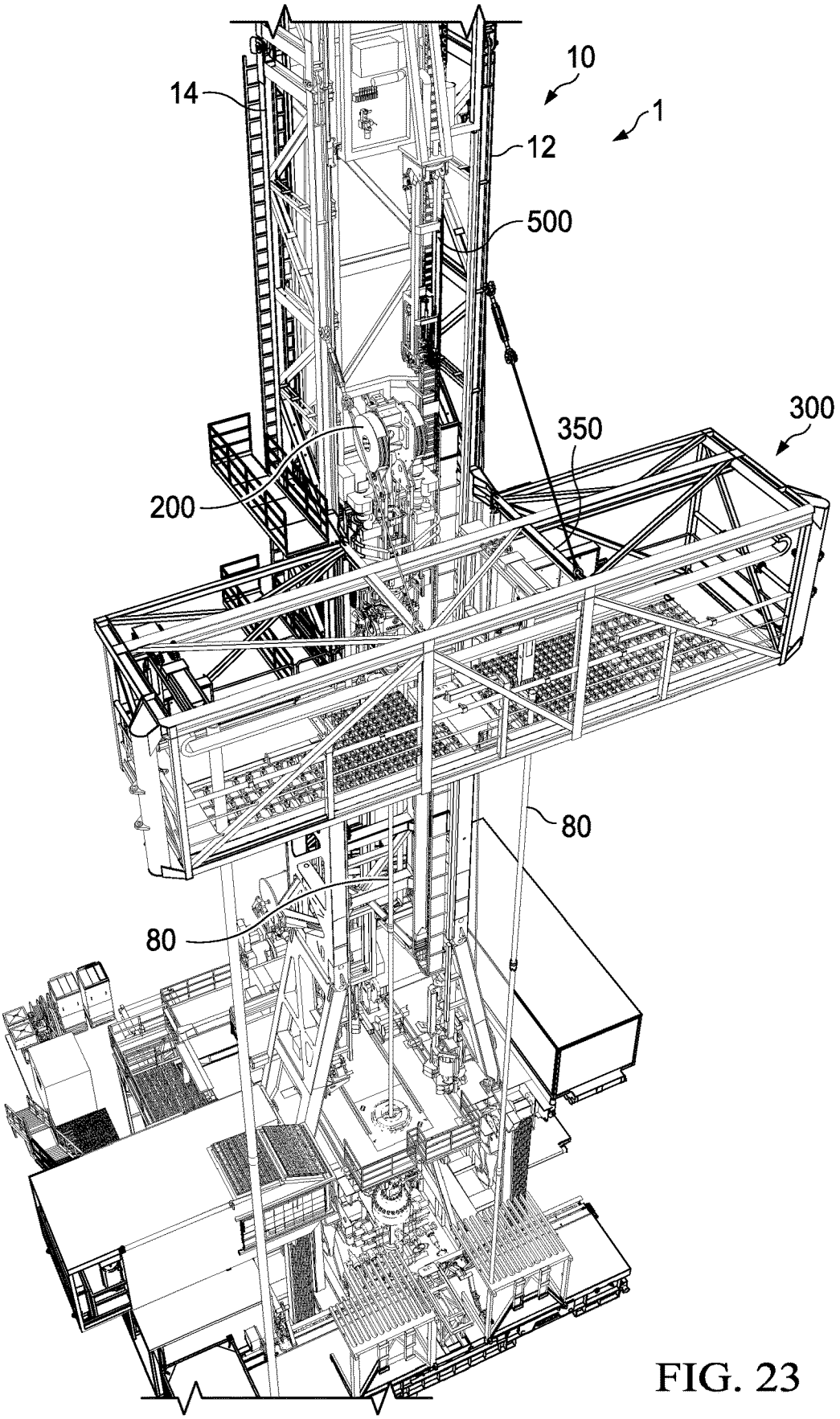
FIGS. 23 through 32 are isometric views that illustrate the high trip rate drilling rig of the disclosed embodiments in the process of moving tubular stands from a racked position and into the well, according to the disclosed embodiments.
Figure 24:
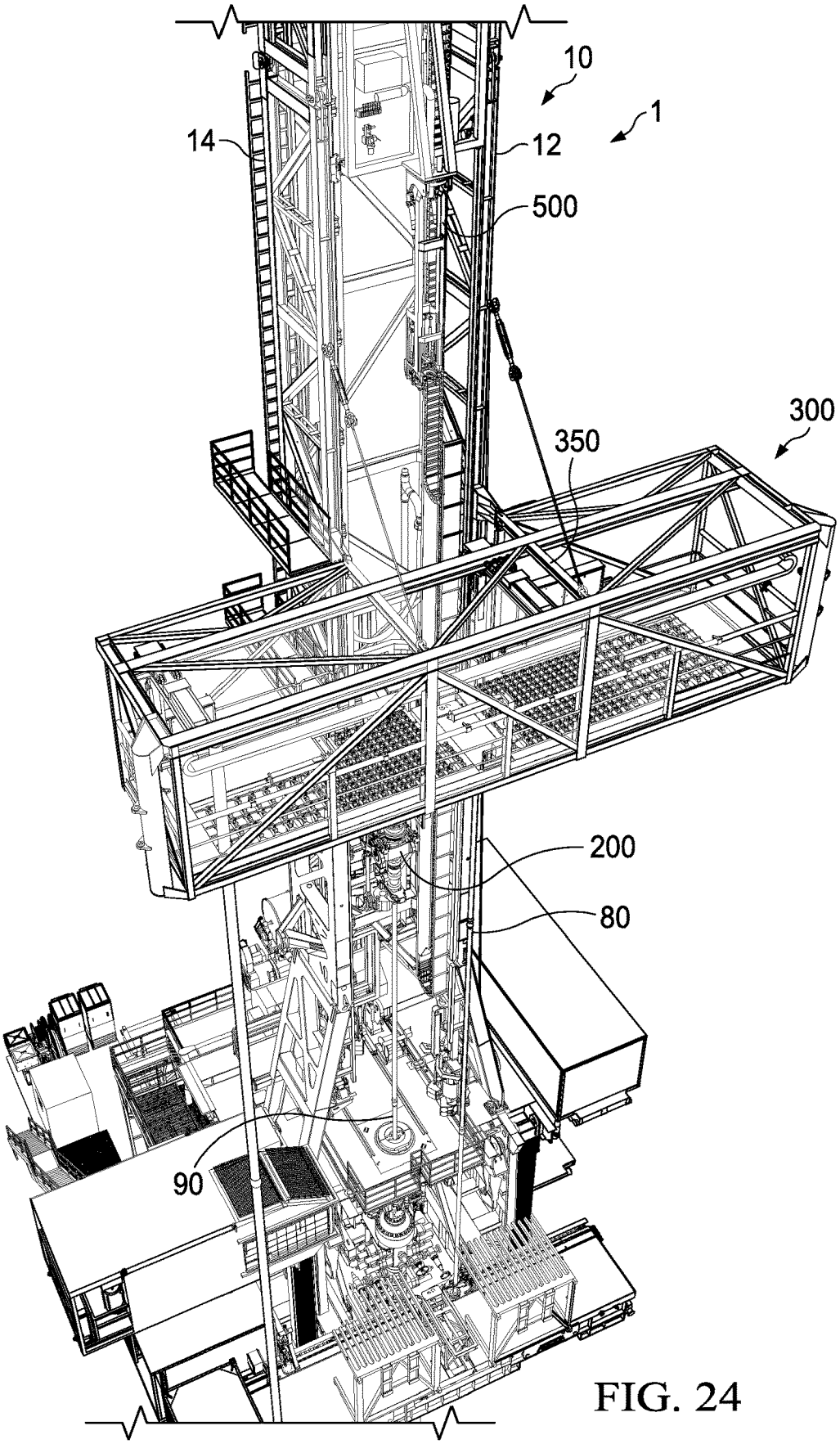
Figure 25:
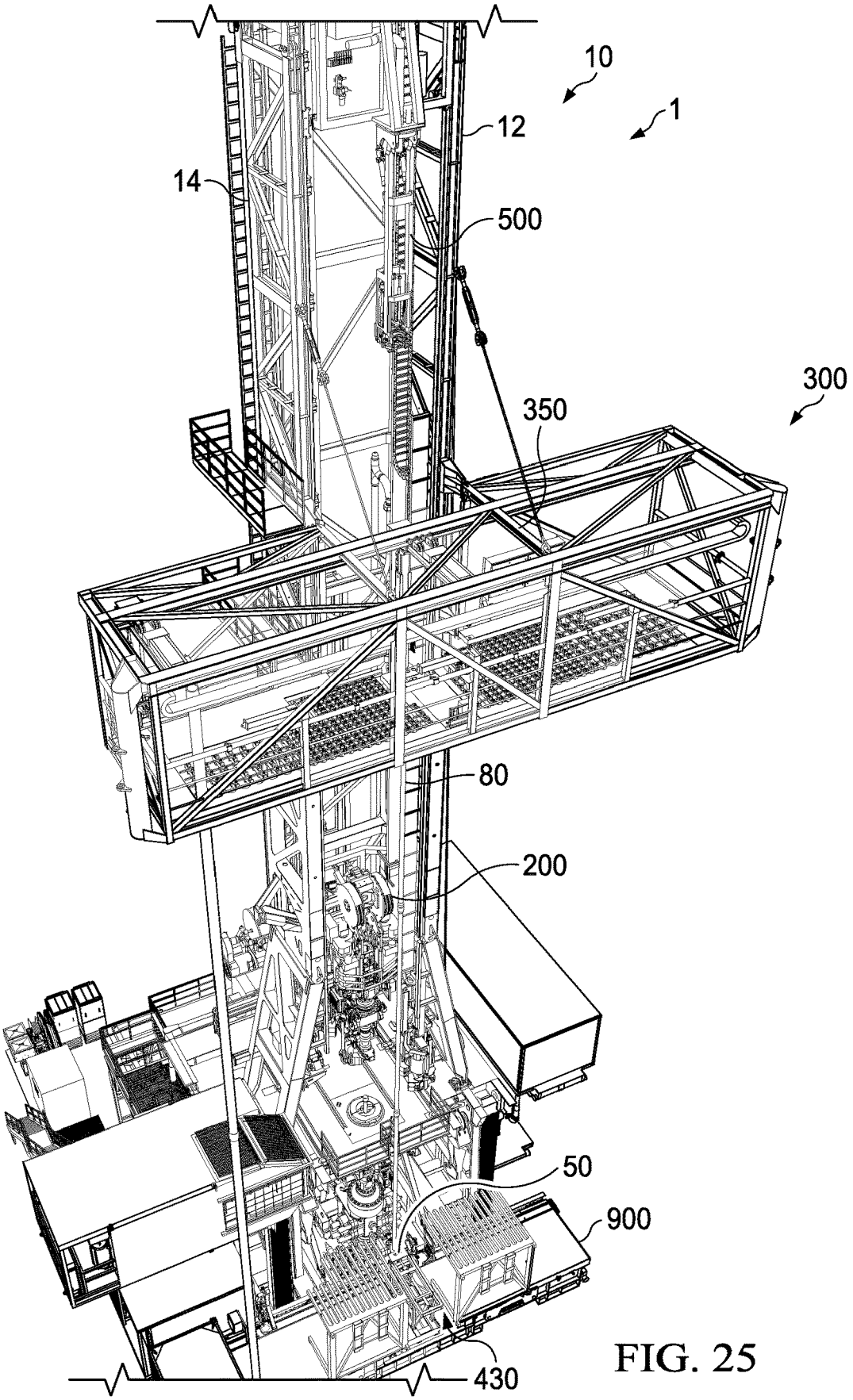

FIGS. 23-25 illustrate an embodiment of high trip rate drilling rig 1 in the process of moving tubular stands 80 from racking module 300 to well center 30 for placement into the well. To keep the drawings readable, some items mentioned below may not be numbered. Please refer to FIGS. 1-22 for the additional detail.

It will be appreciated by a person of ordinary skill in the art that the procedure illustrated, although for "tripping in" in well, can be generally reversed to understand the procedure for "tripping out."

FIG. 23 shows an embodiment of tubular delivery arm 500 on a front side 12 of mast 10 in an unarticulated position above racking module 300 on front side 12 of mast 10. In this position, tubular delivery arm 500 is above stand hand-off position 50, and vertically above retractable top drive assembly 200. Tubular stand 80 has been connected to the drill string in the well (not visible) and is now a component of drill string 90. Tubular stand 80 and the rest of drill string 90 is held by retractable top drive assembly 200, which is articulated into its well center 30 position, and is descending along mast 10 downward towards drill floor 6.

In the embodiment of FIG. 24, retractable top drive assembly 200 has descended further towards drill floor 6 as it lowers drill string 90 into the well. Upper racking arm 350 is moving the next tubular stand 80 from its racked position towards stand hand-off position 50.

In FIG. 25, retractable top drive assembly 200 has neared the position where automatic slips will engage drill string 90. Tubular delivery arm 500 has moved lower down front side 12 of mast 10 near stand hand-off position 50. Upper racking arm 350 and lower racking arm 950 (see FIG. 34) have delivered tubular stand 80 to stand hand-off position 50. Upper stand constraint 420 (see FIG. 35) and lower stand constraint 440 have secured tubular stand 80 at stand hand-off position 50.

Figure 26:
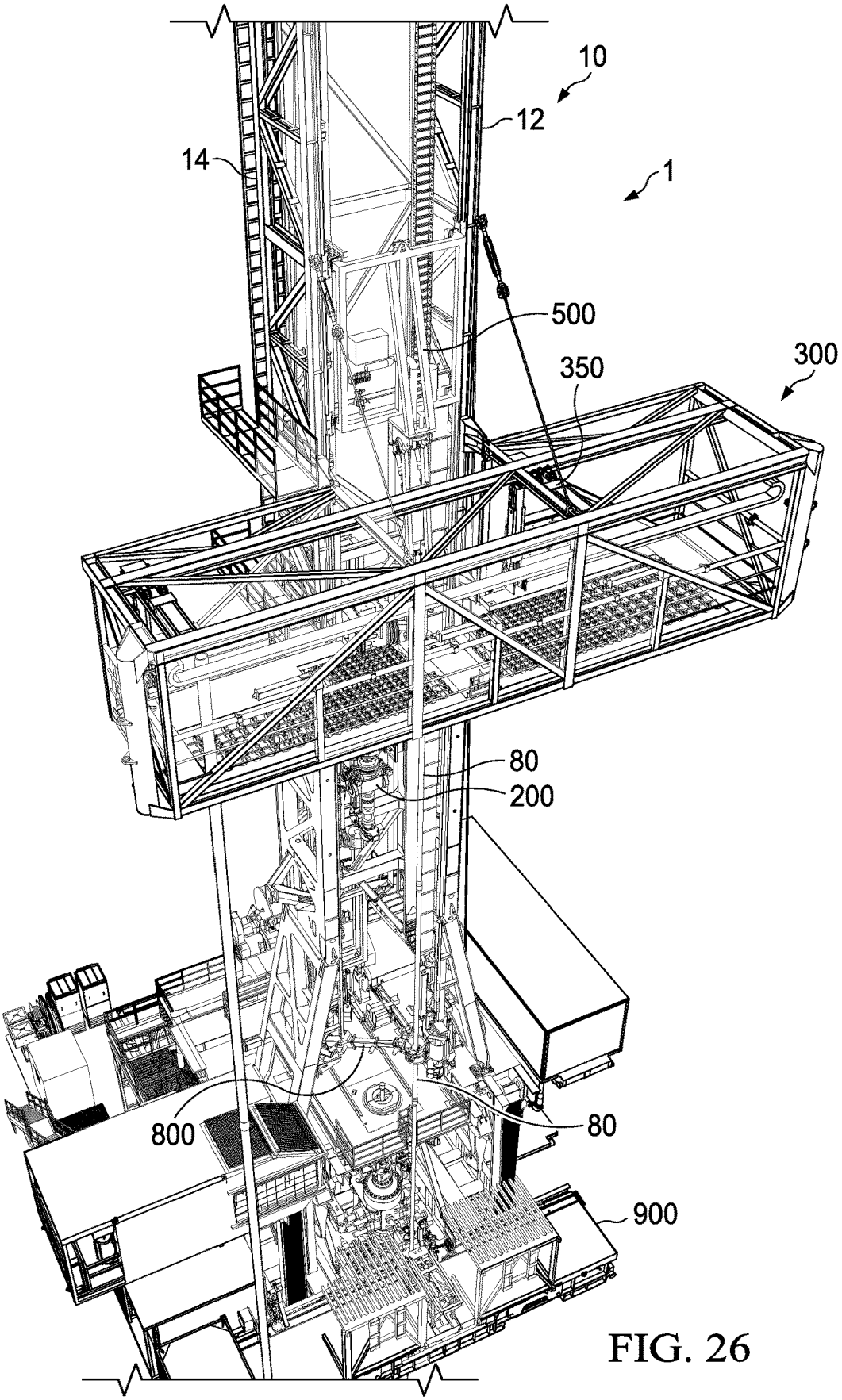

In the embodiment of FIG. 26, automatic slips have engaged drill string 3 and retractable top drive assembly 200 has released tubular stand 80. Retractable top drive assembly 200 has been moved into the retracted position of its return path behind well center 30 and proximate to the rear side 14 of mast 10. Tubular delivery arm 500 has articulated its arms 532 and its clasp 550 has latched onto tubular stand 80. Near drill floor 6, lower stabilizing arm 800 has engaged the lower end of tubular stand 80. Upper stand constraint 420 (see FIG. 35) has released tubular stand 80.

Figure 27:
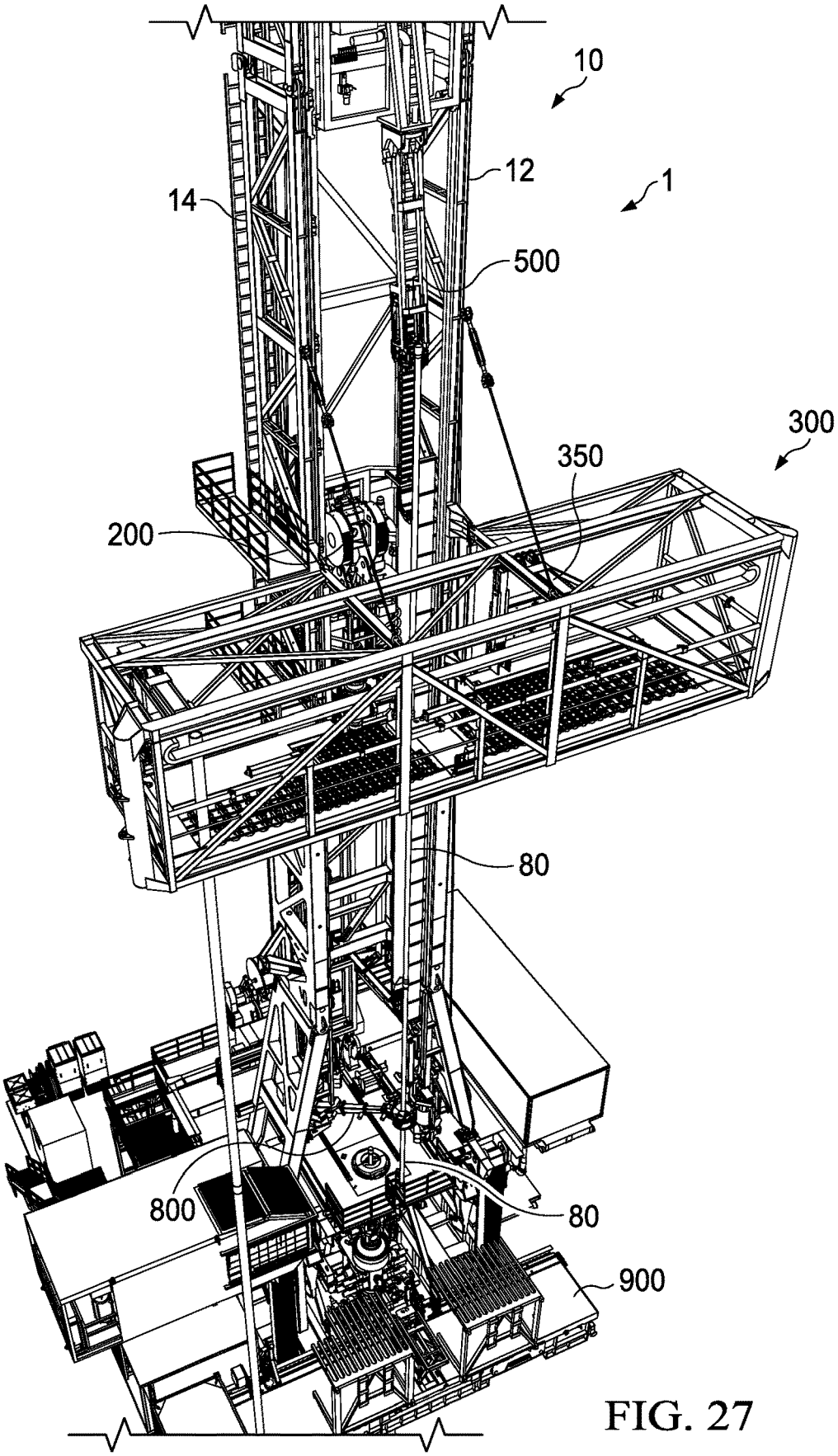

In the embodiment of FIG. 27, retractable top drive assembly 200 has begun a retracted ascent to the top of mast 10. Tubular delivery arm 500 has also risen along the front side 12 of mast 10. With this motion, clasp 550 of tubular delivery arm 500 has engaged the upset of tubular stand 80 and lifted tubular stand 80 vertically off setback platform 900. Lower stabilizing arm 800 is supporting the lower end of tubular stand 80.

Figure 28:
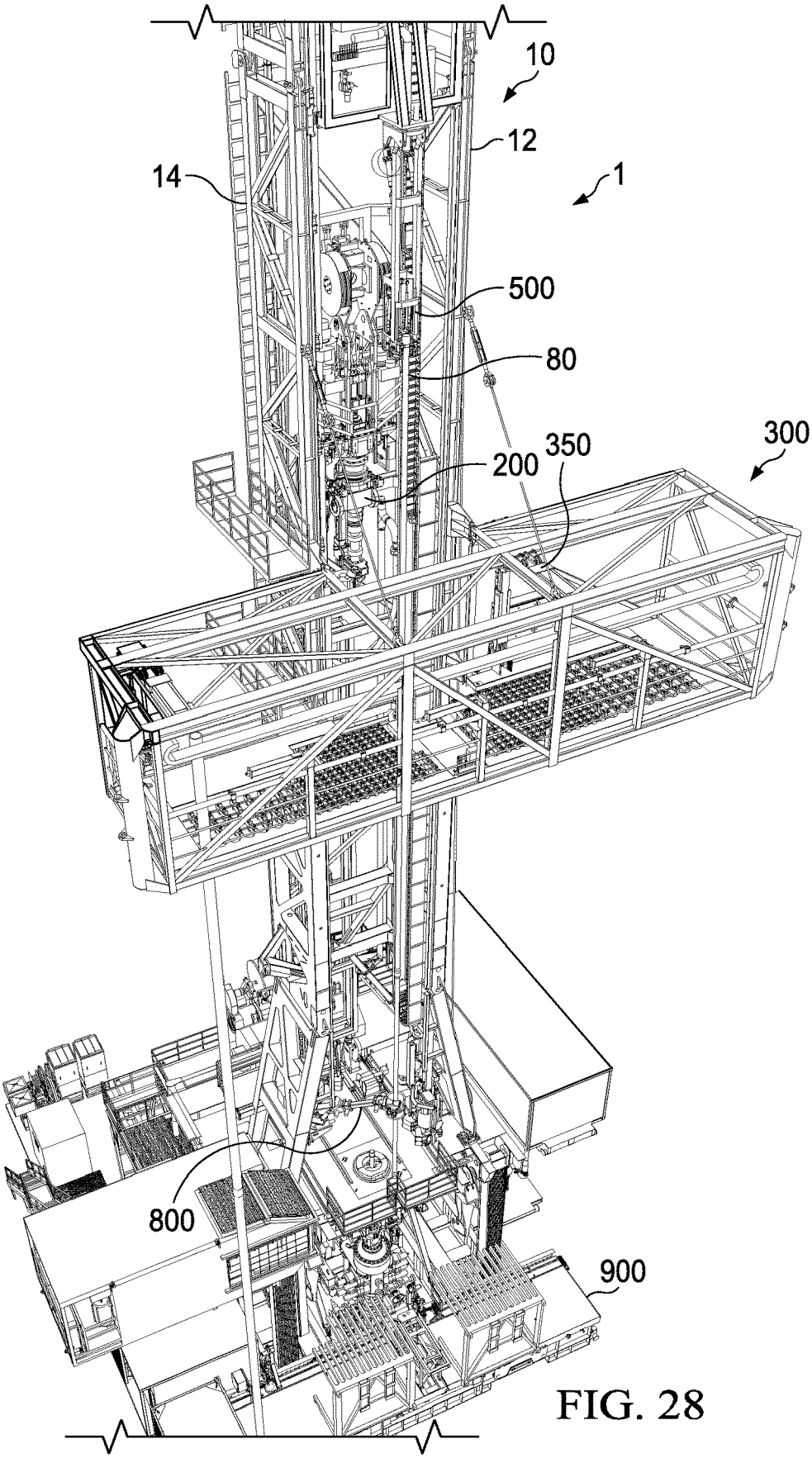

In the embodiment of FIG. 28, retractable top drive assembly 200 continues its retracted ascent up mast 10. Tubular delivery arm 500 has elevated sufficiently to insure the bottom of tubular stand 80 will clear the stump of drill string 90 extending above drill floor 6. Since releasing tubular stand 80 at stand hand-off position 50, upper racking arm 350 has been free to move to and secure the next drill stand in sequence.

Figure 29:
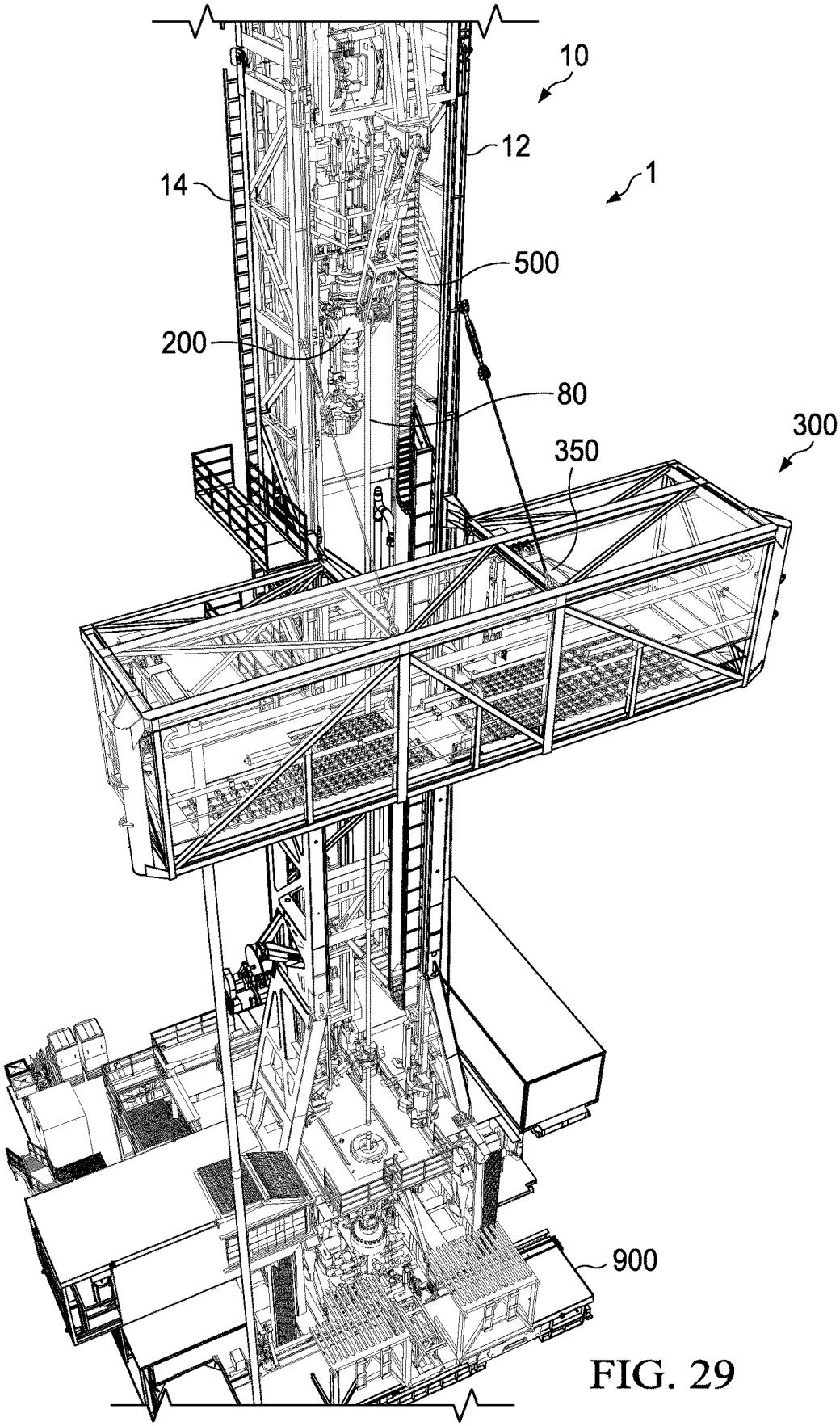

In the embodiment of FIG. 29, retractable top drive assembly 200 continues its retracted ascent up mast 10. Tubular delivery arm 500 has rotated 180 degrees, such that the opening on clasp 550 is facing well center 30. After rotation, tubular delivery arm 500 has been articulated to position tubular stand 80 over well center 30.

Figure 30:
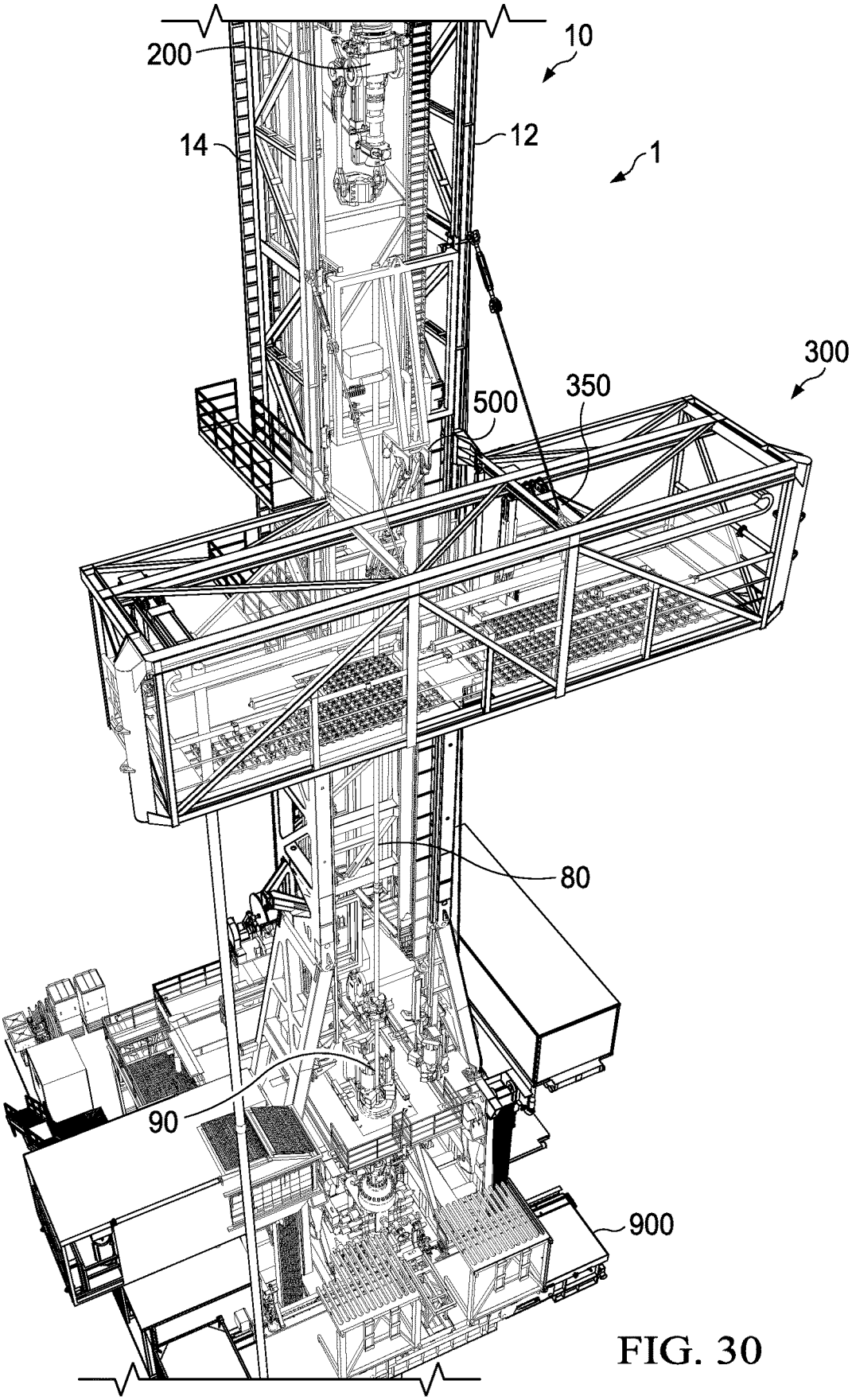

In the embodiment of FIG. 30, tubular delivery arm 500 has descended its path on the front side 12 of mast 10 until tubular stand 80, with guidance from lower stabilizing arm 800, has stabbed the pin connection of its lower tool joint into the box connection of the exposed tool joint of drill string 90. Tubular delivery arm 500 continues to descend such that clasp 550 moves lower on tubular stand 80 to make room for retractable top drive assembly 200, while maintaining lateral positioning and stabilizing the upper end of the stand 80.

Retractable top drive assembly 200 has risen to a position on mast 10 that is fully above tubular delivery arm 500. Having cleared tubular delivery arm 500 and tubular stand 80 in its ascent, retractable top drive assembly 200 has expanded actuator 220 to extend retractable top drive assembly 200 to its well center 30 position, directly over tubular stand 80, and is now descending to engage the top of tubular stand 80.

Figure 31:
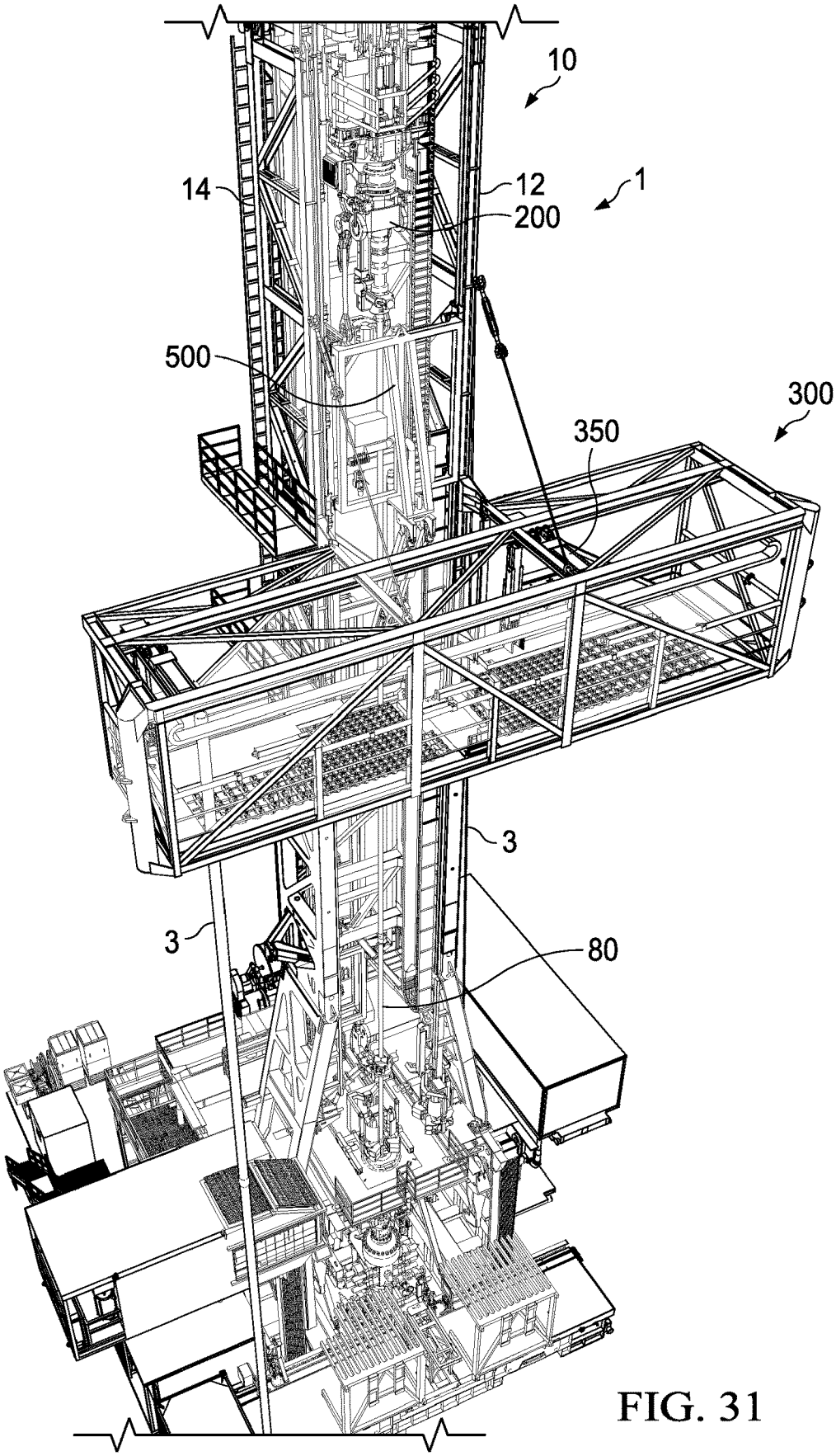

In the embodiment of FIG. 31, retractable top drive assembly 200 has engaged tubular stand 80 as centered by tubular delivery arm 500 at the top and lower stabilizing arm 800 at the bottom. Retractable top drive assembly 200 can now rotate to make-up and fully torque the connection. An iron roughneck at drill floor 6 may be used to secure the connection.

Figure 32:
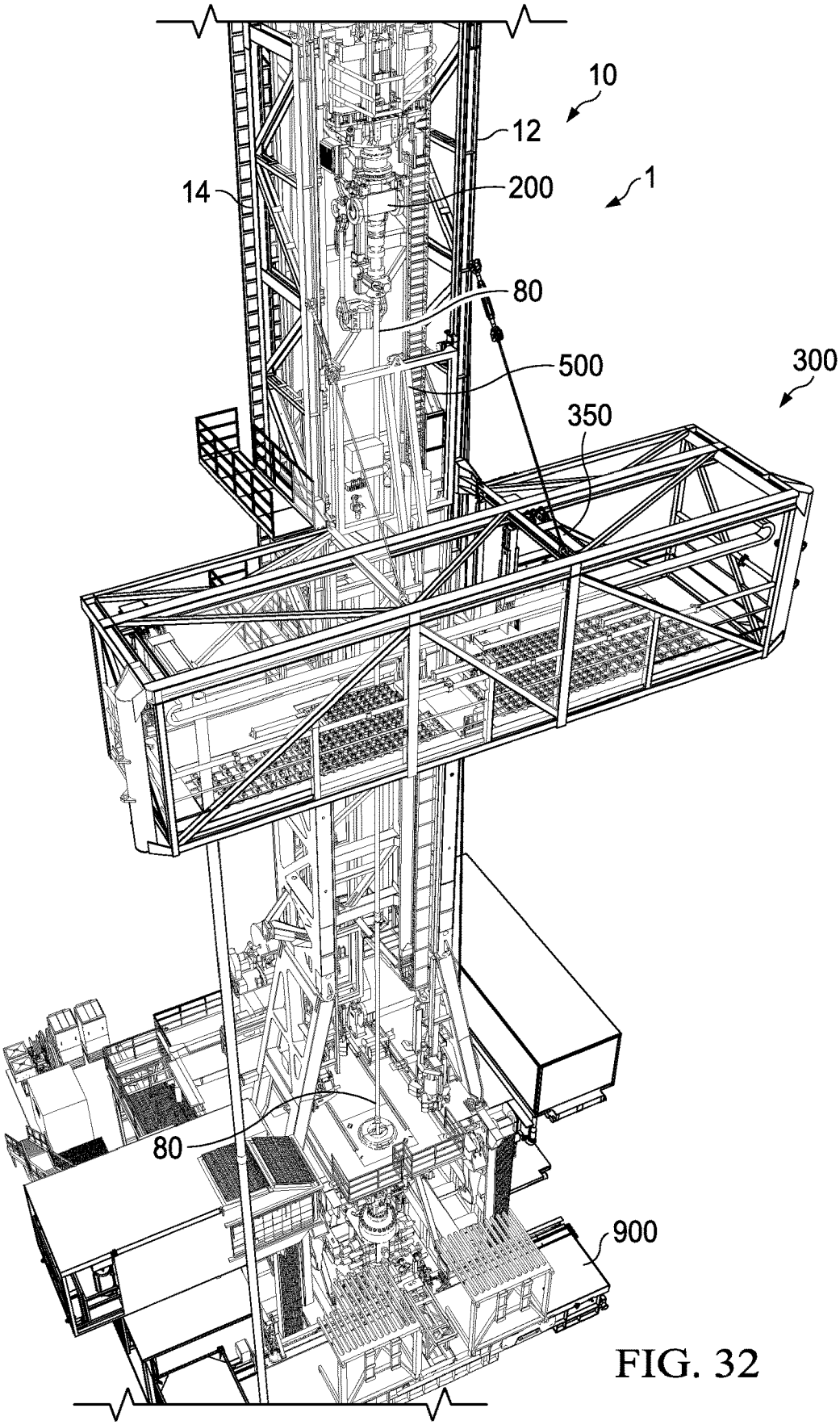

In the embodiment of FIG. 32, lower stabilizing arm 800 and tubular delivery arm 500 have released tubular stand 80 and retracted from well center 30. In the non-actuated position, tubular delivery arm 500 has rotated to allow clasp 550 to again face stand hand-off position 50 in anticipation of receiving the next tubular stand 80. Retractable top drive assembly 200 now supports the weight of the drill string as the automatic slips have also released, and retractable top drive assembly 200 is beginning its descent to lower drill string 90 into the wellbore.

Figure 33:
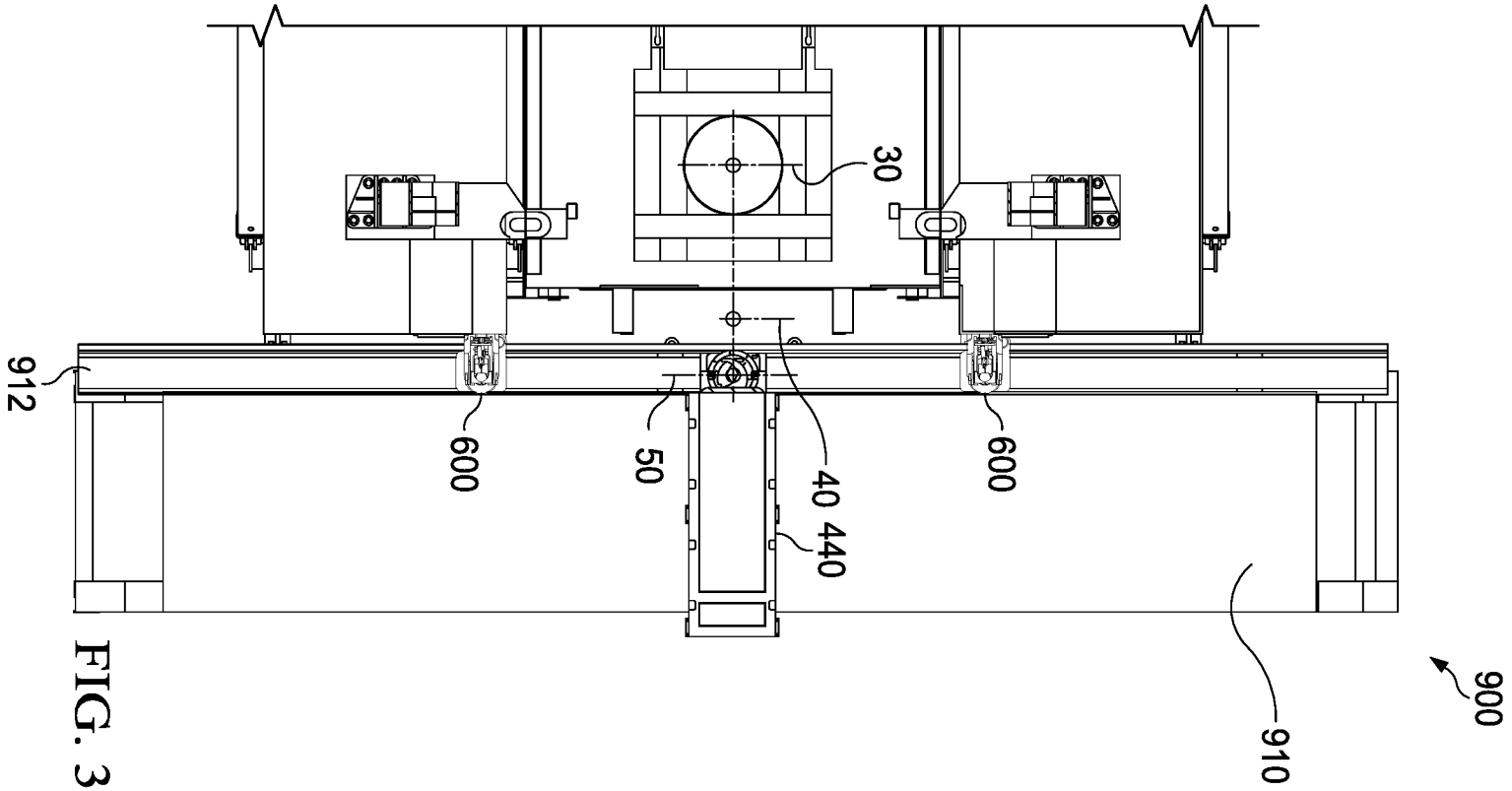
FIG. 33 is a top view of an embodiment of a setback platform of the tubular racking system of the disclosed embodiments.

FIG. 33 is a top view of an embodiment of setback platform 900 on which the tubular stands 80 are stacked in accordance with their respective positions in the fingerboard assembly 310. Drilling rig 1, catwalk 600 and tubular stands 80 are removed for clarity. This embodiment illustrates the relationship between well center 30, mousehole 40, and stand hand-off position 50. As seen in this view, an alleyway 912 is provided on the front edge of setback platform 900. Stand hand-off position 50 is located in the platform alleyway 912, in alignment with mousehole 40 and well center 30. A pair of lower racking arms 950 is also located in alleyway 912.

Figure 34:
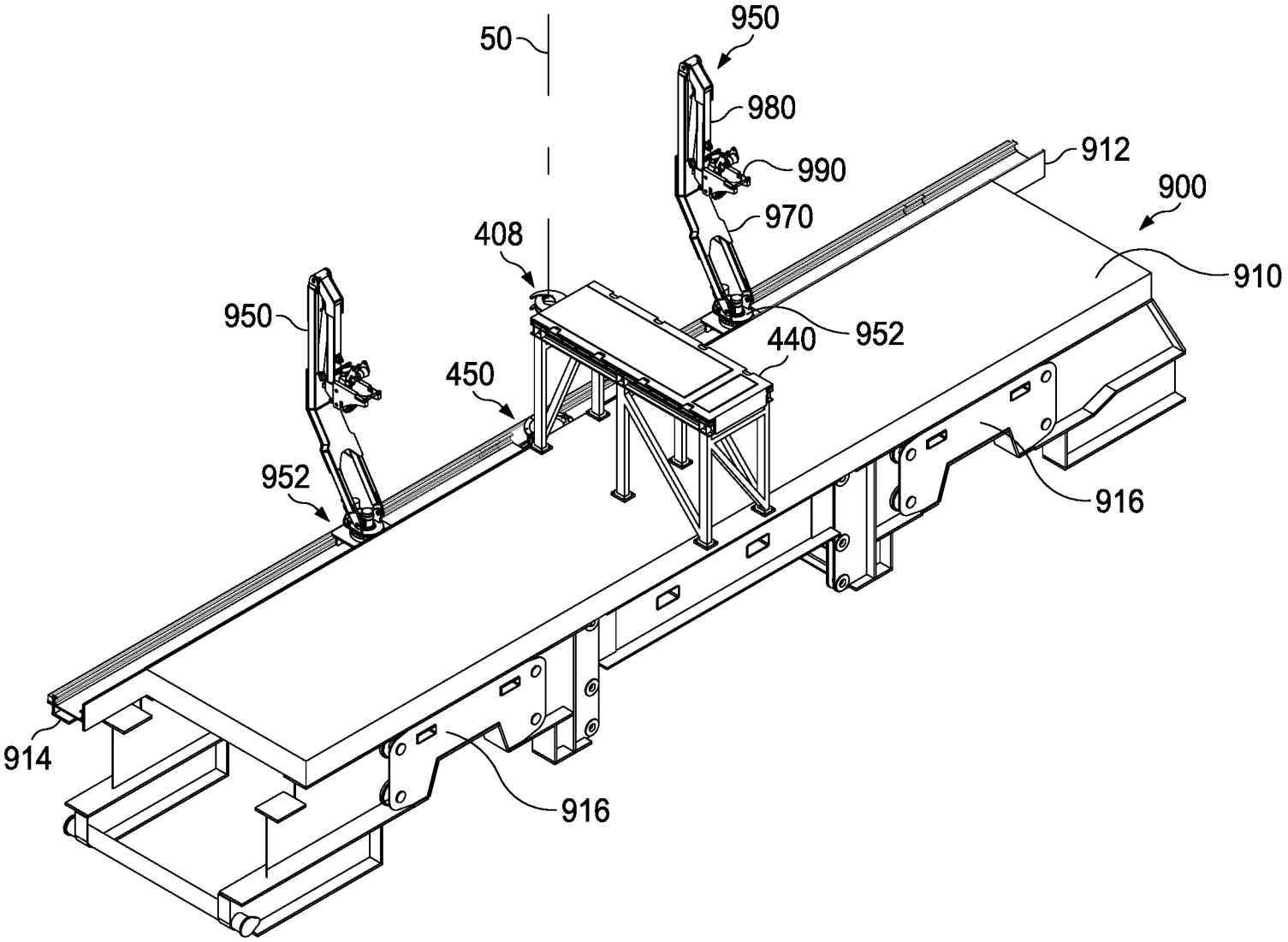
FIG. 34 is an isometric view of an embodiment of the setback platform of the tubular racking system of the disclosed embodiments.

FIG. 34 is an isometric view of an embodiment of setback platform 900 of the tubular racking system of the disclosed embodiments. Setback platform 900 comprises platform 910 for vertical storage of tubular stands 80. Platform 910 has a mast side and an opposite catwalk side. Alleyway 912 extends along the mast side of platform 910. Alleyway 912 is offset below platform 910. Stand hand-off position 50 is located on alleyway 912. A geared rail 914 is affixed to alleyway 912. A lower racking arm 950 is provided, having a base 952 translatably connected to the rail 914. A lower racking frame 970 is connected to the base 952 in rotatable and pivotal relation. A lower racking arm member 980 is pivotally connected to the frame 970, and a clasp 990 is pivotally connected to the arm member 980.

Figure 35:
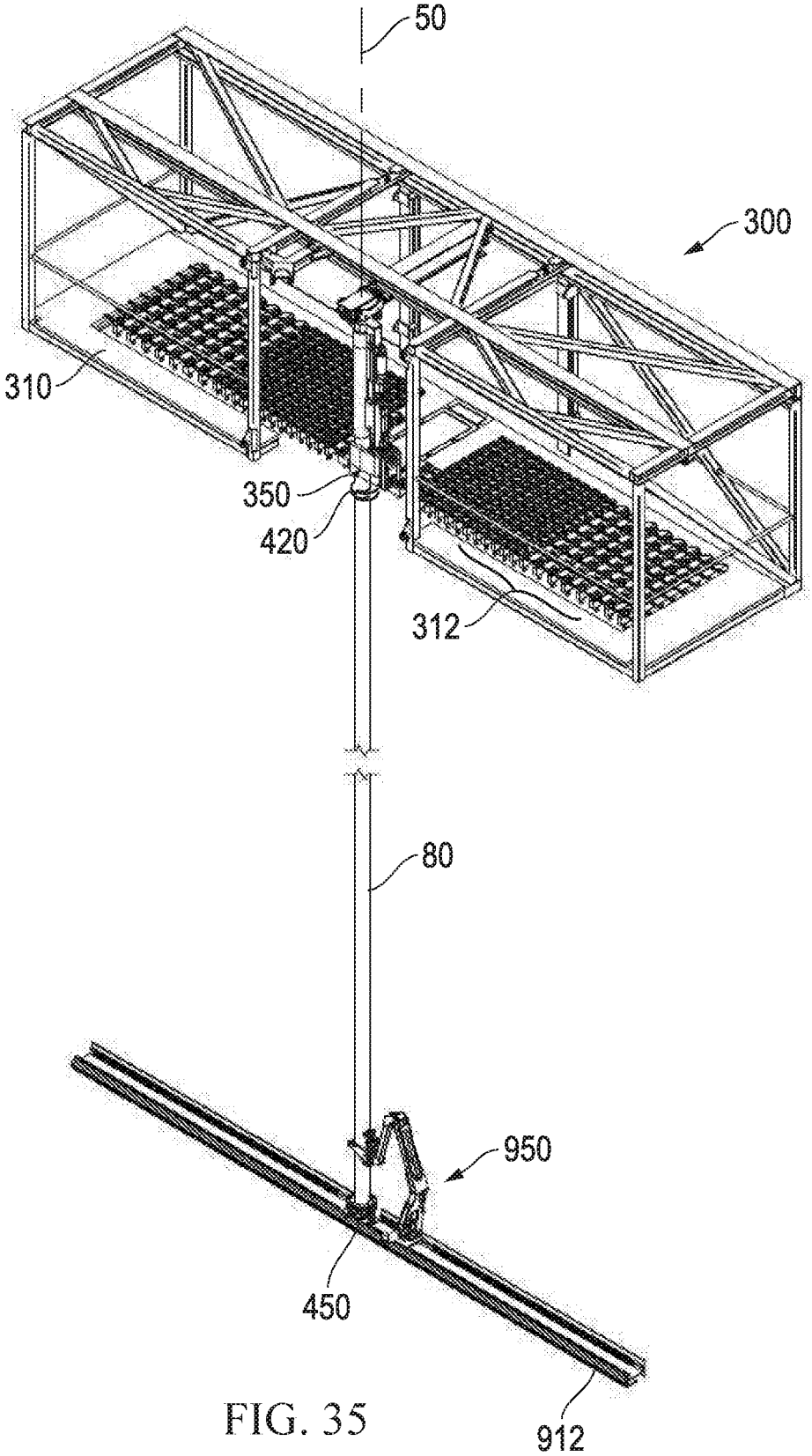
FIG. 35 is an isometric view of an upper racking module of the tubular racking system of the disclosed embodiments.

FIG. 35 is an isometric view of an embodiment of upper racking module 300 illustrating tubular stand 80 held at stand hand-off position 50 by upper stand constraint 420, and engaged by upper racking arm 350 and by lower racking arm 950. Optional engagement with lower stand constraint 440 is not shown. Lower racking arm 950 in some embodiments can allow the lower end of the stand 80 to rotate freely on the centerline of tubular stand 80, e.g., and the arm 950 can thus follow upper racking arm 350 between stand hand-off position 50 and any racking position in racking module 300, while keeping tubular stand 80 vertical.

Figure 36:
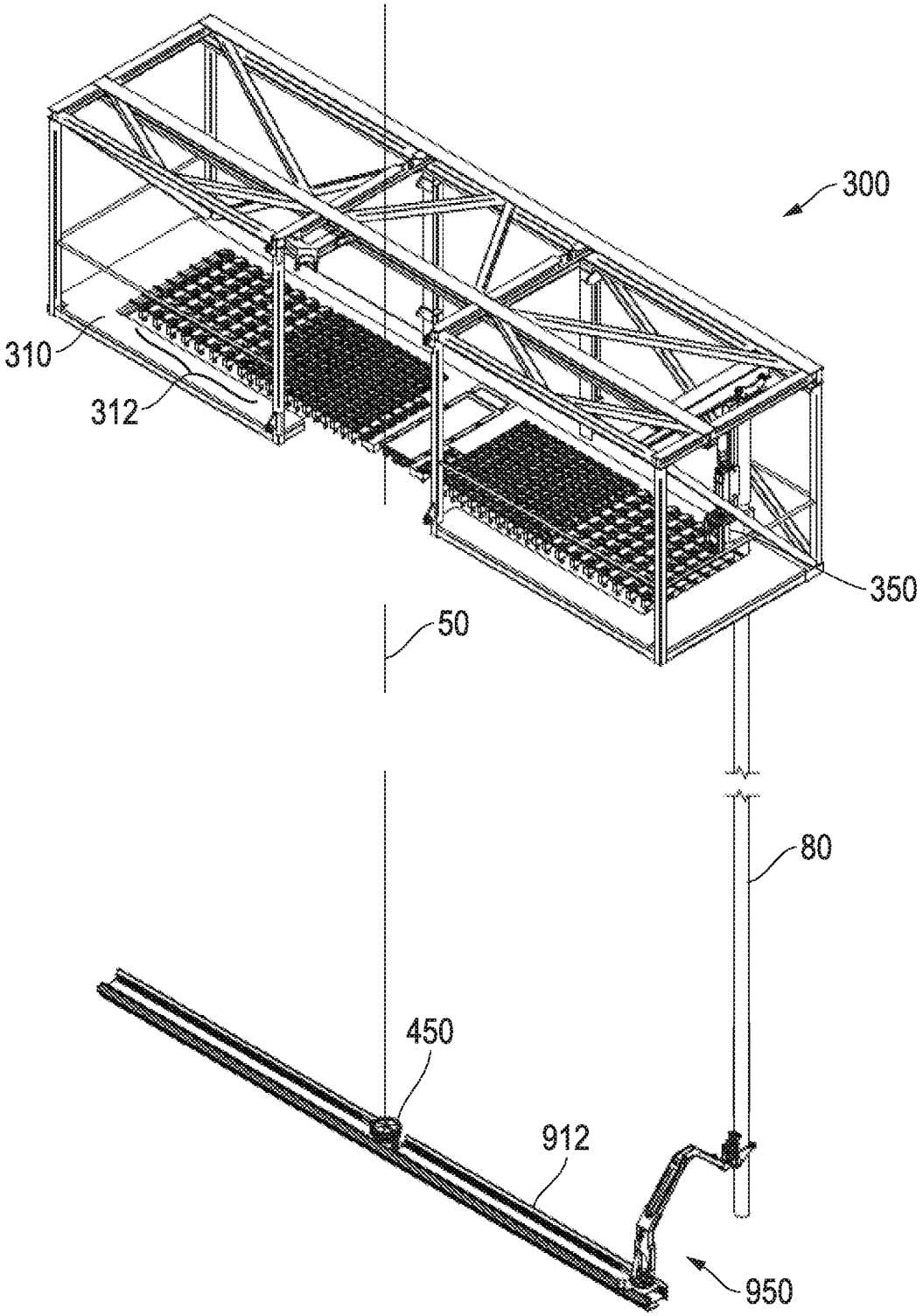
FIG. 36 is an isometric view of the embodiment of FIG. 35 of the upper racking module of the tubular racking system of the disclosed embodiments.

FIG. 36 is an isometric view illustrating an embodiment of tubular stand 80 supported vertically by upper racking arm 350 and held at its lower end by lower racking arm 950, and extended to its designated racking position.

Figure 37:
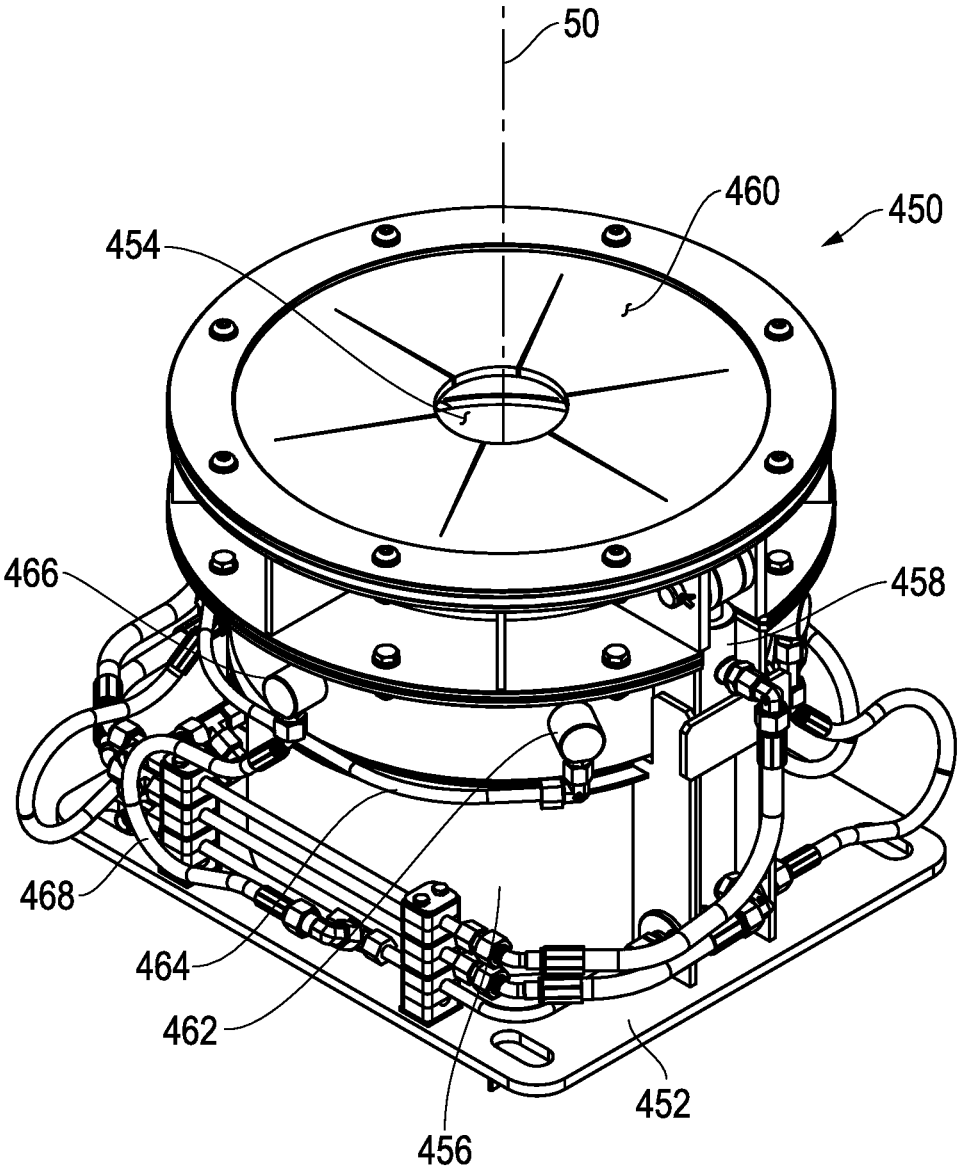
FIG. 37 is an isometric view of an embodiment of a stand hand-off station of the disclosed embodiments.

FIG. 37 is an isometric view of an embodiment of a stand hand-off station 450. Referring to the embodiments illustrated in FIGS. 34-36, stand hand-off station 450 is located at stand hand-off position 50, in alleyway 912. Alleyway 912 is set vertically below surface 910. This permits positioning of stand hand-off station 450 below surface 910 so that tubular stand 80 need not be raised a significant distance by upper racking arm 350 to achieve access to stand hand-off station 450.

As shown in the embodiment of FIG. 37, stand hand-off station 450 has a base 452. An expandable chamber assembly 470 comprises a lower chamber 472 connected to base 452, and an upper chamber 474 positioned in concentric relationship to lower chamber 472. A chamber actuator 458 is connected between lower chamber 472 and upper chamber 474.

A stage 454 is located inside chamber assembly 470. Stage 454 is receivable of the threaded pin end of tubular stand 80. An elastomeric seal 460 is located over a top end of upper chamber 474. Seal 460 has an opening for receiving the threaded pin end of tubular stand 80.

In one embodiment, a grease nozzle 462 is directed towards the interior of chamber assembly 470. A grease supply line 464 is connected to grease nozzle 462 for supplying pressurized grease to grease nozzle 462.

In one embodiment, a wash nozzle 466 is directed towards the interior of chamber assembly 470. A wash supply line 468 is connected to wash nozzle 466 for supplying pressurized washing fluid to wash nozzle 466. A drain is connected to the interior of chamber assembly 470 for collection and removal of wash residue.

In operation, chamber actuator 458 is in the contracted position. The threaded pin end of tubular stand 80 is lowered through the opening of seal 460 and onto stage 454, which receives and supports the weight of tubular stand 80. Chamber actuator 458 is actuated to raise upper chamber 474 upwards to a proper height to cover the threads of the pin connection. In this position, a wash cycle may be activated in which a washing fluid is provided through wash supply line 468 and is sprayed through wash nozzle 466 onto the threaded pin portion of tubular stand 80. Residual wash fluid passes through drain 456 for recycling or disposal.

Alternatively, or subsequently, a doping cycle may be activated in which grease is provided through grease supply line 464 and is sprayed through grease nozzle 462 onto the threaded pin portion of tubular stand 80. This step is intended to replace the manual doping of the threaded connection prior to threading the connection into the box end of another tubular stand 80.

EMBODIMENTS LISTING

Accordingly, the instant disclosure relates to the following embodiments:

1. A drilling rig [1] comprising:
   a top drive assembly [200] vertically translatable along a mast [10] of the drilling rig [1];
   a tubular delivery arm [500] vertically translatable along the mast [10]; and
   the tubular delivery arm [500] having a tubular clasp [550] that is movable between a well center position [30] over a well center and a second position [50] forward of the well center position.
2. The drilling rig of Embodiment 1, further comprising: the top drive assembly and tubular delivery arm having non-conflicting vertical paths.
3. The drilling rig of Embodiment 1, further comprising: the tubular clasp of the tubular delivery arm movable between the well center position and a mousehole position forward of the well center position.
4. The drilling rig of Embodiment 1, further comprising: the tubular clasp of the tubular delivery arm movable between the well center position and a stand hand-off position forward of the well center position.
5. The drilling rig of Embodiment 1, further comprising: the tubular clasp of the tubular delivery arm movable between the well center position and a catwalk position forward of the well center position.
6. The drilling rig of Embodiment 1, further comprising: the top drive assembly being vertically translatable along a first path over the well center and along a second path rearward to a drawworks side of well center.
7. The drilling rig of Embodiment 1, further comprising: the top drive assembly being horizontally movable between the well center position over the well center and a retracted position rearward to a drawworks side of the well center position.

8. The drilling rig of Embodiment 7, the top drive assembly further comprising:

a dolly translatably connected to the mast;

a travelling block assembly;

a top drive suspended from the travelling block assembly;

a yoke pivotally connecting the travelling block to the dolly;

an extendable actuator connected between the dolly and the yoke;

a torque tube rigidly connected to the travelling block;

the torque tube connected to the top drive in vertically slidable relation;

wherein extension of the actuator pivots the first yoke to extend the travelling block and top drive away from the dolly to a position over a well center; and wherein retraction of the actuator pivots the first yoke to retract the travelling block towards the dolly to a position away from the well center.

9. The drilling rig of Embodiment 8, further comprising:

wherein torque reactions of a drill string responding to rotation by the top drive are transferred from the top drive to the torque tube, from the torque tube to the travelling block, from the travelling block to the dolly, and from the dolly to the mast.

10. The drilling rig of Embodiment 1, the tubular delivery arm further comprising:

a dolly translatably connected to the mast;

an arm rotatably and pivotally connected to the dolly at its upper end; and the tubular clasp pivotally connected to the arm at its lower end.

11. The drilling rig of Embodiment 10, further comprising:

an inclination actuator pivotally connected between the arm and the clasp.

12. The drilling rig of Embodiment 1, further comprising:

a racking module connected to the drilling rig mast, the racking module comprising:

a frame;

a fingerboard assembly connected to the frame having columns receivable of tubular stands, optionally with the columns oriented in a direction towards the mast;

a fingerboard alleyway connecting the columns on a mast side of the columns; and an upper racking arm comprising:

a bridge translatably connected to the frame in translatable relation;

an arm connected to the bridge in rotatable and translatable relation; and a gripper connected to the arm in vertically translatable relation.

13. The drilling rig of Embodiment 12, further comprising:

a setback platform module comprising:

a platform positioned beneath the fingerboard assembly;

a platform alleyway [912] beneath the fingerboard alleyway of the racking module;

a lower racking arm comprising:

a base connected to the alleyway in translatable relation;

a frame connected to the base in rotatable and pivotal relation;

an arm pivotally connected to the frame; and a clasp pivotally connected to the arm.

14. The drilling rig of Embodiment 13, further comprising: a stand hand-off position located on a mast side of the platform and extending vertically upwards.

15. A method of moving tubular stands [80] from a racked position on a setback platform

[900] and in a racking module [300] to a drill string [90] at the drill floor [6] of a drilling rig [1], comprising the steps of:

clasping a lower portion of a tubular stand [80] resting on the setback platform [900] with a lower racking arm [950];

hoisting the tubular stand [80] with an upper racking arm [350] on a racking module [300] connected to a mast [10] of the drilling rig [1];

moving the tubular stand [80] towards a stand hand-off position [50] with the upper racking arm [350];

moving the clasped lower end of the tubular stand [80] with the lower racking arm [950] along a path coincident to movement of the tubular stand [80] by the upper racking arm [350];

positioning the tubular stand [80] above a stand hand-off position [50] located on the setback platform [900];

lowering the tubular stand [80] to rest at the stand hand-off position [50];

engaging an upper portion of the tubular stand [80] with an upper stand constraint [420];

disengaging the upper racking arm [350] and the lower racking arm [950] from the tubular stand [80];

engaging the upper portion of the tubular stand [80] with a vertically translatable tubular delivery arm [500];

disengaging the tubular stand [80] from the upper stand constraint [420] and lower stand constraint [440];

engaging a lower portion of the tubular stand [80] with a lower stabilizing arm [800];

hoisting the stand [80] with the tubular delivery arm [500]; and stabbing the tubular stand [80] into a drill string end extending above a rotary table [810] on the drill floor [6].

16. The method of embodiment 15, further comprising: engaging a lower portion of the tubular stand with a lower stabilizing arm at the stand hand-off position.

17. The method of embodiment 15, further comprising: engaging a lower portion of the tubular stand with a lower stand constraint at the stand hand-off position.

18. The method of embodiment 15, further comprising:

engaging the tubular stand with a tubular connection torqueing device located above the drill floor;

disengaging the lower stabilizing arm from the tubular stand;

coupling the stand to the drill string in the rotary table;

lowering the position of engagement of the delivery arm on the stand;

engaging the upper portion of the stand with an elevator of a top drive;

disengaging the delivery arm from the stand;

hoisting the stand and connected drill string with the top drive assembly to release the drill string from its support at the drill floor; and lowering the stand and connected drill string into the wellbore with the top drive.

19. The method of embodiment 15, further comprising:

clasping the tubular stand with an upper stand constraint when the tubular stand is at the stand hand-off position; and unclasping the tubular stand from the upper stand constraint when the tubular stand has been clasped by the tubular delivery arm.

20. A method of moving tubular stands [80] from a racked position to a drill string [90] at the drill floor [6] of a drilling rig [1], comprising the steps of:

transporting a tubular stand [80] from a racked position in a fingerboard [310] to a stand hand-off position [50] with an upper racking arm [350] on a racking module [300] connected to a mast [10] of the drilling rig [1];

setting the tubular stand [80] down at the stand hand-off position [50];

transporting a tubular stand [80] from the stand hand-off position [50] to a well center position [30] with a tubular delivery arm [500] translatably connected to the drilling mast [10];

stabbing the tubular stand [80] into a stump of a drill string [90] at the well center [30];

connecting the tubular stand [80] to the drill string [90]; and lowering the drill string [90] with a top drive assembly [200] translatably connected to the drilling mast [10].

21. A drilling rig [1], comprising:

a substructure [2] comprising a pair of base boxes;

a drill floor [6] above the substructure [2];

a setback platform [900] below and forward of the drill floor [6];

a mast [10] extending vertically above the drill floor [6];

a top drive assembly [200] vertically translatable along the mast [10];

a tubular delivery arm [500] vertically translatable along the mast [10];

the tubular delivery arm [500] having a tubular clasp [550] movable between a well center position [30] over a well center and a stand hand-off position [50] forward of the well center position [30];

the top drive assembly [200] being vertically translatable along a first path over the well center and along a second path rearward of the first path;

a racking module [300] extending outward of the mast [10] above the set-back platform [900];

a stand hand-off position [50] located on the setback platform [900], and extending vertically upwards substantially between the mast [10] and the racking module [300]; and an upper stand constraint [420] connected beneath the racking module [300] and extendable rearward towards the mast [10].

22. The drilling rig of embodiment 21, further comprising:

an intermediate stand constraint having a frame connected to the drilling rig at an edge of the V-door side of the drill floor;

a carriage connected to the frame in extendable relationship;

a carriage actuator connected between the frame and the carriage, and operable to extend or retract the carriage outward from the frame;

a tubular clasp attached to the extendable end of the carriage;

a clasp actuator connected to the tubular clasp, and operable to open or close the tubular clasp around a tubular stand;

a tubular gripper attached to the extendable end of the carriage; and a gripper actuator connected to the tubular gripper, and operable to open or close the tubular gripper around a tubular stand.

A1. A drilling rig [1] comprising:

a top drive assembly [200] vertically translatable along a mast [10]; and a tubular delivery arm [500] vertically translatable along the mast [10];

the tubular delivery arm [500] comprising a dolly [510] translatably connected to the mast, and an arm member [532] having an upper end rotatably and pivotally connected to the dolly, and a lower end pivotally connected to a tubular clasp [550] that is movable between a well center position [30] over a well center and a second position [50] forward of the well center position.

A2. The drilling rig of Embodiment A1, wherein the top drive assembly and tubular delivery arm have non-conflicting vertical paths.

A3. The drilling rig of Embodiment A1 or Embodiment A2, wherein the tubular clasp of the tubular delivery arm is movable between the well center position and a mousehole position forward of the well center position.

A4. The drilling rig of any of embodiments A1-A3, wherein the tubular clasp of the tubular delivery arm is movable between the well center position and a stand hand-off position forward of the well center position.

A5. The drilling rig of any of embodiments A1-A4, wherein the tubular clasp of the tubular delivery arm is movable between the well center position and a catwalk position forward of the well center position.

A6. The drilling rig of any of embodiments A1-A5, wherein the top drive assembly having a top drive vertically translatable along a first path over the well center and along a second path rearward to a drawworks side of well center.

A7. The drilling rig of any of embodiments A1-A6, wherein the top drive assembly has a top drive horizontally movable between the well center position over the well center and a retracted position rearward to a drawworks side of the well center position.

A8. The drilling rig of any of embodiments A1-A7, the top drive assembly comprising:

a dolly translatably connected to the mast;

a travelling block assembly;

a top drive suspended from the travelling block assembly;

a yoke pivotally connecting the travelling block to the dolly;

an extendable actuator connected between the dolly and the yoke;

a torque tube rigidly connected to the travelling block;

the torque tube connected to the top drive in vertically slidable relation;

wherein extension of the actuator pivots the first yoke to extend the travelling block and top drive away from the dolly to a position over a well center; and wherein retraction of the actuator pivots the first yoke to retract the travelling block towards the dolly to a position away from the well center.

A9. The drilling rig of Embodiment A8, wherein torque reactions of a drill string responding to rotation by the top drive are transferred from the top drive to the torque tube, from the torque tube to the travelling block, from the travelling block to the dolly, and from the dolly to the mast.

A10. The drilling rig of any of embodiments A1-A9, wherein the tubular clasp is engageable with an upset of a tubular stand [80] and moveable on the tubular stand below the upset.

A11. The drilling rig of any of embodiments A1-A10, the tubular delivery arm further comprising an arm bracket [520] extending outwardly from the dolly, and a drive plate [530] rotatably connected to the arm bracket, the upper end of the arm member pivotally connected to the drive plate.

A12. The drilling rig of any of embodiments 1-10, the tubular delivery arm further comprising an arm bracket [520] extending outwardly from the dolly, a drive plate [530] rotatably connected to an underside of the arm bracket, and a rotary actuator [522] connected to the drive plate, the upper end of the arm member pivotally connected to the drive plate.

A13. The drilling rig of embodiment A11 or embodiment A12, further comprising a tilt actuator [540] pivotally connected between the drive plate and the arm member.

A14. The drilling rig of any of embodiments A1-A13, further comprising:

an incline actuator [552] pivotally connected between the arm and the clasp.

A15. The drilling rig of any of embodiments A1-A14, further comprising:

a racking module connected to the drilling rig mast, the racking module comprising:

a frame;

a fingerboard assembly connected to the frame having columns receivable of tubular stands, optionally with the columns oriented in a direction towards the mast;

a fingerboard alleyway connecting the columns on a mast side of the columns; and an upper racking arm comprising:

a bridge connected to the frame in translatable relation;

an arm connected to the bridge in rotatable and translatable relation; and a gripper connected to the arm in vertically translatable relation.

A16. The drilling rig of Embodiment A15, further comprising:

a setback platform module comprising:

a platform positioned beneath the fingerboard assembly;

a platform alleyway [912] beneath the fingerboard alleyway of the racking module;

a lower racking arm comprising:

a base connected to the alleyway in translatable relation;

a frame connected to the base in rotatable and pivotal relation;

an arm pivotally connected to the frame; and a clasp pivotally connected to the arm.

A17. The drilling rig of any of embodiments A1-A16, further comprising:

a stand hand-off position [50] located on a mast side of a setback platform [900] and extending vertically upwards substantially between the mast and a racking module [300] extending outward of the mast above the setback platform.

A18. A drilling rig [1], comprising:

a substructure [2] comprising a pair of base boxes;

a drill floor [6] above the substructure [2];

a setback platform [900] below and forward of the drill floor [6];

a mast [10] extending vertically above the drill floor [6];

a top drive assembly [200] vertically translatable along the mast [10];

a tubular delivery arm [500] vertically translatable along the mast [10];

the tubular delivery arm [500] having a tubular clasp [550] movable between a well center position [30] over a well center and a stand hand-off position [50] forward of the well center position [30];

the top drive assembly [200] having a top drive vertically translatable along a first path over the well center and along a second path rearward of the first path;

a racking module [300] extending outward of the mast [10] above the set-back platform [900];

a stand hand-off position [50] located on the setback platform [900], and extending vertically upwards substantially between the mast [10] and the racking module [300]; and an upper stand constraint [420] connected beneath the racking module [300] and extendable rearward towards the mast [10].

A19. The drilling rig of embodiment A18, further comprising:

an intermediate stand constraint having a frame connected to the drilling rig at an edge of the V-door side of the drill floor;

a carriage connected to the frame in extendable relationship;

a carriage actuator connected between the frame and the carriage, and operable to extend or retract the carriage outward from the frame;

a tubular clasp attached to the extendable end of the carriage;

a clasp actuator connected to the tubular clasp, and operable to open or close the tubular clasp around a tubular stand;

a tubular gripper attached to the extendable end of the carriage; and a gripper actuator connected to the tubular gripper, and operable to open or close the tubular gripper around a tubular stand.

A20. A method for inserting tubulars in or removing tubulars from a drill string with the drilling rig [1] of any of embodiments A1-A17, comprising:

vertically translating the top drive assembly [200] along mast [10];

vertically translating the dolly of the tubular delivery arm [500] along the mast [10];

rotating and pivoting the arm member [532] at the upper end with respect to the dolly to move the clasp between the well center position [30] and the second position [50];

clasping a tubular stand with the tubular clasp; and unclasping the tubular stand to disengage the tubular clasp.

A21. The method of embodiment A20, further comprising:

retracting a top drive of the top drive assembly from the well center position to pass the tubular delivery arm when the clasp is in the well center position.

A22. The method of embodiment A20 or embodiment A21, further comprising:

retracting the clasp of the tubular delivery arm from the well center position to pass the top drive assembly when a top drive of the top drive assembly is in the well center position.

A23. The method of any of embodiments A20-A22, further comprising:

engaging a tubular stand at an upset with the tubular clasp.

A24. The method of embodiment A23, further comprising:

vertically translating the dolly of the tubular delivery arm to move the tubular clasp along the tubular stand below the upset.

A25. The method of embodiment A24, further comprising:

positioning the top drive over the tubular stand in the well center position;

clasping the tubular stand below the top drive with the tubular clasp; and engaging or disengaging the tubular stand and the top drive in the well center position.

A26. The method of embodiment A25, further comprising:

lowering the tubular stand in the well center position with the tubular delivery arm to stab a pin connection of a lower tool joint of the tubular stand into a box connection of the drill string;

continuing lowering of the tubular delivery arm to move the tubular clasp below the upset lower down on the tubular stand in the well center position;

moving the top drive over the tubular stand in the well center position;

engaging the top drive and the tubular stand in the well center position; and unclasping the tubular stand engaged with the top drive from the tubular clasp.

A27. The method of embodiment A25, further comprising:

clasping the tubular stand in the well center position with the tubular clasp below the top drive;

disengaging the top drive and the tubular stand in the well center position;

retracting the top drive from the well center position; and moving the tubular clasp up on the tubular stand in the well center position to engage the upset.

A28. The method of any of embodiments A20-A27, further comprising:

a first tubular handling function to transport the tubular stands in and out of a setback position on a setback platform;

a second tubular handling function to deliver the tubular stands to and from the well center position, wherein the second tubular handling function comprises:

the vertical translation of the top drive assembly [200] along the mast [10];

the vertical translation of the dolly of the tubular delivery arm [500] along the mast [10];

the rotation and pivoting of the arm member [532]; and the clasping and unclasping of the tubular stands with the tubular clasp;

setting down the tubular stands in a stand hand-off position at an intersection between the first and second functions; and exchanging the tubular stands between the first and second functions at the stand hand-off position.

A29. A method of moving tubular stands [80] from a racked position on a setback platform [900] and in a racking module [300] to a drill string [90] at the drill floor [6] of a drilling rig [1], comprising the steps of:

clasping a lower portion of a tubular stand [80] resting on the setback platform [900] with a lower racking arm [950];

hoisting the tubular stand [80] with an upper racking arm [350] on a racking module [300] connected to a mast [10] of the drilling rig [1];

moving the tubular stand [80] towards a stand hand-off position [50] with the upper racking arm [350];

moving the clasped lower end of the tubular stand [80] with the lower racking arm [950] along a path coincident to movement of the tubular stand [80] by the upper racking arm [350];

positioning the tubular stand [80] above a stand hand-off position [50] located on the setback platform [900];

lowering the tubular stand [80] to rest at the stand hand-off position [50];

engaging an upper portion of the tubular stand [80] with an upper stand constraint [420];

disengaging the upper racking arm [350] and the lower racking arm [950] from the tubular stand [80];

engaging the upper portion of the tubular stand [80] with a vertically translatable tubular delivery arm [500];

disengaging the tubular stand [80] from the upper stand constraint [420] and lower stand constraint [440];

engaging a lower portion of the tubular stand [80] with a lower stabilizing arm [800];

hoisting the stand [80] with the tubular delivery arm [500]; and stabbing the tubular stand [80] into a drill string end extending above a rotary table [810] on the drill floor [6].

A30. The method of embodiment A29, further comprising:

engaging a lower portion of the tubular stand with a lower stabilizing arm at the stand hand-off position.

A31. The method of embodiment A29 or embodiment A30, further comprising:

engaging a lower portion of the tubular stand with a lower stand constraint at the stand hand-off position.

A32. The method of any of embodiments A29-A31, further comprising:

engaging the tubular stand with a tubular connection torqueing device located above the drill floor;

disengaging the lower stabilizing arm from the tubular stand;

coupling the stand to the drill string in the rotary table;

lowering the position of engagement of the delivery arm on the stand;

engaging the upper portion of the stand with an elevator of a top drive;

disengaging the delivery arm from the stand;

hoisting the stand and connected drill string with the top drive assembly to release the drill string from its support at the drill floor; and lowering the stand and connected drill string into the wellbore with the top drive.

A33. The method of any of embodiments A29-A32, further comprising:

clasping the tubular stand with an upper stand constraint when the tubular stand is at the stand hand-off position; and unclasping the tubular stand from the upper stand constraint when the tubular stand has been clasped by the tubular delivery arm.

A34. A method of moving tubular stands [80] from a racked position to a drill string [90] at the drill floor [6] of a drilling rig [1], comprising the steps of:

transporting a tubular stand [80] from a racked position in a fingerboard assembly [310] to a stand hand-off position [50] with an upper racking arm [350] on a racking module [300] connected to a mast [10] of the drilling rig [1];

setting the tubular stand [80] down at the stand hand-off position [50];

transporting a tubular stand [80] from the stand hand-off position [50] to a well center position [30] with a tubular delivery arm [500] translatably connected to the drilling mast [10];

stabbing the tubular stand [80] into a stump of a drill string [90] at the well center [30];

connecting the tubular stand [80] to the drill string [90]; and lowering the drill string [90] with a top drive assembly [200] translatably connected to the drilling mast [10].

B1. A drilling rig, comprising:

first function tubular handling equipment to transport tubular stands [80] in and out of a setback position on a setback platform [900];

second function tubular handling equipment to deliver the tubular stands to and from a well center [30] over a well; and a stand hand-off position between the first and second function tubular handling equipment to set down tubular stands for exchange at an intersection between the first function tubular equipment and the second function tubular equipment.

B2. A drilling rig [1], comprising:

first function tubular handling equipment comprising an upper racking arm [350] over a racking module [300] and a setback platform [900], to transport tubular stands [80] in and out of a setback position on the setback platform;

second function tubular handling equipment comprising a tubular delivery arm [500] to deliver the tubular stands to and from a well center position [30] over a well; and a stand hand-off position [50] to set down tubular stands for exchange at an intersection between the first function tubular handling equipment and the second function tubular handling equipment.

B3. The drilling rig of embodiment B1 or embodiment B2, further comprising:

a mast; and a retractable top drive assembly [200] vertically translatable along the mast;

wherein the tubular delivery arm is vertically translatable along the mast and comprises a tubular clasp [550] movable between the well center position and the stand hand-off position;

wherein the tubular clasp is engageable with an upper end of a depending one of the tubular stands for the delivery of the tubular stands between the well center position and the stand hand-off position; and wherein the tubular clasp is slidably engageable with the tubular stand below the upper end to clasp an upper portion of the tubular stand in the well center position below the upper end.

B4. The drilling rig of any of embodiments B1-B3, wherein the stand hand-off position is located on the setback platform.

B5. The drilling rig of any of embodiments B1-B4, wherein the stand hand-off position extends vertically upwards substantially between a mast and a fingerboard assembly of the racking module.

B6. The drilling rig of any of embodiments B1-B5, wherein the setback platform is offset beneath a drill floor [6].

B7. The drilling rig of any of embodiments B1-B6, further comprising a mousehole having a mousehole center [40] in line between the well center and the stand hand-off position.

B8. The drilling rig of embodiment 7, further comprising a catwalk [60] in line with the stand hand-off position and the mousehole center.

B9. The drilling rig of any of embodiments B1-B8, further comprising a stand constraint [420,440] to secure one of the tubular stands in the stand hand-off position.

B10. The drilling rig of any of embodiment B9, wherein the stand constraint comprises an upper stand constraint [420] connected to the racking module and extendable to the stand hand-off position.

B11. The drilling rig of embodiment B9 or B10, wherein the stand constraint comprises a lower stand constraint [440] on the setback platform and centerable over the stand hand-off position.

B12. The drilling rig of any of embodiments B9-B11, wherein the stand constraint comprises:

an upper stand constraint [420] connected to the racking module and extendable to the stand hand-off position; and a lower stand constraint [440] on the setback platform and centerable over the stand hand-off position;

wherein the upper and lower stand constraints are engageable with respective upper and lower portions of the one tubular stand set down in the stand hand-off position to vertically orient the one tubular stand.

B13. The drilling rig of any of embodiments B9-B12, wherein the stand constraint comprises:

a frame;

a carriage connected to the frame in extendable relationship;

a carriage actuator connected between the frame and the carriage, and operable to extend or retract the carriage outward from the frame;

a clasp attached to an extendable end of the carriage; and a clasp actuator connected to the clasp, and operable to open or close the clasp around one of the tubular stands.

B14. The drilling rig of embodiment B13, wherein:

the tubular stand constraint is affixed to the racking module;

the racking module extends from a mast and comprises a plurality of columns of tubular racking locations, and a transfer row connecting the columns to the stand hand-off position;

the stand hand-off position intersects with the transfer row;

the carriage is extendable towards the mast to allow a center of the clasp to be centered over the stand hand-off position; and the carriage is retractable away from the mast to remove the clasp from intersection with the transfer row.

B15. The drilling rig of embodiment B13 or B14, wherein the frame has a platform located on the racking module centrally between the columns.

B16. The drilling rig of any of embodiments B13-B15, wherein the carriage is extendable towards the mast to position a center of the clasp beyond the center of the stand hand-off position.

B17. The drilling rig of any of embodiments B13-B16, wherein the carriage is extendable towards the mast to position one of the tubular stands within a horizontal range of a top drive unit translatable on the mast.

B18. The drilling rig of any of embodiments B9-B17, wherein:

the tubular stand constraint is affixed to the setback platform;

the setback platform is offset beneath a drill floor [6] and connected to a substructure of the drilling rig;

the setback platform comprises a surface for placing tubular stands, and an alleyway that is accessible to the surface;

the stand hand-off position is located on the alleyway;

the carriage is extendable towards the substructure to allow the clasp to be centered over the stand hand-off position; and the carriage is retractable away from the substructure to remove the clasp from intersection with the alleyway.

B19. The drilling rig of embodiment B18, wherein the carriage is extendable towards the mast to position the clasp beyond the center of the stand hand-off position.

B20. The drilling rig of embodiment B18, wherein the carriage is extendable towards the mast to position the clasp over a mousehole.

B21. The drilling rig of any of embodiments B9-B20, wherein the stand constraint further comprises:

a gripper assembly attached to an extendable end of the carriage;

a gripper assembly actuator connected to the gripper assembly, and operable to open or close the gripper assembly around a tubular stand;

wherein the tubular stand constraint is affixed to a center section of the drilling rig on a V-door side;

wherein the stand hand-off position is located on the setback platform;

wherein a mousehole is located between the well center and the stand hand-off position;

wherein the carriage is extendable to allow the stand constraint clasp and gripper assembly to be centered over the setback position; and wherein the carriage is retractable to allow the stand constraint clasp and gripper assembly to be centered over the mousehole.

B22. The drilling rig of embodiment B21, wherein the clasp is a gripping device that inhibits vertical movement of the gripped tubular.

B23. The drilling rig of any of embodiments B1-B22, further comprising:

a stand hand-off station located at the stand hand-off position;

the stand hand-off station comprising;

a chamber for receiving a pin connection of one of the tubular stands; and a stage inside the chamber receivable of the weight of the one tubular stand.

B24. The drilling rig of any of embodiments B1-B23, further comprising:

a stand hand-off station located at the stand hand-off position;

the stand hand-off station comprising:

a base connecting the stand hand-off station to the setback platform;

an expandable chamber assembly comprising an upper chamber and a lower chamber;

wherein the lower chamber is attached to the base;

wherein the upper chamber is positioned in concentric relationship to the lower chamber;

an actuator connected between the lower chamber and the upper chamber;

a stage located in the chamber assembly, the stage receivable of the lower end of one of the tubular stands; and an elastomeric seal over a top end of the upper chamber, the seal having an opening receivable of the one tubular stand.

B25. The drilling rig of any of embodiments B1-B24, wherein the tubular delivery arm comprises a tubular clasp [550] movable between the stand hand-off position and the well center position.

B26. The drilling rig of embodiment B25, wherein the tubular delivery arm comprises a dolly translatably connected to the mast.

B27. The drilling rig of embodiment B26, wherein the tubular delivery arm further comprises an arm member [532] having an upper end rotatably and pivotally connected to the dolly, and a lower end pivotally connected to the tubular clasp.

B28. The drilling rig of any of embodiments B25-B27, wherein the tubular clasp of the tubular delivery arm is movable to a mousehole position forward of the well center position.

B29. The drilling rig of any of embodiments B25-B28, wherein the tubular clasp of the tubular delivery arm is movable to a catwalk position forward of the stand hand-off position.

B30. The drilling rig of any of embodiments B25-B29, wherein the tubular clasp of the tubular delivery arm is engageable with an upper end or upset of a tubular stand [80], and slidably engageable with the tubular stand below the upper end or upset.

B31. The drilling rig of any of embodiments B25-B30, wherein the tubular delivery arm further comprises an arm bracket [520] extending outwardly from the dolly, and a drive plate [530] rotatably connected to the arm bracket, the upper end of the arm member pivotally connected to the drive plate.

B32. The drilling rig of embodiment B31, further comprising a tilt actuator [540] pivotally connected between the drive plate and the arm member.

B33. The drilling rig of embodiment B31 or embodiment B32, further comprising an incline actuator [552] pivotally connected between the arm and the clasp.

B34. The drilling rig of any of embodiments B25-B33, wherein the tubular delivery arm further comprises an arm bracket [520] extending outwardly from the dolly, a drive plate [530] rotatably connected to the arm bracket, and a rotary actuator [522] connected to the drive plate, the upper end of the arm member pivotally connected to the drive plate.

B35. The drilling rig of any of embodiments B25-B34, further comprising a top drive assembly [200], wherein the top drive assembly and the tubular delivery arm are vertically translatable along a mast [10].

B36. The drilling rig of embodiment B35, wherein the tubular delivery arm and the top drive assembly have non-conflicting vertical paths along the mast.

B37. The drilling rig of embodiment B35 or embodiment B36, wherein the top drive assembly has a top drive [240] vertically translatable along a first path over the well center and along a second path rearward to a drawworks side of well center.

B38. The drilling rig of any of embodiments B35-B37, wherein the top drive assembly has a top drive [240] horizontally movable between the well center position and a retracted position rearward to a drawworks side of the well center position.

B39. The drilling rig of any of embodiments B35-B38, wherein the top drive assembly comprises:

a dolly [202] translatably connected to the mast;

a travelling block assembly [230,232];

a top drive [240] suspended from the travelling block assembly;

a yoke [210,212] pivotally connecting the travelling block to the dolly;

an extendable actuator [220] connected between the dolly and the yoke;

a torque tube [260] rigidly connected to the travelling block;

the torque tube connected to the top drive in vertically slidable relation;

wherein extension of the actuator pivots the yoke to extend the travelling block and top drive away from the dolly to well center position; and wherein retraction of the actuator pivots the yoke to retract the travelling block towards the dolly to a position away from the well center.

B40. The drilling rig of embodiment B39, wherein torque reactions of a drill string responding to rotation by the top drive are transferred from the top drive to the torque tube, from the torque tube to the travelling block, from the travelling block to the dolly, and from the dolly to the mast.

B41. The drilling rig of any of embodiments B25-B40, further comprising a leg [20], a lower stabilizing arm [800] pivotally and rotatably connected to the leg, and a tubular guide [870] connected to the lower stabilizing arm and movable between the stand hand-off position and the well center position.

B42. The drilling rig of any of embodiments B1-B42, further comprising an upper racking arm [350] comprising a gripper [382] movable over a fingerboard assembly [310] and the stand hand-off position.

B43. The drilling rig of embodiment B42, wherein the upper racking arm comprises:

a bridge [358] connected to a frame [302] in translatable relation;

a racking arm [370] connected to the bridge in rotatable and translatable relation; and the gripper connected to the arm in vertically translatable relation.

B44. The drilling rig of embodiment B42 or embodiment B43, wherein the racking module is connected to a mast [10], and the racking module further comprises:

a frame [302];

wherein the fingerboard assembly is connected to the frame and has columns receivable of tubular stands, optionally with the columns oriented in a direction towards the mast;

a fingerboard alleyway [316] connecting the columns on a mast side of the columns.

B45. The drilling rig of embodiment B44, further comprising:

wherein the setback platform is positioned beneath the fingerboard assembly;

a platform alleyway [912] beneath the fingerboard alleyway; and a lower racking arm [950] positioned in the platform alleyway.

B46. The drilling rig of Embodiment B45, wherein the lower racking arm further comprises:

a lower racking base [952] connected to the platform alleyway in translatable relation;

a lower racking frame [972] connected to the base in rotatable and pivotal relation;

a lower racking arm member [980] pivotally connected to the frame; and a lower racking clasp [990] pivotally connected to the arm.

B47. A drilling rig [1], comprising:

a substructure [2] comprising a pair of base boxes;

a drill floor [6] above the substructure [2];

a setback platform [900] below and forward of the drill floor [6];

a mast [10] extending vertically above the drill floor [6];

a top drive assembly [200] vertically translatable along the mast [10];

a tubular delivery arm [500] vertically translatable along the mast [10];

the tubular delivery arm [500] having a tubular clasp [550] movable between a well center position [30] over a well center and a stand hand-off position [50] forward of the well center position [30];

the top drive assembly [200] being vertically translatable along a first path over the well center and along a second path rearward of the first path;

a racking module [300] extending outward of the mast [10] above the set-back platform [900];

a stand hand-off position [50] located on the setback platform [900], and extending vertically upwards substantially between the mast [10] and a fingerboard assembly [310] of the racking module [300]; and an upper stand constraint [420] connected beneath the racking module [300] and extendable rearward towards the mast [10].

B48. The drilling rig of embodiment B47, further comprising:

an intermediate stand constraint having a frame connected to the drilling rig at an edge of the V-door side of the drill floor;

a carriage connected to the frame in extendable relationship;

a carriage actuator connected between the frame and the carriage, and operable to extend or retract the carriage outward from the frame;

a tubular clasp attached to the extendable end of the carriage;

a clasp actuator connected to the tubular clasp, and operable to open or close the tubular clasp around a tubular stand;

a tubular gripper attached to the extendable end of the carriage; and a gripper actuator connected to the tubular gripper, and operable to open or close the tubular gripper around a tubular stand.

B49. A method to insert tubulars in or remove tubulars from a drill string with the drilling rig of any of embodiments B1-B48, comprising:

transporting the tubular stands between the setback position and the stand hand-off position;

setting the tubular stands down in the stand hand-off position;

clasping a tubular stand with a tubular clasp [550] connected to the tubular delivery arm;

vertically translating the tubular delivery arm along a mast [10];

moving the tubular clasp between the stand hand-off position and the well center position; and unclasping the tubular stand to disengage the tubular clasp.

B50. A method to insert tubulars in or remove tubulars from a drill string in a well below a drill floor of a drilling rig, comprising:

using first tubular handling equipment to transport tubular stands in and out of a setback position on a setback platform;

using second tubular handling equipment to deliver the tubular stands to and from a well center position over the well;

setting down the tubular stands in a stand hand-off position at an intersection between the first and second tubular handling equipment; and exchanging the tubular stands between the first and second functions at the stand hand-off position.

B51. A method to insert tubulars in or remove tubulars from a drill string in a well below a drill floor of a drilling rig, comprising:

a first tubular handling function comprising guiding upper portions of the tubular stands to transport the tubular stands in or out of a setback position on a setback platform;

a second tubular handling function comprising guiding the upper portions of the tubular stands to deliver the tubular stands to or from a well center position over the well;

setting down the tubular stands in a stand hand-off position located at an intersection between the first and second functions; and exchanging the tubular stands between the first and second tubular handling functions at the stand hand-off position.

B52. The method of embodiment B50 or embodiment B51, further comprising:

clasping the upper portion below an upper end of one of the tubular stands in the well center position; and engaging or disengaging a top drive assembly [200] with the upper portion of the one tubular stand constrained in the well center position.

B53. The method of any of embodiments B50-B52, further comprising:

vertically translating a top drive assembly along a mast [10]; clasping the one tubular stand at an upper end with a tubular clasp connected to a tubular delivery arm [500];

vertically translating the tubular delivery arm along the mast;

moving the clasp between the well center position and the stand hand-off position; sliding the clasp along the tubular stand in the stand hand-off position below the upper end; and unclasping the tubular stand to disengage the tubular clasp.

B54. The method of any of embodiments B50-B53, further comprising locating the stand hand-off position on the setback platform.

B55. The method of embodiment B54, wherein the stand hand-off position extends vertically upwards substantially between a mast and a fingerboard assembly [310] of the racking module.

B56. The method of embodiment B54 or embodiment B55, further comprising offsetting the setback platform beneath a drill floor [6].

B57. The method of any of embodiments B50-B56, further comprising positioning a mousehole in line between the well center and the stand hand-off position.

B58. The method of embodiment B57, further comprising positioning a catwalk [60] in line with the stand hand-off position and the mousehole.

B59. The method of any of embodiments B50-B58, further comprising securing one of the tubular stands in the stand hand-off position with a stand constraint [420,440].

B60. The method of embodiment B59, further comprising connecting the stand constraint [420] to the racking module, and extending the stand constraint to the stand hand-off position.

B61. The method of embodiment B59 or embodiment B60, further comprising positioning the stand constraint [440] on the setback platform, and centering the stand constraint over the stand hand-off position.

B62. The method of any of embodiments B59-B61, further comprising:

connecting an upper one of the stand constraint [420] to the racking module;

extending the upper stand constraint to the stand hand-off position;

connecting a lower one of the stand constraint [440] on the setback platform;

centering the lower stand constraint over the stand hand-off position;

engaging the upper and lower stand constraints with respective upper and lower portions of one of the tubular stands set down in the stand hand-off position to vertically orient the one tubular stand.

B63. The method of any of embodiments B59-B62, further comprising:

wherein the stand constraint comprises a frame;

connecting a carriage to the frame in extendable relationship;

connecting a carriage actuator between the frame and the carriage;

operating the carriage actuator to extend or retract the carriage outward from the frame;

attaching a clasp to the extendable end of the carriage; and connecting a clasp actuator to the clasp; and operating the clasp actuator to open or close the clasp around one of the tubular stands.

B64. The method of embodiment B63, further comprising:

affixing the tubular stand constraint to the racking module;

wherein the racking module comprises a plurality of columns of tubular racking locations, and a transfer row connecting the columns;

connecting the racking module to a mast to extend outwardly from the mast;

locating the stand hand-off position to project vertically to intersect with the transfer row;

extending the carriage towards the mast to center the clasp over the stand hand-off position; and retracting the carriage away from the mast to remove the clasp from the intersection with the transfer row.

B65. The method of embodiment B64, further comprising locating a platform of the stand constraint frame on the racking module centrally between the columns.

B66. The method of embodiment B64 or embodiment B65, further comprising extending the carriage towards the mast to position a center of the clasp beyond the center of the stand hand-off position.

B67. The method of embodiment B66, connecting a top drive unit operating on the mast to a tubular stand positioned by the extended carriage.

B68. The method of any of embodiments B59-B67, further comprising:

affixing the tubular stand constraint to the setback platform;

offsetting the setback platform beneath a drill floor [6] and connecting the setback platform to a substructure of the drilling rig;

setting down tubular stands on a surface of the setback platform;

locating an alleyway on the setback platform that is accessible to the surface;

locating the stand hand-off position on the alleyway;

extending the carriage towards the substructure to center the clasp over the stand hand-off position; and retracting the carriage away from the substructure to remove the clasp from intersection with the alleyway.

B69. The method of embodiment B68, further comprising extending the carriage towards the mast to position the clasp beyond the center of the stand hand-off position.

B70. The method of embodiment B68, further comprising extending the carriage towards the mast to position the clasp over a mousehole.

B71. The method of any of embodiments B59-B60, further comprising:

attaching a gripper assembly to the extendable end of the carriage;

connecting a gripper assembly actuator to the gripper assembly;

operating the gripper assembly actuator to open or close the gripper assembly around a tubular stand;

affixing the tubular stand constraint to a center section of the drilling rig on a V-door side;

locating the stand hand-off position on the setback platform;

locating a mousehole between the well center and the stand hand-off position;

extending the carriage to center the stand constraint clasp and gripper assembly over the setback position; and retracting the carriage to center the stand constraint clasp and gripper assembly over the mousehole.

B72. The method of embodiment B71, further comprising gripping a tubular with the constraint clasp to inhibit vertical movement of the gripped tubular.

B73. The method of any of embodiments B50-B72, further comprising:

locating a stand hand-off station at the stand hand-off position;

receiving a pin connection of a tubular stand in a chamber of the stand hand-off station; and receiving the weight of the tubular stand on a stage inside the chamber.

B74. The method of any of embodiments B50-B73, further comprising:

locating a stand hand-off station at the stand hand-off position;

connecting a base of the stand hand-off station to the setback platform;

attaching a lower chamber of an expandable chamber assembly to the base;

positioning an upper chamber of the expandable chamber assembly in concentric relationship to the lower chamber;

connecting an actuator between the lower chamber and the upper chamber;

receiving a lower end of a tubular stand through an opening in an elastomeric seal over a top end of the upper chamber; and receiving the lower end of the tubular on a stage in the chamber assembly.

B75. The method of any of embodiments B50-B74, wherein guiding the upper portion of one of the tubular stands for delivery to or from the well center position comprises clasping an upper end of the one tubular stand with a tubular clasp [550] of a tubular delivery arm, and moving the tubular clasp between the stand hand-off position and the well center position.

B76. The method of embodiment B75, further comprising translating the tubular delivery arm along a mast of the drilling rig to raise or lower the tubular clasp.

B77. The method of embodiment B75 or embodiment B76, further comprising translatably connecting a dolly of the tubular delivery arm to the mast.

B78. The method of any of embodiments B75-B77, further comprising rotating and pivoting an upper end of an arm member [532] connected to the dolly, and pivotally connecting a lower end of the arm member to the tubular clasp.

B79. The method of any of embodiments B75-B78, further comprising moving the tubular clasp to a mousehole position forward of the well center position.

B80. The method of any of embodiments B75-B79, further comprising moving the tubular clasp to a catwalk position forward of the stand hand-off position.

B81. The method of any of embodiments B75-B80, further comprising engaging the tubular clasp and an upper end of the one tubular stand, and sliding the tubular clasp along the one tubular stand below the upper end.

B82. The method of any of embodiments B75-B81, further comprising engaging the tubular clasp and an upset at an upper end of the one tubular stand, and sliding the tubular clasp along the one tubular stand below the upset.

B83. The method of any of embodiments B75-B82, further comprising extending an arm bracket [520] outwardly from a dolly of the tubular delivery arm, rotatably connecting a drive plate [530] to the arm bracket, and pivotally connecting an upper end of the arm member to the drive plate.

B84. The method of embodiment B83, further comprising operating a tilt actuator [540] pivotally connected between the drive plate and the arm member to pivot the arm member.

B85. The method of embodiment B83 or embodiment B84, further comprising operating an incline actuator pivotally connected between the arm and the tubular clasp to pivot the tubular clasp.

B86. The method of any of embodiments B75-B85, further comprising extending an arm bracket [520] outwardly from a dolly of the tubular delivery arm, rotatably connecting a drive plate [530] to the arm bracket, connecting a rotary actuator [522] to the drive plate, and pivotally connecting an upper end of the arm member to the drive plate.

B87. The method of any of embodiments B75-B86, further comprising vertically translating a top drive assembly along a mast [10], and vertically translating the tubular delivery arm along the mast.

B88. The method of embodiment B87, comprising vertically translating a top drive of the top drive assembly along a first path over the well center and along a second path rearward to a drawworks side of well center.

B89. The method of embodiment B88, further comprising horizontally moving the top drive between the well center position and a retracted position rearward to a drawworks side of the well center position.

B90. The method of any of embodiments B87-B89, further comprising:

translatably connecting a dolly of the top drive assembly to the mast;

suspending a top drive from a travelling block assembly of the top drive assembly;

pivotally connecting the travelling block to the dolly with a yoke;

connecting an extendable actuator between the dolly and the yoke;

rigidly connecting a torque tube to the travelling block;

connecting the torque tube to the top drive in vertically slidable relation;

extending the actuator to pivot the yoke to extend the travelling block and top drive away from the dolly to the well center position; and retracting the actuator to pivot the yoke to retract the travelling block towards the dolly to a position away from the well center.

B91. The method of embodiment B90, further comprising transferring torque reactions of a drill string responding to rotation by the top drive from the top drive to the torque tube, from the torque tube to the travelling block, from the travelling block to the dolly, and from the dolly to the mast.

B92. The method of any of embodiments B75-B91, further comprising pivotally and rotatably connecting a lower stabilizing arm [800] to a leg [20] of the drilling rig, connecting a tubular guide [870] to the lower stabilizing arm, and moving the tubular guide between the stand hand-off position and the well center position.

B93. The method of any of embodiments B50-B92, further comprising moving a gripper of an upper racking arm over a fingerboard assembly [310] and the stand hand-off position.

B94. The method of embodiment B93, further comprising:

connecting a bridge of the upper racking arm to a frame in translatable relation;

translating the bridge along the frame;

connecting an arm to the bridge in rotatable and translatable relation;

translating the arm along the bridge;

connecting the gripper connected to the arm in vertically translatable relation; and vertically translating the gripper.

B95. The method of embodiment B93, further comprising:

connecting the racking module to a mast, wherein the racking module comprises a frame;

connecting a fingerboard assembly [310] to the frame, wherein the fingerboard has columns receivable of tubular stands;

optionally orienting the columns in a direction towards the mast;

connecting the columns to a fingerboard alleyway on a mast side of the columns.

B96. The method of embodiment B95, further comprising:

positioning the setback platform beneath the fingerboard assembly;

locating a platform alleyway [312] beneath the fingerboard alleyway; and positioning a lower racking arm in the platform alleyway.

B97. The method of any of embodiments B50-B96, further comprising:

connecting or disconnecting the tubular stands and a drill string;

engaging or disengaging the tubular stands and a top drive assembly [200]; and lowering or hoisting the tubular stands connected to the drill string with the top drive assembly.

B98. A method to insert tubulars in or remove tubulars from a drill string [90] in a well below a drill rig, [1] comprising:

moving tubular stands [80] between a racked position in a fingerboard assembly [310] and a set down position in a stand hand-off position [50] located between the fingerboard assembly and a drilling mast [10];

retrieving and delivering the tubular stands between the stand hand-off position and a well center position [30] over a center of a well;

connecting or disconnecting the tubular stands and a drill string;

engaging or disengaging the tubular stands and a top drive assembly [200]; and lowering or hoisting the tubular stands connected to the drill string with the top drive assembly.

B99. The method of embodiment B98, further comprising locating a mousehole [40] in line between the stand hand-off position and the well center.

B100. The method of embodiment B98 or embodiment B99, further comprising securing and releasing the tubular stands set down in the stand hand-off position.

B101. The method of embodiment B100, wherein securing the tubular stands in the stand hand-off position comprises constraining upper and lower portions of one of the tubular stands to secure the one tubular stand in vertical orientation.

B102. The method of any of embodiments B98-B101, further comprising setting down the tubular stands in the stand hand-off and racked positions on a set-back platform [900].

B103. The method of embodiment B102, comprising offsetting the set-back platform with respect to a drill floor [6] of the drill rig, and positioning the set-back platform beneath a level of the drill floor.

B104. The method of any of embodiments B98-B103, wherein the movement of the tubular stands between the racked position and the stand hand-off position comprises guiding upper portions of the tubular stands through columns of the fingerboard assembly optionally oriented toward the mast and through a transverse alleyway on a mast side of the fingerboard assembly connecting the columns to the stand hand-off position.

B105. The method of embodiment B104, further comprising guiding lower portions of the tubular stands along a path coincident with the movement of upper portions of the tubular stands between the fingerboard assembly and the stand hand-off position.

B106. The method of any of embodiments B98-B105, wherein the movement of the tubular stands between the stand hand-off position and the well center position comprises guiding upper portions of the tubular stands between the stand hand-off position and the well center position.

B107. The method of embodiment B106, further comprising guiding lower portions of the tubular stands along a path coincident with the movement of upper portions of the tubular stands between the stand hand-off position and the well center position.

B108. The method of any of embodiments B98-B107, further comprising:

operating an upper racking arm [350] to guide upper portions of the tubular stands between the fingerboard assembly and the stand hand-off position;

operating a tubular delivery arm [500] independently of the upper racking arm to guide the upper portions of the tubular stands between the stand hand-off position and the well center position; and using the stand hand-off position as a designated set down position to hand off the upper portions of the tubular stands between the upper racking arm and the tubular delivery arm.

B109. The method of embodiment B108, further comprising:

clasping an upper portion of one of the tubular stands with the tubular delivery arm below the top drive assembly in the well center position; and engaging or disengaging the constrained upper portion of the one tubular stand and the top drive assembly in the well center position. B110. The method of embodiment B108 or embodiment B109, further comprising:

connecting or disconnecting a lower portion of one of the tubular stands and the drill string engaged in a rotary table [810];

disengaging the drill string and the rotary table for the hoisting or lowering of the drill string with the top drive assembly; and retracting one of the tubular delivery arm and the top drive assembly from the well center position to vertically translate the tubular delivery arm and the top drive assembly along the mast in non-conflicting paths.

B111. The method of embodiment B110, wherein the top drive assembly comprises a retractable dolly [202], and further comprising translatably connecting the top drive dolly to the mast.

B112. The method of any of embodiments B108-B111, wherein the movement of the tubular stands between the fingerboard assembly [310] and the stand hand-off position comprises engaging the upper racking arm [350] with an upper portion of one of the tubular stands, hoisting the one tubular stand, moving the upper racking arm over the fingerboard assembly, setting down the one tubular stand, and disengaging the upper racking arm.

B113. The method of embodiment B112, further comprising moving the upper racking arm free of the one tubular stand into position for the engagement of a next one of the tubular stands.

B114. The method of embodiment B112 or embodiment B113, wherein the upper racking arm comprises a bridge, a racking arm, and a gripper, and further comprising:

translatably connecting the bridge to a frame over the fingerboard assembly, and translatably and rotatably connecting the racking arm to the bridge, to guide the upper racking arm over the finger board assembly; and connecting the gripper to the racking arm in vertically translatable relation for the engagement, hoisting and setting down of the tubular stands.

B115. The method of any of embodiments B98-B116, wherein the retrieval and delivery of the tubular stands between the stand hand-off position and the well center position comprises extending, retracting, and rotating tubular delivery arm [500] with respect to a vertical axis.

B116. The method of embodiment B115, further comprising returning the tubular delivery arm free of the delivered tubular stand into position for the retrieval of a next one of the tubular stands.

B117. The method of any of embodiments B108-B116, wherein the tubular delivery arm comprises a dolly [510], and further comprising translatably connecting the dolly of the tubular delivery arm to the mast.

B118. The method of embodiment B117, wherein the tubular delivery arm comprises an arm member [532], and further comprising rotatably and pivotally connecting an upper end of the arm member to the dolly.

B119. The method of any of embodiments B98-B118, further comprising engaging and disengaging an upper portion of one of the tubular stands and a clasp [550] on a free end of the tubular delivery arm.

B120. The method of any of embodiments B98-B119, further comprising using a lower stabilizing arm to guide lower portions of the tubular stands between the stand hand-off position and the well center position.

B121. The method of any of embodiments B98-B120 to insert tubulars in the drill string, comprising:

(a) moving an upper racking arm over one of the tubular stands racked in the fingerboard assembly;

(b) engaging and hoisting an upper portion of the one tubular stand with the upper racking arm;

(c) moving the upper racking arm over the fingerboard assembly to position the one tubular stand in the stand hand-off position;

(d) setting down the one tubular stand in the stand hand-off position;

(e) securing the one tubular stand in the stand hand-off position;

(f) disengaging and moving the upper racking arm over the fingerboard assembly away from the stand hand-off position; and (g) repeating (a) to (f) for a next one of the tubular stands.

B122. The method of any of embodiments B98-B121 to insert tubulars in the drill string, further comprising:

(1) engaging a clasp [550] of an extended tubular delivery arm [500] with an upper end of one of the tubular stands secured in the stand hand-off position;

(2) releasing the one tubular secured in the stand hand-off position;

(3) translating the tubular delivery arm along the mast to hoist the one tubular stand;

(4) retracting the tubular delivery arm to move the one tubular stand away from the stand hand-off position;

(5) rotating the tubular delivery arm to face the well center position;

(6) extending the tubular delivery arm to move the one tubular stand into the well center position;

(7) connecting the one tubular stand to the drill string engaged in a rotary table [810];

(8) releasing the one tubular stand from the clasp and retracting, rotating, extending, and translating the tubular delivery arm along the mast to return the clasp to the upper portion of a next one of the tubular stands secured in the stand hand-off position; and (9) repeating (1) to (8) for the next one tubular stand.

B123. The method of embodiment B122, further comprising:

(10) after the connection in (7), translating the tubular delivery arm downward along the mast to slide down the clasp engaging the upper portion of the one tubular stand;

(11) translating retracted top drive [810] along the mast past the tubular delivery arm to the upper portion of the one tubular stand above the clasp;

(12) engaging the top drive and the upper portion of the one tubular stand while clasping the upper portion of the one tubular stand with the clasp below the top drive assembly;

(13) disengaging the rotary table and translating the top drive assembly along the mast to lower the one tubular stand and drill string into the well;

(14) engaging the rotary table and disengaging the top drive assembly from the one tubular stand;

(15) retracting the top drive assembly from the well center position; and

(16) repeating (10) to (15) for the next one tubular stand.

B124. The method of any of embodiments B98-B120 to remove tubulars from the drill string, comprising:

(1) engaging a clasp [550] of an extended tubular delivery arm [500] with an upper portion of one of the tubular stands connected to the drill string engaged in a rotary table [810];

(2) disconnecting the one tubular stand from the drill string;

(3) retracting the tubular delivery arm to move the one tubular stand away from the well center position;

(4) translating the tubular delivery arm along the mast to lower the one tubular stand;

(5) rotating the tubular delivery arm to face the stand hand-off position;

(6) extending the tubular delivery arm to move the one tubular stand into the stand hand-off position;

(7) securing the one tubular stand in the stand hand-off position;

(8) releasing the one tubular stand from the tubular clasp and retracting, rotating, extending, and translating the tubular delivery arm along the mast to return the clasp to the upper portion of a next one of the tubular stands connected to the drill string engaged in the rotary table; and (9) repeating (1) to (8) for the next one tubular stand.

B125. The method of embodiment B125, further comprising:

(10) engaging the top drive assembly and the upper portion of the one tubular stand while engaging the one tubular stand connected to the drill string in the rotary table;

(11) disengaging the rotary table and translating the top drive assembly along the mast to hoist the one tubular stand and connected drill string above the rotary table;

(12) engaging the drill string in the rotary table below the lower portion of the one tubular stand;

(13) while clasping the upper portion of the one tubular stand with the clasp of the tubular delivery arm below the top drive assembly, disengaging the top drive assembly from the one tubular stand;

(14) translating the tubular delivery arm along the mast to raise the clasp at the upper portion of the one tubular stand in the well center position for the engagement in (1);

(15) retracting and translating the top drive assembly along the mast past the tubular delivery arm; and

(16) repeating (10) to (15) for the next one tubular stand.

B126. The method of any of embodiments B98-B120, B124, or B125 to remove tubulars from the drill string, comprising:

(a) moving an upper racking arm over one of the tubular stands secured in the stand hand-off position;

(b) engaging and hoisting an upper portion of the one tubular stand with the upper racking arm;

(c) releasing the one tubular stand from the stand hand-off position;

(d) moving the upper racking arm over the fingerboard assembly to position the one tubular stand in a racked position;

(e) setting down the one tubular stand in the rack position;

(f) disengaging and moving the upper racking arm over the fingerboard assembly away from the one tubular stand racked in the fingerboard assembly; and (g) repeating (a) to (f) for a next one of the tubular stands.

B127. A drilling rig [1], comprising:

a retractable top drive assembly vertically translatable along a mast;

a tubular delivery arm vertically translatable along the mast and comprising a tubular clasp [550] movable between a well center position over a well center and a position forward of the well center;

wherein the tubular clasp is engageable with an upper end of a tubular stand [80]; and wherein the tubular clasp is slidably engageable with the tubular stand below the upper end to clasp an upper portion of the tubular stand in the well center position below the upper end.

B128. A method for inserting tubulars in or removing tubulars from a drill string, comprising:

engaging a tubular clasp of a tubular delivery arm and an upper end of a tubular stand [80];

moving the tubular clasp between a well center position over a well center and a position forward of the well center;

clasping an upper portion of the tubular stand in the well center position with the clasp below the upper end; and engaging or disengaging a top drive and the constrained upper end of the tubular stand in the well center position.

B129. The drilling rig of any of embodiments B2-B49 or B127, or the method of any of embodiments B49 or B53-B126, wherein the tubular delivery arm comprises an electric or hydraulically powered crown winch [501].

If used herein, the term "substantially" is intended for construction as meaning "more so than not." If used herein the term "and/or" is inclusive, e.g., an item comprising component A and/or component B, may comprise A alone, B alone, or A and B together.

Having thus described the disclosed embodiments by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the disclosed embodiments may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the disclosed embodiments.

The invention claimed is:

1. A drilling rig, comprising:

first function tubular handling equipment to transport tubular stands in and out of a setback position on a setback platform;

second function tubular handling equipment to deliver the tubular stands to and from a well center over a well; and a stand hand-off position between the first and second function tubular handling equipment to set down tubular stands for exchange at an intersection between the first function tubular equipment and the second function tubular equipment.

2. A drilling rig, comprising:

first function tubular handling equipment comprising an upper racking arm over a racking module and a setback platform, to transport tubular stands in and out of a setback position on the setback platform;

second function tubular handling equipment comprising a tubular delivery arm to deliver the tubular stands to and from a well center position over a well; and a stand hand-off position to set down tubular stands for exchange at an intersection between the first function tubular handling equipment and the second function tubular handling equipment.

3. The drilling rig of claim 2, further comprising:

a mast; and a retractable top drive assembly vertically translatable along the mast;

wherein the tubular delivery arm is vertically translatable along the mast and comprises a tubular clasp movable between the well center position and the stand hand-off position;

wherein the tubular clasp is engageable with an upper end of a depending one of the tubular stands for the delivery of the tubular stands between the well center position and the stand hand-off position; and wherein the tubular clasp is slidably engageable with the tubular stand below the upper end to clasp an upper portion of the tubular stand in the well center position below the upper end.

4. The drilling rig of claim 2, wherein the stand hand-off position is located on the setback platform.

5. The drilling rig of claim 4, wherein the stand hand-off position extends vertically upwards substantially between a mast and a fingerboard assembly of the racking module.

6. The drilling rig of claim 4, wherein the setback platform is offset beneath a drill floor.

7. The drilling rig of claim 2, further comprising a mousehole having a mousehole center in line between the well center and the stand hand-off position.

8. The drilling rig of claim 7, further comprising a catwalk in line with the stand hand-off position and the mousehole center.

9. The drilling rig of claim 2, further comprising a stand constraint to secure one of the tubular stands in the stand hand-off position.

10. The drilling rig of claim 9, wherein the stand constraint comprises an upper stand constraint connected to the racking module and extendable to the stand hand-off position.

11. The drilling rig of claim 9, wherein the stand constraint comprises a lower stand constraint on the setback platform and centerable over the stand hand-off position.

12. The drilling rig of claim 9, wherein the stand constraint comprises:

an upper stand constraint connected to the racking module and extendable to the stand hand-off position; and a lower stand constraint on the setback platform and centerable over the stand hand-off position;

wherein the upper and lower stand constraints are engageable with respective upper and lower portions of the one tubular stand set down in the stand hand-off position to vertically orient the one tubular stand.

13. The drilling rig of claim 9, wherein the stand constraint comprises:

a frame;

a carriage connected to the frame in extendable relationship;

a carriage actuator connected between the frame and the carriage, and operable to extend or retract the carriage outward from the frame;

a clasp attached to an extendable end of the carriage; and a clasp actuator connected to the clasp, and operable to open or close the clasp around one of the tubular stands.

14. The drilling rig of claim 13, wherein:

the tubular stand constraint is affixed to the racking module;

the racking module extends from a mast and comprises a plurality of columns of tubular racking locations, and a transfer row connecting the columns to the stand hand-off position;

the stand hand-off position intersects with the transfer row;

the carriage is extendable towards the mast to allow a center of the clasp to be centered over the stand hand-off position; and the carriage is retractable away from the mast to remove the clasp from intersection with the transfer row.

15. The drilling rig of claim 14, wherein the frame has a platform located on the racking module centrally between the columns.

16. The drilling rig of claim 14, wherein the carriage is extendable towards the mast to position a center of the clasp beyond the center of the stand hand-off position.

17. The drilling rig of claim 14, wherein the carriage is extendable towards the mast to position one of the tubular stands within a horizontal range of a top drive unit translatable on the mast.

18. The drilling rig of claim 9, wherein:

the tubular stand constraint is affixed to the setback platform;

the setback platform is offset beneath a drill floor and connected to a substructure of the drilling rig;

the setback platform comprises a surface for placing tubular stands, and an alleyway that is accessible to the surface;

the stand hand-off position is located on the alleyway;

a carriage is extendable towards the substructure to allow a clasp to be centered over the stand hand-off position; and the carriage is retractable away from the substructure to remove the clasp from intersection with the alleyway.

19. The drilling rig of claim 18, wherein the carriage is extendable towards the mast to position the clasp beyond the center of the stand hand-off position.

20. The drilling rig of claim 18, wherein the carriage is extendable towards the mast to position the clasp over a mousehole.

21. The drilling rig of claim 9, wherein the stand constraint further comprises:

a gripper assembly attached to an extendable end of the carriage;

a gripper assembly actuator connected to the gripper assembly, and operable to open or close the gripper assembly around a tubular stand;

wherein the tubular stand constraint is affixed to a center section of the drilling rig on a V-door side;

wherein the stand hand-off position is located on the setback platform;

wherein a mousehole is located between the well center and the stand hand-off position;

wherein a carriage is extendable to allow a stand constraint clasp and gripper assembly to be centered over the setback position; and wherein the carriage is retractable to allow the stand constraint clasp and gripper assembly to be centered over the mousehole.

22. The drilling rig of claim 21, wherein the clasp is a gripping device that inhibits vertical movement of the gripped tubular.

23. The drilling rig of claim 2, further comprising:

a stand hand-off station located at the stand hand-off position;

the stand hand-off station comprising;

a chamber for receiving a pin connection of one of the tubular stands; and a stage inside the chamber receivable of the weight of the one tubular stand.

24. The drilling rig of claim 2, further comprising:

a stand hand-off station located at the stand hand-off position;

the stand hand-off station comprising:

a base connecting the stand hand-off station to the setback platform;

an expandable chamber assembly comprising an upper chamber and a lower chamber;

wherein the lower chamber is attached to the base;

wherein the upper chamber is positioned in concentric relationship to the lower chamber;

an actuator connected between the lower chamber and the upper chamber;

a stage located in the chamber assembly, the stage receivable of the lower end of one of the tubular stands; and an elastomeric seal over a top end of the upper chamber, the seal having an opening receivable of the one tubular stand.

25. The drilling rig of claim 2, wherein the tubular delivery arm comprises a tubular clasp movable between the stand hand-off position and the well center position.

26. The drilling rig of claim 25, wherein the tubular delivery arm comprises a dolly translatably connected to the mast.

27. The drilling rig of claim 26, wherein the tubular delivery arm further comprises an arm member having an upper end rotatably and pivotally connected to the dolly, and a lower end pivotally connected to the tubular clasp.

28. The drilling rig of claim 25, wherein the tubular clasp of the tubular delivery arm is movable to a mousehole position forward of the well center position.

29. The drilling rig of claim 25, wherein the tubular clasp of the tubular delivery arm is movable to a catwalk position forward of the stand hand-off position.

30. The drilling rig of claim 25, wherein the tubular clasp of the tubular delivery arm is engageable with an upset of a tubular stand, and slidably engageable with the tubular stand below the upset.

31. The drilling rig of claim 25, wherein the tubular delivery arm further comprises an arm bracket extending outwardly from the dolly, and a drive plate rotatably connected to the arm bracket, an upper end of the arm member pivotally connected to the drive plate.

32. The drilling rig of claim 31, further comprising a tilt actuator pivotally connected between the drive plate and the arm member.

33. The drilling rig of claim 31, further comprising an incline actuator pivotally connected between the arm and the clasp.

34. The drilling rig of claim 25, wherein the tubular delivery arm further comprises an arm bracket extending outwardly from the dolly, a drive plate rotatably connected to the arm bracket, and a rotary actuator connected to the drive plate, the upper end of an arm member pivotally connected to the drive plate.

35. The drilling rig of claim 25, further comprising a top drive assembly, wherein the top drive assembly and the tubular delivery arm are vertically translatable along a mast.

36. The drilling rig of claim 35, wherein the tubular delivery arm and the top drive assembly have non-conflicting vertical paths along the mast.

37. The drilling rig of claim 35, wherein the top drive assembly has a top drive vertically translatable along a first path over the well center and along a second path rearward to a drawworks side of well center.

38. The drilling rig of claim 35, wherein the top drive assembly has a top drive horizontally movable between the well center position and a retracted position rearward to a drawworks side of the well center position.

39. The drilling rig of claim 35, wherein the top drive assembly comprises:

a dolly translatably connected to the mast;

a travelling block assembly;

a top drive suspended from the travelling block assembly;

a yoke pivotally connecting the travelling block to the dolly;

an extendable actuator connected between the dolly and the yoke;

a torque tube rigidly connected to the travelling block;

the torque tube connected to the top drive in vertically slidable relation;

wherein extension of the actuator pivots the yoke to extend the travelling block and top drive away from the dolly to well center position; and wherein retraction of the actuator pivots the yoke to retract the travelling block towards the dolly to a position away from the well center.

40. The drilling rig of claim 39, wherein torque reactions of a drill string responding to rotation by the top drive are transferred from the top drive to the torque tube, from the torque tube to the travelling block, from the travelling block to the dolly, and from the dolly to the mast.

41. The drilling rig of claim 25, further comprising a leg, a lower stabilizing arm pivotally and rotatably connected to the leg, and a tubular guide connected to the lower stabilizing arm and movable between the stand hand-off position and the well center position.

42. The drilling rig of claim 2, further comprising an upper racking arm comprising a gripper movable over a fingerboard assembly and the stand hand-off position.

43. The drilling rig of claim 42, wherein the upper racking arm comprises:

a bridge connected to a frame in translatable relation;

a racking arm connected to the bridge in rotatable and translatable relation; and the gripper connected to the arm in vertically translatable relation.

44. The drilling rig of claim 42, wherein the racking module is connected to a mast, and the racking module further comprises:

a frame;

wherein the fingerboard assembly is connected to the frame and has columns receivable of tubular stands, the columns optionally oriented in a direction towards the mast;

a fingerboard alleyway connecting the columns on a mast side of the columns.

45. The drilling rig of claim 44, further comprising:

wherein the setback platform is positioned beneath the fingerboard assembly;

a platform alleyway beneath the fingerboard alleyway; and a lower racking arm positioned in the platform alleyway. a lower racking base connected to the platform alleyway in translatable relation;

a lower racking frame connected to the base in rotatable and pivotal relation;

a lower racking arm member pivotally connected to the frame; and a lower racking clasp pivotally connected to the arm.

46. The drilling rig of claim 45, wherein the lower racking arm further comprises:

a lower racking base connected to the platform alleyway in translatable relation;

a lower racking frame connected to the base in rotatable and pivotal relation;

a lower racking arm member pivotally connected to the frame; and a lower racking clasp pivotally connected to the arm.

47. A drilling rig, comprising:

a substructure comprising a pair of base boxes;

a drill floor above the substructure;

a setback platform below and forward of the drill floor;

a mast extending vertically above the drill floor;

a top drive assembly vertically translatable along the mast;

a tubular delivery arm vertically translatable along the mast;

the tubular delivery arm having a tubular clasp movable between a well center position over a well center and a stand hand-off position forward of the well center position;

the top drive assembly being vertically translatable along a first path over the well center and along a second path rearward of the first path;

a racking module extending outward of the mast above the set-back platform;

a stand hand-off position located on the setback platform, and extending vertically upwards substantially between the mast and a fingerboard assembly of the racking module; and an upper stand constraint connected beneath the racking module and extendable rearward towards the mast.

48. The drilling rig of claim 47, further comprising:

an intermediate stand constraint having a frame connected to the drilling rig at an edge of the V-door side of the drill floor;

a carriage connected to the frame in extendable relationship;

a carriage actuator connected between the frame and the carriage, and operable to extend or retract the carriage outward from the frame;

a tubular clasp attached to the extendable end of the carriage;

a clasp actuator connected to the tubular clasp, and operable to open or close the tubular clasp around a tubular stand;

a tubular gripper attached to the extendable end of the carriage; and a gripper actuator connected to the tubular gripper, and operable to open or close the tubular gripper around a tubular stand.

49. A drilling rig, comprising:

a retractable top drive assembly vertically translatable along a mast;

a tubular delivery arm vertically translatable along the mast and comprising a tubular clasp movable between a well center position over a well center and a position forward of the well center;

wherein the tubular clasp is engageable with an upper end of a tubular stand; and wherein the tubular clasp is slidably engageable with the tubular stand below the upper end to clasp an upper portion of the tubular stand in the well center position below the upper end.

* * * * *